US008741820B2

(12) United States Patent
Akao et al.

(10) Patent No.: US 8,741,820 B2
(45) Date of Patent: Jun. 3, 2014

(54) LUBRICATION KIT AND SMALL ELECTRONIC DEVICE USING THE SAME

(75) Inventors: Yuji Akao, Nakano-ku (JP); Masahiro Furuya, Minamitsurugun (JP)

(73) Assignee: Citizen Electronics Co., Ltd., Yamanashi (JP)

( * ) Notice: Subject to any disclaimer, the term of this patent is extended or adjusted under 35 U.S.C. 154(b) by 201 days.

(21) Appl. No.: 13/142,214

(22) PCT Filed: Dec. 25, 2009

(86) PCT No.: PCT/JP2009/071629

§ 371 (c)(1),
(2), (4) Date: Jun. 24, 2011

(87) PCT Pub. No.: WO2010/074242

PCT Pub. Date: Jul. 1, 2010

(65) Prior Publication Data

US 2011/0257053 A1 Oct. 20, 2011

(30) Foreign Application Priority Data

Dec. 26, 2008 (JP) ..... 2008-334166
Dec. 26, 2008 (JP) ..... 2008-334167

(51) Int. Cl.
*C10M 169/04* (2006.01)

(52) U.S. Cl.
USPC ..... 508/110

(58) Field of Classification Search
USPC ..... 508/110
See application file for complete search history.

(56) References Cited

U.S. PATENT DOCUMENTS

| | | | | |
|---|---|---|---|---|
| 4,415,419 | A * | 11/1983 | Niederhaeuser et al. | 204/192.15 |
| 7,385,880 | B2 | 6/2008 | Akao | |
| 8,242,063 | B2 | 8/2012 | Kawamura et al. | |
| 2003/0050197 | A1 * | 3/2003 | Akao | 508/280 |
| 2005/0014658 | A1 * | 1/2005 | Akao | 508/280 |
| 2008/0132341 | A1 | 6/2008 | Momiyama et al. | |

FOREIGN PATENT DOCUMENTS

| | | | |
|---|---|---|---|
| CN | 101065472 | A | 10/2007 |
| CN | 101189321 | A | 5/2008 |
| JP | 59-155497 | A | 9/1984 |
| JP | 2002-348586 | A | 12/2002 |
| JP | 2004-91785 | A | 3/2004 |
| JP | 2004091785 | A * | 3/2004 |
| JP | 2004-364490 | A | 12/2004 |
| WO | 01/59043 | A1 | 8/2001 |
| WO | 2004/018594 | A1 | 3/2004 |

* cited by examiner

*Primary Examiner* — Taiwo Oladapo
(74) *Attorney, Agent, or Firm* — Sughrue Mion, PLLC

(57) ABSTRACT

[Object] To provide a lubrication kit which is capable of improving wear resistance and durability of a sliding portion mounted in a small electronic device and which is capable of reducing a sound generated during driving.

[Solution] A lubrication kit used for a small electronic device having a sliding portion, according to the present invention comprises at least one lubricant selected from a lubricant (1) comprising an anti-wear agent and a base oil which contains a polyol ester oil and/or a paraffinic hydrocarbon oil and a lubricant (2) comprising an anti-wear agent, polytetrafluoroethylene particles, and a base oil which contains a polyol ester oil and/or a paraffinic hydrocarbon oil, and a surface-treating agent obtained from a fluorine type surfactant and a phosphoric ester having a hydrocarbon group in which a part or all of hydrogen atoms have been substituted with a fluorine atom.

3 Claims, 2 Drawing Sheets

LUBRICATION KIT AND SMALL ELECTRONIC DEVICE USING THE SAME

CROSS REFERENCE TO RELATED APPLICATIONS

This application is a National Stage of International Application No. PCT/JP2009/071629, filed on Dec. 25, 2009, the contents of which are incorporated herein by reference in their entirety.

TECHNICAL FIELD

The present invention relates to a lubrication kit and a small electronic device using the same. In more particular, the present invention relates to a lubrication kit comprising a lubricant and a surface-treating agent and a small electronic device using the lubrication kit. In addition, the present invention relates to a lubricant and a small electronic device using the same. In more particular, the present invention relates to a lubricant comprising a base oil and an anti-wear agent and a small electronic device (such as a portable electronic device having an actuator) using the lubricant. In addition, the present invention relates to a surface-treating agent and a small electronic device using the same. In more particular, the present invention relates to a surface-treating agent obtained from a fluorine type surfactant and a phosphoric ester having a hydrocarbon group in which a part or all of hydrogen atoms have been substituted with a fluorine atom and a small electronic device (such as a portable electronic device having an actuator) using the surface-treating agent.

BACKGROUND ART

Portable electronic devices (such as a cellular phone, a PHS, a personal digital assistant, a portable computer (mobile computer), and a digital camera), each of which include an optical zoom function together with an electronic camera and which can change a photographing field angle, have begun to spread. By the electronic camera described above, animations are frequently taken besides still pictures. In the portable electronic device as described above, as means for changing a photographing field angle, in particular, an actuator for moving a camera module, such as a lens, is mounted.

In Patent Literature 1, as the actuator described above, an actuator has been disclosed which has, between two housings, a motor having a rotor, two torque increasing gears for increasing a rotary torque generated from the motor, and an output gear which is engaged with one of the above gears and which outputs a power to drive a driven mechanism.

CITATION LIST

Patent Literature

[PTL 1]: Japanese Unexamined Patent Application Publication No. 2004-364490

SUMMARY OF INVENTION

Technical Problem

However, in the above actuator, sliding portions formed between the rotor and the housings and between the gears and the housings are liable to be worn out, and hence the durability has been a problem. Furthermore, the portable electronic device is also required to be usable even at a low temperature of approximately −40° C. However, the wear resistance can hardly be improved even if a conventionally known lubricant is used, and in addition, since this lubricant is deteriorated at a low temperature, the actuator cannot be unfavorably driven.

In addition, the actuator described above has a problem due to a loud sound generated during driving. In particular, when an animation is taken, the sound generated during driving may also be disadvantageously recorded in some cases.

In addition, the durability and the sound as described above have also been a problem of a small electronic device which has a sliding portion other than an actuator.

Hence, an object of the present invention is to provide a lubricant which can improve wear resistance and durability of a sliding portion mounted in a small electronic device (such as an actuator mounted in a portable electronic device) in the use at a low temperature as well as at ordinary temperature.

In addition, an another object of the present invention is to provide a surface-treating agent which can reduce a sound generated from a sliding portion mounted in a small electronic device (such as an actuator mounted in a portable electronic device) during driving.

Furthermore, a still another object of the present invention is to provide a lubrication kit which can improve wear resistance and durability of a sliding portion mounted in a small electronic device and which can reduce a sound generated during driving.

Solution to Problem

The present inventors found that the objects described above can be achieved by using a specific lubricant and a specific surface-treating agent in combination.

That is, the present invention relates to the following [1] to [3].

[1] A lubrication kit used for a small electronic device having a sliding portion, comprises: at least one lubricant selected from a lubricant (1) comprising an anti-wear agent and a base oil containing a polyol ester oil and/or a paraffinic hydrocarbon oil, 85 to 99.5 parts by mass of the base oil and 0.5 to 15 parts by mass of the anti-wear agent being comprised with respect to 100 parts by mass of the total of the base oil and the anti-wear agent and a lubricant (2) comprising an anti-wear agent, polytetrafluoroethylene particles, and a base oil containing a polyol ester oil and/or a paraffinic hydrocarbon oil, 85 to 99.5 parts by mass of the base oil and 0.5 to 15 parts by mass of the anti-wear agent being comprised with respect to 100 parts by mass of the total of the base oil and the anti-wear agent, 30 to 50 parts by mass of the polytetrafluoroethylene particles being comprised with respect to 100 parts by mass of the total of the base oil and the anti-wear agent; and a surface-treating agent obtained from a fluorine type surfactant and a phosphoric ester having a hydrocarbon group in which a part or all of hydrogen atoms have been substituted with a fluorine atom.

[2] A small electronic device comprises: a sliding portion, wherein the sliding portion is adhered with at least one lubricant selected from a lubricant (1) comprising an anti-wear agent and a base oil containing a polyol ester oil and/or a paraffinic hydrocarbon oil, 85 to 99.5 parts by mass of the base oil and 0.5 to 15 parts by mass of the anti-wear agent being comprised with respect to 100 parts by mass of the total of the base oil and the anti-wear agent and a lubricant (2) including an anti-wear agent, polytetrafluoroethylene particles, and a base oil containing a polyol ester oil and/or a paraffinic hydrocarbon oil, 85 to 99.5 parts by mass of the base oil and 0.5 to 15 parts by mass of the anti-wear agent being comprised with respect to 100 parts by mass of the total of the base oil and the anti-wear agent, 30 to 50 parts by mass of the polytetrafluoroethylene particles being comprise with respect to 100 parts by mass of the total of the base oil and the anti-wear agent; and a surface-treating agent obtained from a fluorine type surfactant and a phosphoric ester having a hydrocarbon group in which a part or all of hydrogen atoms have been substituted with a fluorine atom.

[3] A method for manufacturing a small electronic device having a sliding portion, comprises a step of: adhering, to the sliding portion, at least one lubricant selected from a lubricant (1) comprising an anti-wear agent and a base oil containing a polyol ester oil and/or a paraffinic hydrocarbon oil, 85 to 99.5 parts by mass of the base oil and 0.5 to 15 parts by mass of the anti-wear agent being comprised with respect to 100 parts by mass of the total of the base oil and the anti-wear agent and a lubricant (2) comprising an anti-wear agent, polytetrafluoroethylene particles, and a base oil containing a polyol ester oil and/or a paraffinic hydrocarbon oil, 85 to 99.5 parts by mass of the base oil and 0.5 to 15 parts by mass of the anti-wear agent being comprised with respect to 100 parts by mass of the total of the base oil and the anti-wear agent, 30 to 50 parts by mass of the polytetrafluoroethylene particles being comprised with respect to 100 parts by mass of the total of the base oil and the anti-wear agent; and a surface-treating agent obtained from a fluorine type surfactant and a phosphoric ester having a hydrocarbon group in which a part or all of hydrogen atoms have been substituted with a fluorine atom.

The present inventors found that the above objects can be achieved by using a lubricant which includes a specific base oil and an specific anti-wear agent at a specific ratio.

That is, the present invention relates to the following [A1] to [A27].

[A1] A lubricant comprises an anti-wear agent and a base oil containing a polyol ester oil and/or a paraffinic hydrocarbon oil, 85 to 99.5 parts by mass of the base oil and 0.5 to 15 parts by mass of the anti-wear agent being comprised with respect to 100 parts by mass of the total of the base oil and the anti-wear agent.

[A2] In the lubricant described in [A1], the anti-wear agent is a neutral phosphoric ester and/or a neutral phosphorous ester.

[A3] In the lubricant described in [A1] or [A2], the lubricant has a change in weight of 1.62 percent by mass or less after allowed to stand at 90° C.

[A4] In the lubricant described in one of [A1] to [A3], the lubricant has a total acid number of 0.2 mgKOH/g or less.

[A5] In the lubricant described in one of [A1] to [A4], the polyol ester oil is a polyol ester having no hydroxyl group at every molecular end.

[A6] In the lubricant described in one of [A1] to [A5], the paraffinic hydrocarbon oil is an α-olefin polymer having 15 carbon atoms or more.

[A7] The lubricant described in one of [A1] to [A6] further comprises a metal deactivator.

[A8] In the lubricant described in [A7], the metal deactivator is benzotriazole or its derivative.

[A9] The lubricant described in one of [A1] to [A8] further comprises an antioxidant.

[A10] The lubricant described in one of [A1] to [A9] further comprises a fluorescent agent.

[A11] A lubricant comprises an anti-wear agent, polytetrafluoroethylene particles, and a base oil containing a polyol ester oil and/or paraffinic hydrocarbon oil, 85 to 99.5 parts by mass of the base oil and 0.5 to 15 parts by mass of the anti-wear agent being comprised with respect to 100 parts by mass of the total of the base oil and the anti-wear agent, 30 to 50 parts by mass of the polytetrafluoroethylene particles being comprised with respect to 100 parts by mass of the total of the base oil and the anti-wear agent.

[A12] In the lubricant described in [A11], the anti-wear agent is a neutral phosphoric ester and/or a neutral phosphorous ester.

[A13] In the lubricant described in [A11] or [A12], the content of some of the polytetrafluoroethylene particles, which have a particle diameter of 1 μm or less, is 90 percent by mass or more.

[A14] In the lubricant described in one of [A11] to [A13], the polytetrafluoroethylene particles have an aspect ratio of 0.5 to 1.0.

[A15] In the lubricant described in one of [A11] to [A14], the lubricant has a change in weight of 1.62 percent by mass or less after allowed to stand at 90° C.

[A16] In the lubricant described in one of [A11] to [A15], the lubricant has a total acid number of 0.2 mgKOH/g or less.

[A17] In the lubricant described in one of [A11] to [A16], the polyol ester oil is a polyol ester having no hydroxyl group at every molecular end.

[A18] In the lubricant described in one of [A11] to [A17], the paraffinic hydrocarbon oil is an α-olefin polymer having 15 carbon atoms or more.

[A19] The lubricant described in one of [A11] to [A18] further comprises a metal deactivator.

[A20] In the lubricant described in [A19], the metal deactivator is benzotriazole or its derivative.

[A21] The lubricant described in one of [A11] to [A20] further comprises an antioxidant.

[A22] The lubricant described in one of [A11] to [A21] further comprises a fluorescent agent.

[A23] An actuator comprises, between two housings, a motor having a rotor, at least one torque increasing gear which increases a rotary torque generated from the motor, and an output gear which is engaged with the gear and which outputs a power to drive a driven mechanism, wherein the lubricant described in one of [A1] to [A10] or the lubricant described in one of [A11] to [A22] is adhered to one of a first sliding portion formed between each housing and the rotor, a second sliding portion formed between each housing and the torque increasing gear, and a third sliding portion formed between each housing and the output gear.

[A24] In the actuator described in [A23], the lubricant described in one of [A1] to [A10] is adhered to the first sliding portion and the second sliding portion, and the lubricant described in one of [A11] to [A22] is adhered to the third sliding portion.

[A25] In the actuator described in [A23], at least two of the torque increasing gears are engaged with each other, the lubricant described in one of [A11] to [A22] is adhered to the second sliding portion of the torque increasing gear which is engaged with the output gear, the lubricant described in one of [A1] to [A10] is adhered to the second sliding portion of the torque increasing gear which is not engaged with the output gear, the lubricant described in one of [A1] to [A10] is adhered to the first sliding portion, and the lubricant described in one of [A11] to [A22] is adhered to the third sliding portion.

[A26] In the actuator described in one of [A23] to [A25], the housing side of one of the sliding portions is processed by a surface-treating agent, and the surface-treating agent is obtained from a fluorine type surfactant and a phosphoric ester having a hydrocarbon group in which a part or all of hydrogen atoms have been substituted with a fluorine atom.

[A27] A portable electronic device comprises the actuator described in one of [A23] to [A26].

The present inventors found that the above objects can be achieved by using a specific phosphoric ester in combination with a specific fluorine type surfactant.

That is, the present invention relates to the following [B1] to [B9].

[B1] A surface-treating agent is obtained from a fluorine type surfactant and a phosphoric ester which has a hydrocarbon group in which a part or all of hydrogen atoms have been substituted with a fluorine atom.

[B2] The surface-treating agent described in [B1] is obtained from, with respect to 100 parts by mass of the total of the phosphoric ester and the fluorine type surfactant, 30 to 70 parts by mass of the phosphoric ester and 30 to 70 parts by mass of the fluorine type surfactant.

[B3] In the surface-treating agent described in [B1] or [B2], the phosphoric ester is a phosphoric ester represented by one of the following formulas (A) to (C).

[Chemical 1]

(A)

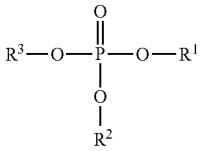

(In the formula (A), $R^1$, $R^2$, and $R^3$ each independently represent a chain or a branched aliphatic hydrocarbon group having 1 to 20 carbon atoms in which a part or all of hydrogen atoms have been substituted with a fluorine atom or a hydrocarbon group containing an aromatic ring having 6 to 20 carbon atoms in which a part or all of hydrogen atoms have been substituted with a fluorine atom.)

[Chemical 2]

(B)

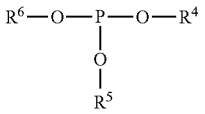

(In the formula (B), $R^4$, $R^5$, and $R^6$ each independently represent a chain or a branched aliphatic hydrocarbon group having 1 to 20 carbon atoms in which a part or all of hydrogen atoms have been substituted with a fluorine atom or a hydrocarbon group containing an aromatic ring having 6 to 20 carbon atoms in which a part or all of hydrogen atoms have been substituted with a fluorine atom.)

[Chemical 3]

(C)

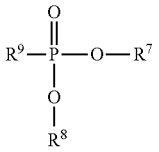

(In the formula (C), $R^7$ and $R^8$ each independently represent a chain or a branched aliphatic hydrocarbon group having 1 to 20 carbon atoms in which a part or all of hydrogen atoms have been substituted with a fluorine atom or a hydrocarbon group containing an aromatic ring having 6 to 20 carbon atoms in which a part or all of hydrogen atoms have been substituted with a fluorine atom. $R^9$ represents an acetyl group or a methoxycarbonylmethyl group.)

[B4] The surface-treating agent described in one of [B1] to [B3] is obtained by dissolving the phosphoric ester and the fluorine type surfactant in a solvent having a boiling point of 180° C. or less.

[B5] In the surface-treating agent described in [B4], the solvent is an alcohol, a hydrocarbon, an ether, or a ketone.

[B6] In the surface-treating agent described in one of [B1] to [B5], the fluorine type surfactant is a nonionic surfactant.

[B7] An actuator comprises, between two housings, a motor having a rotor, at least one torque increasing gear which increases a rotary torque generated from the motor, and an output gear which is engaged with the gear and which outputs a power to drive a driven mechanism, wherein the actuator has a first sliding portion formed between each housing and the rotor, a second sliding portion formed between each housing and the torque increasing gear, and a third sliding portion formed between each housing and the output gear, and the housing side of one of the sliding portions is processed by the surface-treating agent described in one of [B1] to [B6].

[B8] In the actuator described in [B7], a lubricant is adhered to one of the first sliding portion formed between each housing and the rotor, the second sliding portion formed between each housing and the torque increasing gear, and the third sliding portion formed between each housing and the output gear, and the lubricant is a lubricant comprising an anti-wear agent and a base oil containing a polyol ester oil and/or a paraffinic hydrocarbon oil, in which with respect to 100 parts by mass of the total of the base oil and the anti-wear agent, 85 to 99.5 parts by mass of the base oil and 0.5 to 15 percent by mass of the anti-wear agent are comprised, or a lubricant including an anti-wear agent, polytetrafluoroethylene particles, and a base oil containing a polyol ester oil and/or a paraffinic hydrocarbon oil, in which 85 to 99.5 parts by mass of the base oil and 0.5 to 15 parts by mass of the anti-wear agent are comprised with respect to 100 parts by mass of the total of the base oil and the anti-wear agent, and 30 to 50 parts by mass of the polytetrafluoroethylene particles is comprised with respect to 100 parts by mass of the total of the base oil and the anti-wear agent.

[B9] A portable electronic device comprises the actuator described in [B7] or [B8].

In addition, the present invention relates to the following [C1] to [C4].

[C1] A watch comprising: a sliding portion processed by a surface-treating agent and a lubricating oil composition, wherein the surface-treating agent is obtained from a fluorine type surfactant and a phosphoric ester having a hydrocarbon group in which a part or all of hydrogen atoms have been substituted with a fluorine atom, and the lubricating oil composition comprises a base oil containing a polyol ester (A), 0.1 to 20 percent by weight of a viscosity index improver (B) and 0.1 to 8 percent by weight of an anti-wear agent (C).

[C2] A watch comprising: a sliding portion processed by a surface-treating agent and a lubricating oil composition, wherein the surface-treating agent is obtained from a fluorine type surfactant and a phosphoric ester having a hydrocarbon group in which a part or all of hydrogen atoms have been substituted with a fluorine atom, and the lubricating oil composition comprises a base oil containing a paraffinic hydrocarbon oil (F) having 30 carbon atoms or more and 0.1 to 15 percent by weight of a viscosity index improver (B).

[C3] A watch comprising: a sliding portion processed by a surface-treating agent and a lubricating oil composition, wherein the surface-treating agent is obtained from a fluorine type surfactant and a phosphoric ester having a hydrocarbon group in which a part or all of hydrogen atoms have been substituted with a fluorine atom, and the lubricating oil composition comprises a base oil containing an ether oil (G), an anti-wear agent (C) and an antioxidant (E), the anti-wear agent (C) is a neutral phosphoric ester and/or a neutral phosphorous ester, and the content of the anti-wear agent (C) is 0.1 to 8 percent by weight.

[C4] A watch comprising: a sliding portion processed by a surface-treating agent and a lubricating oil composition, wherein the surface-treating agent is obtained from a fluorine type surfactant and a phosphoric ester having a hydrocarbon group in which a part or all of hydrogen atoms have been substituted with a fluorine atom, and the lubricating oil composition comprises a base oil containing at least a polyol ester or a paraffinic hydrocarbon oil having 30 carbon atoms or more and has a viscosity of 200 to 400 mPa·s at 20° C.

Advantageous Effects of Invention

According to the lubricant of the present invention, in the use at a low temperature as well as at ordinary temperature, the wear resistance and the durability of a sliding portion mounted in a small electronic device (such as an actuator mounted in a portable electronic device) can be improved.

In addition, according to the surface-treating agent of the present invention, a sound generated from a sliding portion mounted in a small electronic device (such as an actuator mounted in a portable electronic device) can be reduced, that is, this sliding portion (such as an actuator) can be silenced.

In addition, according to the lubrication kit of the present invention, the wear resistance and the durability of a sliding portion mounted in a small electronic device can be improved, and a sound generated during driving can be reduced.

DESCRIPTION OF EMBODIMENTS

A. Lubricant

Figure 1:
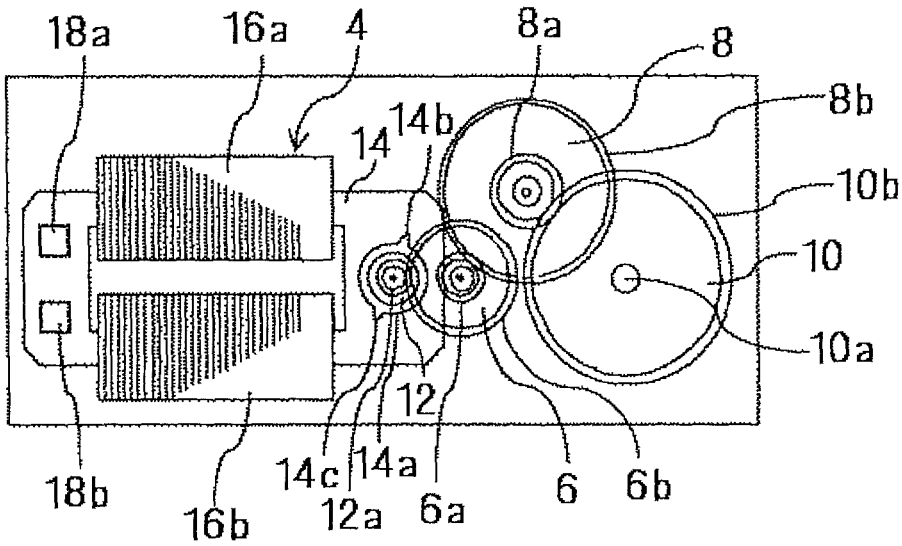
FIG. 1 is a view illustrating an actuator according to the present invention.

First, a lubricant according to the present invention, a sliding portion (such as an actuator) of a small electronic device using this lubricant, and a small electronic device including this sliding portion (such as a portable electronic device including an actuator) will be concretely described.

<Lubricant (1)>

A lubricant (1) according to the present invention includes an anti-wear agent and a base oil which contains a polyol ester oil and/or a paraffinic hydrocarbon oil.

The polyol ester oil used as the base oil is, in particular, an ester having a structure obtained by a reaction between a polyol having at least two hydroxyl groups in one molecule and at least one type of a monobasic acid or an acid chloride. When the polyol ester oil as described above is used, the solubility to dissolve additives added to the lubricant is high, and hence the room for selection of additives is increased. In addition, since having lubricity, the above polyol ester oil is suitably used.

As the polyol, for example, neopentyl glycol, trimethylolpropane, pentaerythritol, and dipentaerythritol may be mentioned.

As the monobasic acid, for example, there may be mentioned saturated aliphatic carboxylic acids, such as acetic acid, propionic acid, butyric acid, isobutyric acid, valeric acid, pivalic acid, heptanoic acid, octanoic acid, nonanoic acid, decanoic acid, lauric acid, myristic acid, and palmitic acid; unsaturated aliphatic carboxylic acids, such as stearic acid, acrylic acid, propiolic acid, crotonic acid, and oleic acid; and cyclic carboxylic acids, such as benzoic acid, toluic acid, naphthoic acid, cinnamic acid, cyclohexane carboxylic acid, nicotinic acid, isonicotinic acid, 2-furoic acid, 1-pyrrole carboxylic acid, monoethyl malonate, and monoethyl hydrogen phthalate.

As the acid chloride, for example, salts, such as chlorides of the above monobasic acids, may be mentioned.

As these products, for example, there may be mentioned a neopentyl glycol caprylate caprate mixed ester, a trimethylolpropane valerate heptanoate mixed ester, a trimethylolpropane decanoate octanoate mixed ester, trimethylolpropane nonanoate, and a pentaerythritol heptanoate caprate mixed ester. In addition, in the lubricant (1), as the base oil, only one type of polyol ester oil may be used, or at least two types of polyol ester oils may also be used by mixing.

As the polyol ester oil used for the lubricant (1), in view of viscosity and evaporation rate, a polyol ester having three hydroxyl groups or less is preferable, and a perfect ester having no hydroxyl group is more preferable.

In addition, the kinematic viscosity of the polyol ester oil is preferably 2,500 cSt or less at −40° C. Incidentally, the kinematic viscosity is usually 500 cSt or more at −40° C.

The paraffinic hydrocarbon oil used as the above base oil is formed of an α-olefin polymer in which the total number of carbon atoms is preferably 15 or more, more preferably 15 to 35, and even more preferably 20 to 30. Since the paraffinic hydrocarbon oil as described above has no polarity, even if a member of the sliding portion (actuator) is formed of a plastic, the member is, advantageously, not degraded thereby.

The α-olefin polymer having 15 carbon atoms or more is a polymer which has 15 carbon atoms or more in total and which is a homopolymer of ethylene and an α-olefin having 3 to 18 carbon atoms or a copolymer of at least two types selected from ethylene and α-olefins each having 3 to 18 carbon atoms. In particular, as the polymer described above, for example, a trimer of 1-decene, a trimer of 1-undecene, a trimer of 1-dodecen, a trimer of 1-tridecene, a trimer of 1-tetradecene, and a copolymer of 1-hexene and 1-pentene may be mentioned. In addition, a polymer which has 15 carbon atoms or more in total and which is formed by polymerizing at least one of 1-butene, 1-pentene, 1-hexene, 1-heptene, 1-octene, 1-nonene, 1-decene, 1-undecene, and 1-dodecen is also suitably used. In addition, in the lubricant (1), as the base oil, only one type of paraffinic hydrocarbon oil may be used, or at least two types of paraffinic hydrocarbon oils may also be used by mixing.

In addition, as the base oil, at least one type of polyol ester oil and at least one type of paraffinic hydrocarbon oil may also be used by mixing. When the base oil as described above is used, the lubricant (1) is not likely to flow from a position to which the lubricant (1) is supplied, and the member is suppressed from being eroded; hence, a lubricant (1) having more superior balance can be obtained.

As the anti-wear agent, a neutral phosphoric ester and/or a neutral phosphorous ester is suitably used. Incidentally, if a metal-based anti-wear agent, a sulfide-based anti-wear agent, an acid phosphoric ester-based anti-wear agent, an acid phosphorous ester-based anti-wear agent, an acid phosphoric ester amine-salt anti-wear agent or the like is used, the member of the sliding portion (actuator) is corroded, and rust may be generated in some cases. As a result, an unnecessary sound may be generated in some cases when the sliding portion (actuator) is driven. When an animation is taken by a small electronic device having the sliding portion as described above (portable electronic device having an actuator), a sound generated during this driving may also be disadvantageously recorded. On the other hand, if a neutral phosphoric ester and/or a neutral phosphorous ester is used, the above problem is not likely to occur.

As the neutral phosphoric ester, a phosphoric ester represented by the following formula (1) may be mentioned.

[Chemical 4]

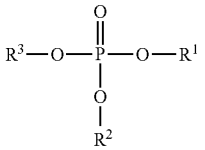

(1)

(In the formula (1), $R^1$, $R^2$, and $R^3$ each independently represent a chain or a branched aliphatic hydrocarbon group having 1 to 20 carbon atoms or a hydrocarbon group containing an aromatic ring having 6 to 20 carbon atoms.)

Among these mentioned above, since the wear resistance and the durability at a low temperature can be further improved, $R^1$, $R^2$, and $R^3$ each preferably independently represent a chain or a branched aliphatic hydrocarbon group having 12 to 18 carbon atoms or a phenyl group which may contain a chain or a branched aliphatic hydrocarbon group having 1 to 10 carbon atoms as a substituent (in this case, when a plurality of substituents is present, the total number of carbon atoms of these substituents is 1 to 14), and a dodecyl group, a tridecyl group, an oleyl group, a stearyl group, a phenyl group, a cresyl group, a dimethylphenyl group, a di-t-butylphenyl group, or a nonylphenyl group is more preferable.

As the neutral phosphoric ester described above, in particular, there will be preferably used trioleyl phosphate, tricresyl phosphate, trixylenyl phosphate, triphenyl phosphate, tris(nonylphenyl) phosphate, tris(tridecyl) phosphate, tristearyl phosphate, and tris(2,4-di-t-butylphenyl) phosphate.

In addition, a neutral phosphoric ester other than the neutral phosphoric ester represented by the formula (1) may also be suitably used. As the above neutral phosphoric ester, for example, there may be mentioned trimethylolpropane phosphate, tetraphenyldipropylene glycol diphosphate, tetraphenyltetra(tridecyl)pentaerythritol tetraphosphate, tetra(tridecyl)-4,4'-isopropylidenediphenyl diphosphate, bis(tridecyl) pentaerythritol diphosphate, bis(nonylphenyl)pentaerythritol diphosphate, distearyl pentaerythritol diphosphate, or a hydrogenated bisphenol A/pentaerythritol phosphate polymer.

As the neutral phosphorous ester, a phosphoric ester represented by the following formula (2) may be mentioned.

[Chemical 5]

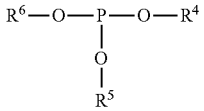

(2)

(In the formula (2), $R^4$, $R^5$, and $R^6$ each independently represent a chain or a branched aliphatic hydrocarbon group having 1 to 20 carbon atoms or a hydrocarbon group containing an aromatic ring having 6 to 20 carbon atoms.)

Among these mentioned above, since the wear resistance and the durability at a low temperature can be further improved, $R^4$, $R^5$, and $R^6$ each preferably independently represent a chain or a branched aliphatic hydrocarbon group having 12 to 18 carbon atoms or a phenyl group which may contain a chain or a branched aliphatic hydrocarbon group having 1 to 10 carbon atoms as a substituent (in this case, when a plurality of substituents is present, the total number of carbon atoms of these substituents is 1 to 14), and a dodecyl group, a tridecyl group, an oleyl group, a stearyl group, a phenyl group, a cresyl group, a dimethylphenyl group, a di-t-butylphenyl group, or a nonylphenyl group is more preferable.

As the neutral phosphorous ester described above, in particular, there may be suitably used trioleyl phosphite, tricresyl phosphite, trixylenyl phosphite, triphenyl phosphite, tris (nonylphenyl) phosphite, tris(tridecyl) phosphite, tristearyl phosphite, and tris(2,4-di-t-butylphenyl) phosphite.

In addition, a neutral phosphorous ester other than the neutral phosphorous ester represented by the formula (2) may also be suitably used. As the above neutral phosphoric ester, for example, there may be mentioned trimethylolpropane phosphite, tetraphenyldipropylene glycol diphosphite, tetraphenyltetra(tridecyl)pentaerythritol tetraphosphite, tetra (tridecyl)-4,4'-isopropylidenediphenyl diphosphite, bis (tridecyl)pentaerythritol diphosphite, bis(nonylphenyl) pentaerythritol diphosphite, distearyl pentaerythritol diphosphite, or a hydrogenated bisphenol A/pentaerythritol phosphite polymer.

The above neutral phosphoric esters may be used alone, or at least two types thereof may also be used in combination. The case described above is also applied to the above neutral phosphorous esters. In addition, at least one type of neutral phosphoric ester and at least one type of neutral phosphorous ester may be used in combination.

In addition, in the lubricant (1), with respect to 100 parts by mass of the total of the base oil and the anti-wear agent, 85 to 99.5 parts by mass, preferably 95 to 99 parts by mass, and more preferably 95 to 97 parts by mass of the base oil is included, and 0.5 to 15 parts by mass, preferably 1 to 5 parts by mass, and more preferably 3 to 5 parts by mass of the anti-wear agent is included. As described above, since including a specific base oil and a specific anti-wear agent at a specific ratio, if the lubricant (1) is used at a sliding portion (sliding portion of an actuator) of a small electronic device, the wear is suppressed, and the durability can be improved. In addition, the wear resistance and the durability can be improved in a wide temperature range from a low temperature to a high temperature (−40° C. to 80° C.). If more than 15 parts by mass of the anti-wear agent is included, the member of the sliding portion (actuator) may be corroded in some cases. In addition, in the case in which at least two types of base oils are used by mixing, the above amount of the base oil is the total amount of the at least two types of base oils. In addition, the case described above is also applied to the amount of the anti-wear agent.

In addition, International Publication WO2001/059043 pamphlet has disclosed as a lubricant for a watch, a lubricating oil composition including, besides a base oil, 0.1 to 20 percent by mass of a viscosity index improver and 0.1 to 8 percent by mass of an anti-wear agent. However, this lubricating oil composition cannot always improve the wear resistance of a sliding portion (actuator) of a small electronic device. The reason for this is believed that the case is not taken into consideration in which a force applied to the sliding portion (sliding portion of the actuator) of the small electronic device is larger than that applied to a sliding portion of a watch. On the other hand, according to the lubricant (1) of the present invention, since the specific base oil and anti-wear agent are included at a specific ratio as described above, in the use at a low temperature as well as at ordinary temperature, the wear resistance and the durability of the sliding portion (actuator) of the small electronic device can be improved.

The lubricant (1) may further include a metal deactivator, an antioxidant, or a fluorescent agent.

The metal deactivator is added to prevent corrosion of the member of the sliding portion (actuator), and as this metal deactivator, benzotriazole or its derivative is suitably used.

As the benzotriazole derivatives, in particular, there may be mentioned 2-(2'-hydroxy-5'-methylphenyl)benzotriazole, 2-[2'-hydroxy-3',5'-bis(α,α-dimethylbenzyl)phenyl]-benzotriazole, 2-(2'-hydroxy-3',5'-di-t-butyl-phenyl)-benzotriazole, and a compound having the structure represented by the following formulas in which R, R', and R" each represent an alkyl group having 1 to 18 carbon atoms, such as 1-(N,N-bis(2-ethylhexyl)aminomethyl)benzotriazole.

[Chemical 6]

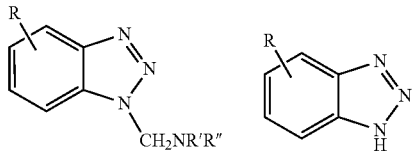

These compounds may be used alone, or at least two types thereof may also be used in combination.

In the lubricant (1), based on 100 parts by mass of the total of the base oil and the anti-wear agent, usually 0.01 to 3 parts by mass, preferably 0.02 to 3 parts by mass, and more preferably 0.03 to 0.06 parts by mass of the metal deactivator is used. When the metal deactivator in an amount in the range described above is used together with the anti-wear agent, corrosion of the member of the sliding portion (actuator) can be further prevented, and the total acid number of the lubricant (1) can be controlled in a preferable range.

The antioxidant is added to prevent deterioration of the lubricant (1) over a long period of time, and as this antioxidant, a phenol-based antioxidant and/or an amine-based antioxidant is suitably used.

The phenol-based antioxidant is preferably at least one compound selected from 2,6-di-t-butyl-p-cresol, 2,4,6-tri-t-butylphenol, and 4,4'-methylenebis(2,6-di-t-butylphenol. In addition, as the amine-based antioxidant, a diphenylamine derivative is preferable. These compounds may be used alone, or at least two types thereof may also be used in combination.

In the lubricant (1), based on 100 parts by mass of the total of the base oil and the anti-wear agent, usually 0.01 to 1.0 parts by mass, preferably 0.01 to 0.5 parts by mass, and more preferably 0.03 to 0.06 parts by mass of the antioxidant is used. When the antioxidant in an amount in the range described above is used, the deterioration of the lubricant (1) can be prevented over a longer period of time.

As the fluorescent agent, an inorganic or an organic fluorescent substance may be mentioned. The fluorescent agent can be used to judge whether the lubricant (1) is supplied to the sliding portion (sliding portion of the actuator) of the small electronic device or not. A small electronic device in which a sliding portion is mounted (portable electronic device such as a cellular phone in which an actuator is mounted) is rarely used by performing maintenance and/or repair work. Hence, for example, when a portable electronic device is assembled using an actuator, it is preferable that the lubricant (1) be reliably supplied to the sliding portion. For this reason, when the portable electronic device is assembled, it is usually checked whether the lubricant (1) is supplied to the sliding portion or not. In more particular, the sliding portion to which the lubricant (1) is supplied is irradiated with ultraviolet rays, and excited light such as fluorescence generated when the fluorescent agent receives ultraviolet rays is detected by visual inspection or a device having a photosensor, so that whether the lubricant (1) is supplied or not is confirmed.

As the organic fluorescent substance, for example, pyrene, perylene, 1,6 diphenyl-1,3,5-hexatriene, 1,8-diphenyl-1,3,5,7-octatetraene, and coumarin 6 may be mentioned. These compounds may be used alone, or at least two types thereof may also be used in combination.

In the lubricant (1), based on 100 parts by mass of the total of the base oil and the anti-wear agent, usually 0.01 to 0.5 parts by mass and preferably 0.05 to 0.2 parts by mass of the fluorescent agent is used.

The lubricant (1) preferably includes no viscosity index improver. When the viscosity index improver is not included, the wear resistance and the durability at a low temperature (down to −40° C.) can be further improved. In particular, if the viscosity index improver is included, the viscosity excessively increases at a low temperature, and the sliding property may be degraded in some cases. On the other hand, if the viscosity index improver is not included, the fluidity becomes high at a high temperature, and the wear resistance and the durability may be degraded in some cases. However, in the lubricant (1) according to the present invention, since a relatively large amount of the anti-wear agent is included, the problem as described above is not likely to occur.

As the viscosity index improver, for example, a homopolymer selected from a polyacrylate, a polymethacrylate, a polyisobutylene, a poly(alkyl styrene), a polyester, isobutylene fumarate, styrene maleate ester, and vinyl acetate fumarate ester, or a compound obtained by copolymerization, such as a poly(butadiene styrene) copolymer, a poly(methyl methacrylate-vinylpyrrolidone) copolymer, or an ethylene alkyl acrylate copolymer, may be mentioned.

As the polyacrylate and polymethacrylate, in particular, a polymer of acrylic acid or methacrylic acid, or a polymer of an alkyl ester having 1 to 10 carbon atoms may be mentioned. As the poly(alkyl styrene), in particular, for example, a polymer of a monoalkyl styrene having a substituent of 1 to 18 carbon atoms, such as a poly(α-methyl styrene), a poly(β-methyl styrene), a poly(α-ethyl styrene), or a poly(β-ethyl styrene), may be mentioned. As the polyester, for example, there may be mentioned a polyester obtained from a polyhydric alcohol, such as ethylene glycol, propylene glycol, neopentyl glycol, or dipentaerythritol, having 1 to 10 carbon atoms and a polybasic acid, such as oxalic acid, malonic acid, succinic acid, glutaric acid, adipic acid, fumaric acid, or phthalic acid. As the α-olefin copolymer, in particular, for example, there may be mentioned an ethylene propylene copolymer formed of recurring units derived from ethylene and recurring units derived from isopropylene, and in addition, for example, a reaction product obtained by copolymerizing α-olefins, such as ethylene, propylene, butylene, and butadiene, having 2 to 18 carbon atoms may also be mentioned.

The lubricant (1) is prepared by appropriately mixing the components described above.

When the lubricant (1) is allowed to stand at 90° C., the change in weight thereof is 1.62 percent by mass or less, preferably 1.0 percent by mass or less, and more preferably 0.5 percent by mass or less. Since a smaller change in weight is more preferable, the lower limit thereof is not particularly specified but is generally approximately 0.01 percent by mass. If the change in weight, that is, if the evaporation loss (in this specification, also referred to as an evaporation rate in some cases), obtained when the lubricant is allowed to stand at 90° C. is in the range described above, operation stability for a long period of time can be improved in a wide range from a low temperature to a high temperature (in particular, at a high temperature). In addition, the change in weight obtained when the lubricant is allowed to stand at 90° C. indicates an evaporation rate obtained when 230 g of the lubricant (1) charged in a container having a diameter of 6 cm and a depth of 10 cm is allowed to stand in an open state at 90° C. for 1,000 hours.

In addition, the total acid number of the lubricant (1) is 0.2 mgKOH/g or less, preferably 0.1 mgKOH/g or less, and more preferably 0.03 to 0.1 mgKOH/g. If the total acid number is more than 0.2 mgKOH/g, the member of the sliding portion (actuator) is corroded, and rust may be generated in some cases. Hence, an unnecessary sound may be generated when the sliding portion (actuator) is driven. When an animation is taken by a small electronic device having the sliding portion (portable electronic device having an actuator) as described above, a sound generated during this driving is also disadvantageously recorded. On the other hand, if the total acid number is in the range described above, the above problem is not likely to occur. In addition, when the total acid number is 0.03 mgKOH/g or more, the sliding property of the lubricant (1) is improved. The total acid number can be reduced by using a base oil refined, for example, by distillation or a high purity neutral phosphoric ester or neutral phosphorous ester, such as that of a reagent grade purity. In addition, the total acid number may by reduced by using a metal deactivator. As impurities which may be contained in the neutral phosphoric ester or the neutral phosphorous ester, for example, an acid phosphoric ester or an acid phosphorous ester may be mentioned. If these impurities are contained, the total acid number of the lubricant (1) will be increased. Hence, in the lubricant (1) according to the present invention, if a high purity neutral phosphoric ester or neutral phosphorous ester is used, even when a relatively large amount of the neutral phosphoric ester or the neutral phosphorous ester is contained as in the lubricant (1) according to the present invention, the total acid number can be controlled in the range described above. Incidentally, the total acid number is measured based on "JIS K2501-1992 petroleum product and lubricating oil-neutralization number testing method." In particular, a sample is dissolved in a mixed solvent of toluene, isopropyl alcohol, and water and is measured by a potentiometric titration method using a standard isopropyl alcohol solution of potassium hydroxide.

The lubricant (1) according to the present invention is suitably used particularly as a lubricant for a sliding portion (sliding portion of an actuator) of a small electronic device.

<Lubricant (2)>

A lubricant (2) according to the present invention includes an anti-wear agent, polytetrafluoroethylene particles, and a base oil containing a polyol ester oil and/or a paraffinic hydrocarbon oil.

The base oil and the anti-wear agent used for the lubricant (2) are similar to the base oil and the anti-wear agent used for the lubricant (1) in terms of the preferable compounds, the ranges of properties, the reasons therefor, and the like.

As for the polytetrafluoroethylene particles, the content of particles having a diameter of 1 μm or less is preferably 90 percent by mass or more, and the content of particles having a particle diameter of 0.01 to 1 μm is more preferably 90 percent by mass or more. In addition, it is more preferable that the contents of polytetrafluoroethylene particles having a particle diameter of 10 μm or less and 1 μm or less be 100 percent by mass and 90 percent by mass or more, respectively, and it is particularly preferable that the contents of particles having a particle diameter of 10 μm or less and 0.01 to 1 μm be 100 percent by mass and 90 percent by mass or more, respectively. When the content of particles having a particle diameter of 1 μm or less is less than 90 percent by mass, the sliding property of the lubricant (1) may be degraded in some cases. In addition, the particle diameter and the content are measured by a laser diffraction type particle size distribution measuring apparatus.

In addition, the aspect ratio of the polytetrafluoroethylene particles is preferably 0.5 to 1.0. When the aspect ratio is in the range described above, it is preferable since the fluidity and the sliding property of the lubricant (1) are not disturbed. In addition, the aspect ratio is one of the shape indices of particles, is a ratio of the minor axis to the major axis (minor axis/major axis) of a two-dimensional projection image of particles, and is measured by a flow type particle image analysis apparatus.

The polytetrafluoroethylene particles may be manufactured by any one of block polymerization, suspension polymerization, solution polymerization, and emulsion polymerization.

In addition, in the lubricant (2), 85 to 99.5 parts by mass, preferably 95 to 99 parts by mass, and more preferably 95 to 97 parts by mass of the base oil is included, and 0.5 to 15 parts by mass, preferably 1 to 5 parts by mass, and more preferably 3 to 5 parts by mass of the anti-wear agent is included with respect to 100 parts by mass of the total of the base oil and the anti-wear agent, and 30 to 50 parts by mass and preferably 40 to 50 parts by mass of the polytetrafluoroethylene particles is included with respect to 100 parts by mass of the total of the base oil and the anti-wear agent. As described above, since including a specific base oil and a specific anti-wear agent at a specific ratio, if the lubricant (2) is used at a sliding portion (sliding portion of an actuator) of a small electronic device, the wear is suppressed, and the durability can be improved. In addition, the wear resistance and the durability can be improved in a wide temperature range from a low temperature to a high temperature (−40° C. to 80° C.). If more than 15 parts by mass of the anti-wear agent is included, when the lubricant is used for the sliding portion (actuator), a member thereof may be corroded in some cases. In addition, since including the polytetrafluoroethylene particles at a specific ratio, even if the lubricant (2) is used at a section of the sliding portion (sliding portion of the actuator) of the small electronic device to which a force is particularly applied, the lubricant (2) can stay at the above section over a long period of time. Hence, the wear resistance and the durability of the sliding portion of the small electronic device to which a force is particularly applied (sliding portion of the actuator to which a force is particularly applied) can be improved. Furthermore, since the lubricant is not deteriorated even at a low temperature (−40° C.) when the polytetrafluoroethylene particles are used, the wear resistance and the durability at a low temperature (down to −40° C.) can be improved. In addition, in the case in which at least two types of base oils are mixed and used, the above amount of the base oil is the total amount of the at least two types of base oils. The case described above is also applied to the amount of the anti-wear agent.

In addition, as disclosed, for example, in International Publication WO2004/018594 pamphlet, in a grease composition for a watch, in order to enable a lubricant component to stay at a sliding portion over a long period of time, a thickening agent, such as lithium stearate or a diurea compound, is used. However, when a grease composition containing the above thickening agent is used on a sliding portion (actuator) which can be used at a temperature lower than that in the case of a watch, a sliding resistance is excessively increased at a low temperature (−40° C.), and the lubrication cannot be performed. On the other hand, since the lubricant (2) according to the present invention includes the polytetrafluoroethylene particles at a specific ratio with the specific base oil and the specific anti-wear agent as described above, extreme-pressure performance can be obtained even at a low temperature (−40° C.) together with a predetermined fluidity. Hence, according to the lubricant (2) of the present invention, as described above, the wear resistance and the durability of the sliding portion (actuator) can be improved in the use not only at ordinary temperature but also at a low temperature. Furthermore, unlike the above grease composition, since including no metallic soap, the lubricant (2) according to the present invention is also preferable in view of environmental conservation.

The lubricant (2) may further include a metal deactivator, an antioxidant, or a fluorescent agent. The metal deactivator, the antioxidant, and the fluorescent agent are similar to the metal deactivator, the antioxidant, and the fluorescent agent used for the lubricant (1) in terms of the preferable compounds, the ranges of properties and amounts, the reasons therefor, and the like.

The lubricant (2) is prepared by appropriately mixing the components described above.

The change in weight of the lubricant (2) when allowed to stand at 90° C. and the total acid number thereof are similar to the change in weight of the lubricant (1) when allowed to stand at 90° C. and the total acid number thereof, respectively, in terms of the desirable ranges, the reasons therefor, and the like.

The lubricant (2) according to the present invention is suitably used particularly as a lubricant for a section of a sliding portion (sliding portion of an actuator) of a small electronic device to which a force is particularly applied.

<Actuator>

Hereinafter, as one example of the sliding portion of the small electronic device, an actuator will be described. As other sliding portions, for example, gears of a watch, such as a wrist watch, may be mentioned.

An actuator according to the present invention is an actuator which has, between two housings, a motor having a rotor, at least one torque increasing gear increasing a rotary torque generated from the motor, and an output gear which is engaged with the gear and which outputs a power to drive a driven mechanism, and the lubricant (1) or the lubricant (2) is adhered to any one of a first sliding portion formed between each housing and the rotor, a second sliding portion formed between each housing and the torque increasing gear, and a third sliding portion formed between each housing and the output gear. Hereinafter, an embodiment of the actuator will be described in more particular with reference to the drawings.

Embodiment A1 of Actuator

Figure 2:
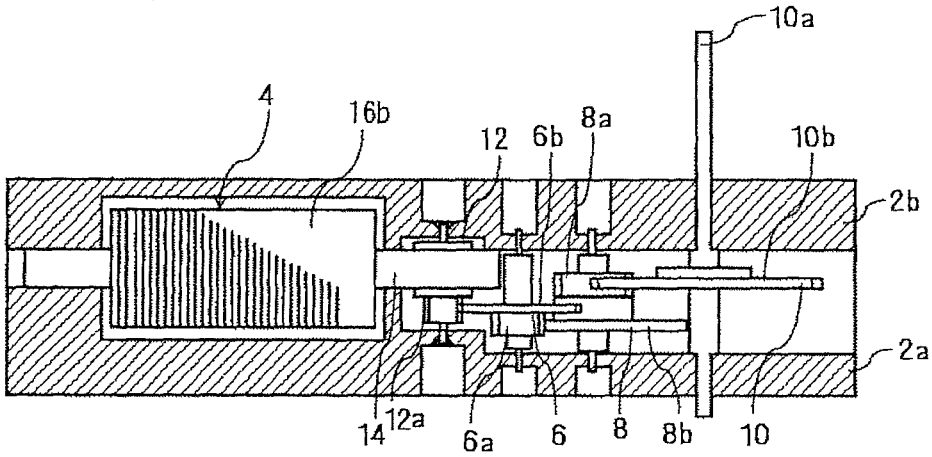
FIG. 2 is a view illustrating the actuator according to the present invention.

FIG. 1 is a top plan view of an actuator of Embodiment A1 when viewed from above, and FIG. 2 is a cross-sectional view of the actuator of Embodiment A1 when viewed from the side thereof. As shown in FIGS. 1 and 2, in the actuator of Embodiment A1, a two-pole step motor 4 having a rotor 12, two torque increasing gears (a first torque increasing gear 6 and a second torque increasing gear 8), and an output gear 10 are provided between two housings 2*a* and 2*b* and are fixed thereto with screws which are not shown in the figures. The fixing may also be performed by using hooks and/or caulking instead of using the screws. In this embodiment, the housings 2*a* and 2*b*, the first torque increasing gear 6, the second torque increasing gear 8, and the output gear 10 are each usually made of a copper alloy, such as brass, an iron alloy, or an engineering plastic.

The two-pole step motor 4 is formed of the rotor 12 made of a two-pole permanent magnet, a two-pole stator 14 which has a rotor hole 14*a* into which the rotor 12 is to be inserted and which is magnetically coupled with the rotor 12, and coils 16*a* and 16*b* fixed to the stator 14, and these elements are arranged in plan. Although the coils 16*a* and 16*b* are separated and are wound around the stator 14, one coil may also be used instead. The rotor hole 14*a* of the stator 14 into which the rotor 12 is to be inserted is formed so that a stable position of the rotor 12 when the coils 16*a* and 16*b* are excited and a stable position of the rotor 12 when the coils 16*a* and 16*b* are not excited are different from each other. In this case, the rotor hole 14*a* has projections 14*b* and 14*c* at positions each forming an angle of approximately 45° with the magnetic pole direction of the stator 14. In addition, in Embodiment A1, although the projections 14*b* and 14*c* are each provided to form an angle of approximately 45° with the magnetic pole direction of the stator, an angle of 25° to 75° is preferable. In addition, in Embodiment A1, although an example in which the projections 14*b* and 14*c* are provided is shown as the shape of the rotor hole 14*a* of the stator 14, the shape of the rotor hole 14*a* may be a hole having a step formed by shifting a half circle thereof to a certain extent.

A pinion 12*a* provided under the rotor 12 is engaged with a gear 6*b* of the first torque increasing gear 6, a pinion 6*a* of the first torque increasing gear 6 is engaged with a gear 8*b* of the second torque increasing gear 8, a pinion 8*a* of the second torque increasing gear 8 is engaged with a gear 10*b* of the output gear 10, and a shaft 10*a* of the output gear 10 is projected above the housing 2*b* and functions as a rotation output shaft 10*a*.

Terminals from a circuit for control and drive of the actuator, which are not shown in the figure, are connected to connection points 18*a* and 18*b* provided on the stator 14. In addition, terminals of the coils 16*a* and 16*b* are also connected to the connection points 18*a* and 18*b*, respectively.

Since the gears are arranged as described above, the rotation generated from the motor, that is, the rotation of the rotor 12, can be transmitted by the first torque increasing gear 6 and the second torque increasing gear 8, and at the same time, the rotary torque of the rotor 12 can be increased. In addition, according to the output gear 10, a power can be output to drive the driven mechanism.

Figure 3:
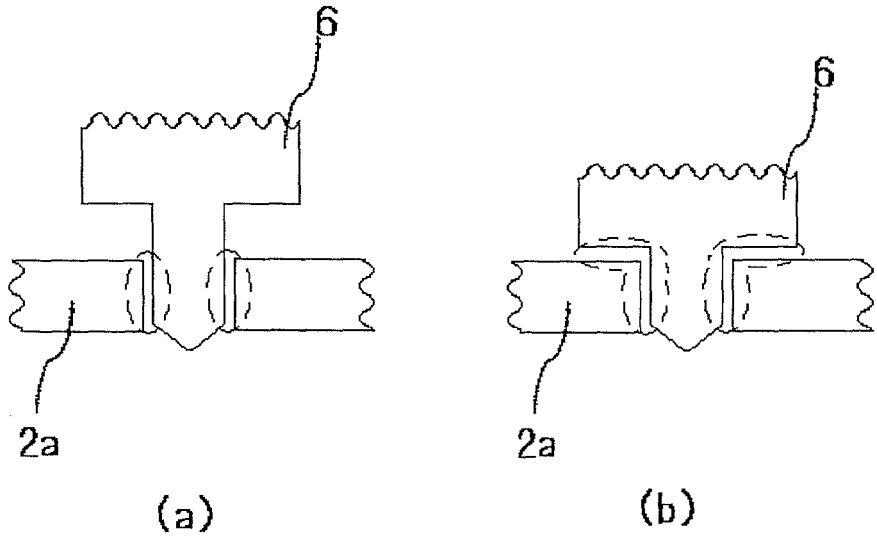
FIG. 3 includes views each illustrating a sliding portion of the actuator according to the present invention.

In addition, in the actuator of Embodiment A1, the first sliding portions are formed between the rotor 12 and the housings 2*a* and 2*b*, the second sliding portions are formed between the first torque increasing gear 6 and the housings 2*a* and 2*b* and between the second torque increasing gear 8 and the housings 2*a* and 2*b*, and the third sliding portions are formed between the output gear 10 and the housings 2*a* and 2*b*. FIG. 3 shows an insertion portion of the first torque increasing gear 6 which is inserted in the housing 2*a*. As shown in this FIG. 3, the area of the second sliding portion is changed depending on the shape of the gear. In particular, the second sliding portion may have an area surrounded by dotted lines of FIG. 3(*a*) or may have an area surrounded by dotted lines of FIG. 3 (*b*). The case described above is also applied to the other sliding portions.

In the actuator of Embodiment A1, the lubricant (1) is adhered to each first sliding portion and each second sliding portion, and the lubricant (2) is adhered to each third sliding portion. Although a method for adhering the lubricant (1) and the lubricant (2) is not particularly limited, the following method may be mentioned. In the housing 2*a*, the lubricant (1) is supplied in holes into which the rotor 12, the first torque increasing gear 6, and the second torque increasing gear 8 are to be inserted, and the lubricant (2) is supplied in a hole into which the output gear 10 is to be inserted. Subsequently, the rotor 12, the first torque increasing gear 6, the second torque increasing gear 8, and the output gear 10 are inserted in the housing 2*a*, and the housing 2*b* is fitted thereto so as to sandwich the rotor 12, the first torque increasing gear 6, the second torque increasing gear 8, and the output gear 10 therebetween. Finally, from above the housing 2*b*, the lubricant (1) is supplied in holes into which the rotor 12, the first torque increasing gear 6, and the second torque increasing gear 8 have been inserted, and the lubricant (2) is supplied in a hole into which the output gear 10 has been inserted. As described above, the lubricant (1) and the lubricant (2) can be adhered to the sliding portions.

Embodiment A1 is preferably applied to the case in which a force is applied particularly to the third sliding portions and a force is not so much applied to the first sliding portions and second sliding portions. At the third sliding portions to each of which a force is particularly applied, the lubricant (2) can stay over a long period of time, and at the first sliding portions and the second sliding portions to each of which a force is not so much applied, without any excessive increase in sliding resistance, lubrication can be performed over a long period of time. For this reason, according to Embodiment A1, the wear resistance and the durability can be improved in a wide temperature range from a low temperature to a high temperature.

Embodiment A2 of Actuator

In an actuator of Embodiment A2, the two torque increasing gears are engaged with each other (the first torque increasing gear 6 and the second torque increasing gear 8 are engaged with each other), the lubricant (2) is adhered to the second sliding portions of the second torque increasing gear 8 engaged with the output gear 10, the lubricant (1) is adhered to the second sliding portions of the first torque increasing gear 6 not engaged with the output gear 10, the lubricant (1) is adhered to the first sliding portions, and the lubricant (2) is adhered to the third sliding portions.

Although a method for adhering the lubricant (1) and the lubricant (2) is not particularly limited, a method in accordance with that of Embodiment 1 may be mentioned.

Embodiment A2 is preferably applied to the case in which a force is applied particularly to the second sliding portions formed by the second torque increasing gear and the third sliding portions and in which a force is not so much applied to the first sliding portions and the second sliding portions formed by the first torque increasing gear. At the sliding portions to each of which a force is particularly applied, the lubricant (2) can stay over a long period of time, and at the sliding portions to each of which a force is not so much applied, without any excessive increase in sliding resistance, lubrication can be performed over a long period of time. For this reason, according to Embodiment A2, the wear resistance and the durability can be improved in a wide temperature range from a low temperature to a high temperature.

Embodiment A3 of Actuator

In an actuator of Embodiment A3, housing sides of the first sliding portions, the second sliding portions, and the third sliding portions of the actuator of each of Embodiments A1 and A2 are processed by a surface-treating agent.

Hereinafter, the surface-treating agent will be described.

<<Surface-Treating Agent>>

The surface-treating agent is obtained from a fluorine type surfactant and a phosphoric ester having a hydrocarbon group in which a part or all of hydrogen atoms have been substituted with a fluorine atom. By using the surface-treating agent including a fluorine type surfactant and a phosphoric ester in combination, a sound of an actuator mounted in a portable electronic device generated during driving can be reduced. In addition, since the surface-treating agent can stay over a long period of time at a portion to which it is supplied, according to this surface-treating agent, a sound reduction effect can be maintained over a long period of time.

As the phosphoric ester having a hydrocarbon group in which a part or all of hydrogen atoms have been substituted with a fluorine atom (in this specification, this phosphoric ester is also called a fluorine-containing phosphoric ester), for example, there may be mentioned a neutral phosphoric ester, a neutral phosphorous ester, or a phosphonate, each having a hydrocarbon group in which a part or all of hydrogen atoms have been substituted with a fluorine atom. If the above compounds are used, the wear resistance and the durability of the sliding portion of the actuator can also be improved.

As the neutral phosphoric ester having a hydrocarbon group in which a part or all of hydrogen atoms have been substituted with a fluorine atom (in this specification, the neutral phosphoric ester is also called a fluorine-containing neutral phosphoric ester), a fluorine-containing phosphoric ester represented by the following formula (A) may be mentioned.

[Chemical 7]

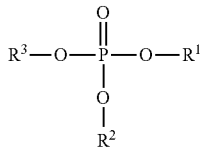

(A)

(In the formula (A), $R^1$, $R^2$, and $R^3$ each independently represent a chain or a branched aliphatic hydrocarbon group having 1 to 20 carbon atoms in which a part or all of hydrogen atoms have been substituted with a fluorine atom or a hydrocarbon group containing an aromatic ring having 6 to 20 carbon atoms in which a part or all of hydrogen atoms have been substituted with a fluorine atom.)

Among these described above, since the sliding property can be improved, $R^1$, $R^2$ and $R^3$ each preferably independently represent a chain or a branched aliphatic hydrocarbon group having 5 to 18 carbon atoms in which a part or all of hydrogen atoms have been substituted with a fluorine atom, and a pentyl group, an octyl group, a decyl group, a dodecyl group, a tridecyl group, an oleyl group, or a stearyl group, in each of which a part or all of hydrogen atoms have been substituted with a fluorine atom, is more preferable.

As the fluorine-containing neutral phosphoric ester described above, in particular, tripentyl phosphate, trioleyl phosphate, or trioctyl phosphate, each compound having a hydrocarbon group in which a part or all of hydrogen atoms have been substituted with a fluorine atom, may be mentioned.

In addition, a fluorine-containing neutral phosphoric ester other than the fluorine-containing neutral phosphoric ester represented by the formula (A) may also be suitably used. As the fluorine-containing neutral phosphoric ester described above, for example, there may be mentioned trimethylolpropane phosphate, tetraphenyldipropylene glycol diphosphate, tetraphenyltetra(tridecyl)pentaerythritol tetraphosphate, tetra(tridecyl)-4,4'-isopropylidenediphenyl diphosphate, bis(tridecyl)pentaerythritol diphosphate, bis(nonylphenyl)pentaerythritol diphosphate, distearyl pentaerythritol diphosphate, or a hydrogenated bisphenol A/pentaerythritol phosphate polymer, each having a hydrocarbon group in which a part or all of hydrogen atoms have been substituted with a fluorine atom.

As the neutral phosphorous ester having a hydrocarbon group in which a part or all of hydrogen atoms have been substituted with a fluorine atom (in this specification, the neutral phosphorous ester is also called a fluorine-containing neutral phosphorous ester), a fluorine-containing phosphoric ester represented by the following formula (B) may be mentioned.

[Chemical 8]

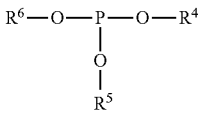

(B)

(In the formula (B), $R^4$, $R^5$, and $R^6$ each independently represent a chain or a branched aliphatic hydrocarbon group having 1 to 20 carbon atoms in which a part or all of hydrogen atoms have been substituted with a fluorine atom or a hydrocarbon group containing an aromatic ring having 6 to 20 carbon atoms in which a part or all of hydrogen atoms have been substituted with a fluorine atom.)

Among these described above, since the sliding property can be improved, $R^4$, $R^5$ and $R^6$ each preferably independently represent a chain or a branched aliphatic hydrocarbon group having 5 to 18 carbon atoms in which a part or all of hydrogen atoms have been substituted with a fluorine atom, and a pentyl group, an octyl group, a decyl group, a dodecyl group, a tridecyl group, an oleyl group, or a stearyl group, in each of which a part or all of hydrogen atoms have been substituted with a fluorine atom, is more preferable.

As the fluorine-containing neutral phosphorous ester described above, in particular, there may be mentioned tripentyl phosphite, trioleyl phosphite, or trioctyl phosphite, each having a hydrocarbon group in which a part or all of hydrogen atoms have been substituted with a fluorine atom.

A fluorine-containing neutral phosphorous ester other than the fluorine-containing neutral phosphorous ester represented by the formula (B) may also be suitably used. As the fluorine-containing neutral phosphorous ester described above, for example, there may be mentioned trimethylolpropane phosphite, tetraphenyldipropylene glycol diphosphite, tetraphenyltetra(tridecyl)pentaerythritol tetraphosphite, tetra(tridecyl)-4,4'-isopropylidenediphenyl diphosphite, bis(tridecyl)pentaerythritol diphosphite, bis(nonylphenyl)pentaerythritol diphosphite, distearyl pentaerythritol diphosphite, or a hydrogenated bisphenol A/pentaerythritol phosphite polymer, each having a hydrocarbon group in which a part or all of hydrogen atoms have been substituted with a fluorine atom.

As the phosphonate having a hydrocarbon group in which a part or all of hydrogen atoms have been substituted with a fluorine atom (in this specification, the phosphonate is also called a fluorine-containing phosphonate), a fluorine-containing phosphoric ester represented by the following formula (C) may be mentioned.

[Chemical 9]

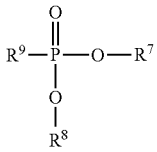

(C)

(In the formula (C), $R^7$ and $R^8$ each independently represent a chain or a branched aliphatic hydrocarbon group having 1 to 20 carbon atoms in which a part or all of hydrogen atoms have been substituted with a fluorine atom or a hydrocarbon group containing an aromatic ring having 6 to 20 carbon atoms in which a part or all of hydrogen atoms have been substituted with a fluorine atom. $R^9$ represents an acetyl group or a methoxycarbonylmethyl group.)

Among these described above, since the sliding property can be improved, $R^7$ and $R^8$ each preferably independently represent a chain or a branched aliphatic hydrocarbon group having 2 to 18 carbon atoms (preferably 2 to 8 carbon atoms) in which a part or all of hydrogen atoms have been substituted with a fluorine atom, and an ethyl group in which a part or all of hydrogen atoms have been substituted with a fluorine atom is more preferable.

As described above, as the surface-treating agent, in the neutral phosphoric ester, the neutral phosphorous ester, or the phosphonate, a compound having a hydrocarbon group in its molecule in which a part or all of hydrogen atoms have been substituted with a fluorine atom is suitably used. The phosphoric esters having a hydrocarbon group in which a part or all of hydrogen atoms have been substituted with a fluorine atom may be used alone, or at least two types thereof may also be used in combination.

In addition, a fluorine-containing phosphoric ester in which 50% or more of the total number of hydrogen atoms of a hydrocarbon group is substituted with fluorine atoms is preferable. According to the fluorine-containing phosphoric esters as described above, preferable oil repellency can be obtained. In addition, the hydrocarbon groups of the phosphoric ester corresponds to $R^1$, $R^2$, and $R^3$ of the formula (A), $R^4$, $R^5$, and $R^6$ of the formula (B), and $R^7$ and $R^8$ of the formula (C).

As the phosphoric ester having a hydrocarbon group in which a part or all of hydrogen atoms have been substituted with a fluorine atom, in more particular, there may be mentioned tris(1H,1H,5H-octafluoro-n-pentyl) phosphate and bis (2',2',2-trifluoroethyl)(methoxycarbonyl) phosphonate.

As the fluorine type surfactant, an anionic surfactant, a cationic surfactant, and a nonionic surfactant may be mentioned.

As the anionic surfactant, for example, a perfluoroalkyl (C2 to C10) sulfonate or a perfluoroalkyl (C2 to C10) carboxylate may be mentioned; as the cationic surfactant, for example, a perfluoroalkyl (C4 to C10) quaternary amine salt may be mentioned; and as the nonionic surfactant, for example, an alkylene oxide adduct of a perfluoroalkyl alcohol, such as a perfluoroalkyl ethylene oxide adduct or a perfluoroalkyl propylene oxide adduct, or an oligomer having a perfluoroalkyl group, such as a perfluoroalkyl acrylate oligomer or a perfluoroalkyl methacrylate oligomer, may be mentioned. The anionic surfactant, the cationic surfactant, and the nonionic surfactant each may be used alone, or at least two types thereof may also be used in combination.

Among these compounds mentioned above, since containing no ions and not being affected even if oil and/or water coexists, the nonionic surfactant is more preferable, and an alkylene oxide adduct of a perfluoroalkyl alcohol is even more preferable.

The surface-treating agent is preferably obtained from, with respect to 100 parts by mass of the total of the fluorine-containing phosphoric ester and the fluorine type surfactant, 30 to 70 parts by mass, preferably 40 to 60 parts by mass, and more preferably 45 to 55 parts by mass of the fluorine-containing phosphoric ester and 30 to 70 parts by mass, preferably 40 to 60 parts by mass, and more preferably 45 to 55 parts by mass of the fluorine type surfactant. If the fluorine-containing phosphoric ester and the fluorine type surfactant are used at the ratio described above, the sound reduction effect can be maintained over a longer period of time. In addition, when at least two types of fluorine-containing phosphoric esters are used in combination, the amount of the fluorine-containing phosphoric ester is the total amount of the at least two types of fluorine-containing phosphoric esters. The case described above is also applied to the amount of the fluorine type surfactant.

In particular, the surface-treating agent is preferably obtained by dissolving the fluorine-containing phosphoric ester and the fluorine type surfactant in a solvent having a boiling point of 180° C. or less. The surface-treating agent is preferably obtained by dissolving 0.3 to 1.5 parts by mass of the total of the fluorine-containing phosphoric ester and the fluorine type surfactant with respect to 100 parts by mass of the solvent. If the amount in the range described above is dissolved, coating properties and immersion properties of the surface-treating agent are improved, and a process thereby may be more easily performed. In addition, after the process by the surface-treatment agent is performed, a washing step using isopropyl alcohol or the like may be advantageously omitted. On the other hand, if the amount is out of the range described above, washing is preferably performed after the process by the surface-treating agent is performed.

As the solvent, an alcohol, a hydrocarbon, an ether, or a ketone, each having a boiling point of 180° C. or less, is suitably used. Since the solvent as mentioned above easily evaporates, the process by the surface-treating agent can be easily performed. In more particular, alcohols, such as methanol, ethanol, and isopropyl alcohol; hydrocarbons, such as hexane, heptane, octane, and nonane; ethers, such as diethyl ether; and ketones, such as acetone, methyl ethyl ketone, and ethyl ethyl ketone, may be used.

In the actuator of Embodiment A3, the above surface-treating agent is suitably used as a surface-treating agent for the housing sides of the sliding portions.

Although a method for performing a process by a surface-treating agent is not particularly limited, for example, there may be mentioned a method for immersing the housings 2*a* and 2*b* beforehand in a surface-treating agent and a method for applying a surface-treating agent to the holes of the housings 2*a* and 2*b* into which the gears are to be inserted. In addition, except that the housings 2*a* and 2*b* processed by the surface-treating agent are used, the lubricant (1) and the lubricant (2) may be adhered in a manner similar to that in Embodiments A1 and A2.

According to Embodiment A3, besides the effect of improving wear resistance and durability described in Embodiments A1 and A2, an effect of reducing a sound generated from an actuator during driving may also be obtained. Of course, without using the lubricant (1) and the lubricant (2), if the housing sides of the sliding portions are processed by the surface-treating agent, the sound-reducing effect can be obtained. However, as in Embodiment A3, when the surface-treating agent is used together with the lubricant (1) and the lubricant (2), a more superior sound reduction effect can be obtained over a longer period of time. The reason for this is believed that a compound derived from the neutral phosphoric ester included in the surface-treatment agent has properties similar to those of the neutral phosphoric esters included in the lubricant (1) and the lubricant (2). In more particular, the reason for this is believed that when the compound derived from the neutral phosphoric ester of the surface-treating agent is removed from a portion of the housing, the neutral phosphoric esters included in the lubricant (1) and the lubricant (2) are supplied to the above portion of the housing.

Furthermore, according to Embodiment A3, the effect of improving wear resistance and durability described in Embodiments A1 and A2 can be obtained over a longer period of time. The reason for this is believed that the surface-treating agent has properties to enable the lubricant (1) and the lubricant (2) to stay at places to which the above lubricants are supplied.

In addition, even if the lubricant (1) and the lubricant (2) are not used, when the housing sides of the sliding portions are processed by the surface-treating agent, the wear resistance and the durability can be improved although being inferior to those of the case in which the lubricant (1) and the lubricant (2) are used.

(Embodiment of Another Actuator)

In Embodiments A1 to A3, although a three-stage torque increasing gear train is formed, in accordance with the relationship between a power of the two-pole step motor and a power required for the driven mechanism, a two-stage torque increasing gear train or a four-stage torque increasing gear train may also be formed. In addition, in accordance with a driving speed and a space of the driven mechanism, the number of gear may be increased or decreased by changing a torque increasing rate between the gears.

In addition, in Embodiments A1 to A3, although the two-pole step motor is used, in accordance with a power required for the driven mechanism, a three-pole step motor or a four-pole step motor may also be used. Furthermore, as long as the rotation is transmitted to the torque increasing gear, another motor may also be used.

In Embodiments A1 to A3, although the lubricant (1) or the lubricant (2) is adhered to all the sliding portions, an actuator may also be formed in which the lubricant (1) or the lubricant (2) is adhered to any one of each first sliding portion, each second sliding portion, and each third sliding portion. In the case of a portable electronic device, in consideration of a power required for a driven mechanism, such as a camera module, Embodiment A1 or Embodiment A2 is preferable.

In addition, in the case in which the actuator of Embodiment A1 is assembled and is actually used, when it is found that a large force is applied to the second torque increasing gear 8, the lubricant (2) may be adhered thereto afterward. As described above, the actuator can be changed afterward into that of Embodiment A2. Since the lubricant (1) and the lubricant (2) according to the present invention have the common base oil and anti-wear agent, the lubricant (2) which is adhered afterward may be compatible with the lubricant (1) which is adhered beforehand.

In addition, in Embodiment A3, although all the housing sides of the sliding portions are processed by the surface-treating agent, an actuator may also be formed in which the housing sides of any one of each first sliding portion, each second sliding portion, and each third sliding portion are processed by the surface-treating agent. In the case of a portable electronic device, when the sound reduction effect is taken into consideration, an embodiment in which the housing sides of all the sliding portions are processed by the surface-treating agent is preferable.

<Small Electronic Device>

As a small electronic device according to the present invention, for example, a portable electronic device or a precision device may be mentioned, and in more particular, a cellular phone, a PHS, a personal digital assistant, a portable computer (mobile computer), a digital camera, a video camera, or the like may be mentioned. The above small electronic device includes a sliding portion to which the lubricant (1) or the lubricant (2) is adhered as described above. In particular, the above portable electronic device includes an actuator to which the lubricant (1) or the lubricant (2) is adhered as described above. In this case, as a driven mechanism driven by the actuator, in particular, a camera module mounted in a portable electronic device may be mentioned. Furthermore, the small electronic device according to the present invention preferably includes a sliding portion processed by the above surface-treating agent as well as adhered with the lubricant (1) or the lubricant (2) as described above. In particular, the portable electronic device preferably includes an actuator processed by the above surface-treating agent as well as adhered with the lubricant (1) or the lubricant (2) as described above.

In addition, an actuator according to the present invention may also be applied to a small toy. For example, the actuator may also be used, for example, to move legs or the like of a miniature doll or an animal.

B. Surface-Treating Agent

Next, a surface-treatment agent according to the present invention, a sliding portion (such as an actuator) of a small electronic device using the above surface-treatment agent, and a small electronic device having the above sliding portion (such as a portable electronic device having an actuator) will be concretely described.

<Surface-Treating Agent>

The surface-treating agent according to the present invention is obtained from a fluorine type surfactant and a phosphoric ester having a hydrocarbon group in which a part or all of hydrogen atoms have been substituted with a fluorine atom. By using the surface-treating agent in which a phosphoric ester and a fluorine type surfactant are included in combination, a sound of a sliding portion mounted in a small electronic device (actuator mounted in a portable electronic device) generated during driving can be reduced. In addition, since the surface-treating agent according to the present invention can stay over a long period of time at a portion to which it is supplied, according to this surface-treating agent, the sound reduction effect can be maintained over a long period of time.

As the phosphoric ester having a hydrocarbon group in which a part or all of hydrogen atoms have been substituted with a fluorine atom (in this specification, the phosphoric ester is also called a fluorine-containing phosphoric ester), a neutral phosphoric ester, a neutral phosphorous ester, or a phosphonate, each having a hydrocarbon group in which a part or all of hydrogen atoms have been substituted with a fluorine atom, may be mentioned. If these compounds are used, the wear resistance and the durability of the sliding portion of the small electronic component (sliding portion of the actuator) can also be improved.

As the neutral phosphoric ester having a hydrocarbon group in which a part or all of hydrogen atoms have been substituted with a fluorine atom (in this specification, the neutral phosphoric ester is also called a fluorine-containing neutral phosphoric ester), a fluorine-containing phosphoric ester represented by the following formula (A) may be mentioned.

[Chemical 10]

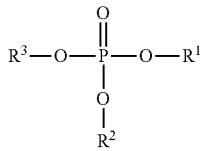

(A)

(In the formula (A), $R^1$, $R^2$, and $R^3$ each independently represent a chain or a branched aliphatic hydrocarbon group having 1 to 20 carbon atoms in which a part or all of hydrogen atoms have been substituted with a fluorine atom or a hydrocarbon group containing an aromatic ring having 6 to 20 carbon atoms in which a part or all of hydrogen atoms have been substituted with a fluorine atom.)

Among these described above, since the sliding property can be improved, $R^1$, $R^2$, and $R^3$ each preferably independently represent a chain or a branched aliphatic hydrocarbon group having 5 to 18 carbon atoms in which a part or all of hydrogen atoms have been substituted with a fluorine atom, and a pentyl group, an octyl group, a decyl group, a dodecyl group, a tridecyl group, an oleyl group, or a stearyl group, in each of which a part or all of hydrogen atoms have been substituted with a fluorine atom, is more preferable.

As the fluorine-containing neutral phosphoric ester described above, in particular, tripentyl phosphate, trioleyl phosphate, or trioctyl phosphate, each compound having a hydrocarbon group in which a part or all of hydrogen atoms have been substituted with a fluorine atom, may be mentioned.

In addition, a fluorine-containing neutral phosphoric ester other than the fluorine-containing neutral phosphoric ester represented by the formula (A) may also be suitably used. As the above fluorine-containing neutral phosphoric ester, for example, there may be mentioned trimethylolpropane phosphate, tetraphenyldipropylene glycol diphosphate, tetraphenyltetra(tridecyl)pentaerythritol tetraphosphate, tetra(tridecyl)-4,4'-isopropylidenediphenyl diphosphate, bis(tridecyl)

pentaerythritol diphosphate, bis(nonylphenyl)pentaerythritol diphosphate, distearyl pentaerythritol diphosphate, or a hydrogenated bisphenol A/pentaerythritol phosphate polymer, each having a hydrocarbon group in which a part or all of hydrogen atoms have been substituted with a fluorine atom.

As the neutral phosphorous ester having a hydrocarbon group in which a part or all of hydrogen atoms have been substituted with a fluorine atom (in this specification, the neutral phosphorous ester is also called a fluorine-containing neutral phosphorous ester), a fluorine-containing phosphoric ester represented by the following formula (B) may be mentioned.

[Chemical 11]

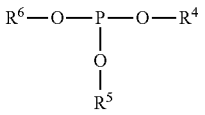

(B)

(In the formula (B), $R^4$, $R^5$, and $R^6$ each independently represent a chain or a branched aliphatic hydrocarbon group having 1 to 20 carbon atoms in which a part or all of hydrogen atoms have been substituted with a fluorine atom or a hydrocarbon group containing an aromatic ring having 6 to 20 carbon atoms in which a part or all of hydrogen atoms have been substituted with a fluorine atom.)

Among these described above, since the sliding property can be improved, $R^4$, $R^5$, and $R^6$ each preferably independently represent a chain or a branched aliphatic hydrocarbon group having 5 to 18 carbon atoms in which a part or all of hydrogen atoms have been substituted with a fluorine atom, and a pentyl group, an octyl group, a decyl group, a dodecyl group, a tridecyl group, an oleyl group, or a stearyl group, in each of which a part or all of hydrogen atoms have been substituted with a fluorine atom, is more preferable.

As the fluorine-containing neutral phosphorous ester described above, in particular, there may be mentioned tripentyl phosphite, trioleyl phosphite, or trioctyl phosphite, each having a hydrocarbon group in which a part or all of hydrogen atoms have been substituted with a fluorine atom, may be mentioned.

A fluorine-containing neutral phosphorous ester other than the fluorine-containing neutral phosphorous ester represented by the formula (B) may also be suitably used. As the fluorine-containing neutral phosphorous ester described above, for example, there may be mentioned trimethylolpropane phosphite, tetraphenyldipropylene glycol diphosphite, tetraphenyltetra(tridecyl)pentaerythritol tetraphosphite, tetra(tridecyl)-4,4'-isopropylidenediphenyl diphosphite, bis(tridecyl)pentaerythritol diphosphite, bis(nonylphenyl)pentaerythritol diphosphite, distearyl pentaerythritol diphosphite, or a hydrogenated bisphenol A/pentaerythritol phosphite polymer, each having a hydrocarbon group in which a part or all of hydrogen atoms have been substituted with a fluorine atom.

As the phosphonate having a hydrocarbon group in which a part or all of hydrogen atoms have been substituted with a fluorine atom (in this specification, the above phosphonate is also called a fluorine-containing phosphonate), a fluorine-containing phosphoric ester represented by the following formula (C) may be mentioned.

[Chemical 12]

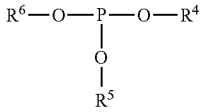

(B)

(In the formula (C), $R^7$ and $R^8$ each independently represent a chain or a branched aliphatic hydrocarbon group having 1 to 20 carbon atoms in which a part or all of hydrogen atoms have been substituted with a fluorine atom or a hydrocarbon group containing an aromatic ring having 6 to 20 carbon atoms in which a part or all of hydrogen atoms have been substituted with a fluorine atom. $R^9$ represents an acetyl group or a methoxycarbonylmethyl group.)

Among these described above, since the sliding property can be improved, $R^7$ and $R^8$ each preferably independently represent a chain or a branched aliphatic hydrocarbon group having 2 to 18 carbon atoms (preferably 2 to 8 carbon atoms) in which a part or all of hydrogen atoms have been substituted with a fluorine atom, and an ethyl group in which a part or all of hydrogen atoms have been substituted with a fluorine atom is more preferable.

As described above, as the surface-treating agent according to the present invention, in the neutral phosphoric ester, the neutral phosphorous ester, or the phosphonate, a compound having a hydrocarbon group in its molecule in which a part or all of hydrogen atoms have been substituted with a fluorine atom is suitably used. The phosphoric esters each having a hydrocarbon group in which a part or all of hydrogen atoms have been substituted with a fluorine atom may be used alone, or at least two types thereof may also be used in combination.

In addition, a fluorine-containing phosphoric ester in which 50% or more of the total number of hydrogen atoms of a hydrocarbon group is substituted with fluorine atoms is preferable. According to the fluorine-containing phosphoric ester as described above, preferable oil repellency can be obtained. In addition, the hydrocarbon group of the phosphoric ester corresponds to $R^1$, $R^2$, and $R^3$ of the formula (A), $R^4$, $R^5$, and $R^6$ of the formula (B), and $R^7$ and $R^8$ of the formula (C).

As the phosphoric ester having a hydrocarbon group in which a part or all of hydrogen atoms have been substituted with a fluorine atom, in more particular, there may be mentioned tris(1H,1H,5H-octafluoro-n-pentyl) phosphate and bis(2',2',2-trifluoroethyl)(methoxycarbonyl) phosphonate.

As the fluorine type surfactant, an anionic surfactant, a cationic surfactant, and a nonionic surfactant may be mentioned.

As the anionic surfactant, for example, a perfluoroalkyl(C2 to C10) sulfonate or a perfluoroalkyl(C2 to C10) carboxylate may be mentioned; as the cationic surfactant, for example, a perfluoroalkyl(C4 to C10) quaternary amine salt may be mentioned; and as the nonionic surfactant, for example, an alkylene oxide adduct of a perfluoroalkyl alcohol, such as a perfluoroalkyl ethylene oxide adduct or a perfluoroalkyl propylene oxide adduct, or an oligomer having a perfluoroalkyl group, such as a perfluoroalkyl acrylate oligomer or a perfluoroalkyl methacrylate oligomer, may be mentioned. The anionic surfactant, the cationic surfactant, and the nonionic surfactant each may be used alone, or at least two types thereof may also be used in combination.

Among these compounds mentioned above, since containing no ions and not being affected even if oil and/or water coexists, the nonionic surfactant is more preferable, and an alkylene oxide adduct of a perfluoroalkyl alcohol is even more preferable.

The surface-treating agent is preferably obtained from, with respect to 100 parts by mass of the total of the fluorine-containing phosphoric ester and the fluorine type surfactant, 30 to 70 parts by mass, preferably 40 to 60 parts by mass, and more preferably 45 to 55 parts by mass of the fluorine-containing phosphoric ester and 30 to 70 parts by mass, preferably 40 to 60 parts by mass, and more preferably 45 to 55 parts by mass of the fluorine type surfactant. If the fluorine-containing phosphoric ester and the fluorine type surfactant are used at the ratio described above, the sound reduction effect can be maintained over a longer period of time. In addition, when at least two types of fluorine-containing phosphoric esters are used in combination, the amount of the fluorine-containing phosphoric ester is the total amount of the at least two types of fluorine-containing phosphoric esters. The case described above is also applied to the amount of the fluorine type surfactant.

In particular, the surface-treating agent is preferably obtained by dissolving the fluorine-containing phosphoric ester and the fluorine type surfactant in a solvent having a boiling point of 180° C. or less. The surface-treating agent is preferably obtained by dissolving 0.3 to 1.5 parts by mass of the total of the fluorine-containing phosphoric ester and the fluorine type surfactant with respect to 100 parts by mass of the solvent. If the amount in the range described above is dissolved, coating properties and immersion properties of the surface-treating agent are improved, and a process thereby may be more easily performed. In addition, after the process by the surface-treatment agent is performed, a washing step using isopropyl alcohol or the like may be advantageously omitted. On the other hand, if the amount is out of the range described above, washing is preferably performed after the process by the surface-treating agent is performed.

As the solvent, an alcohol, a hydrocarbon, an ether, or a ketone, each having a boiling point of 180° C. or less, is suitably used. Since the solvent as mentioned above easily evaporates, the process by the surface-treating agent can be easily performed. In more particular, alcohols, such as methanol, ethanol, and isopropyl alcohol; hydrocarbons, such as hexane, heptane, octane, and nonane; ethers, such as diethyl ether; and ketones, such as acetone, methyl ethyl ketone, and ethyl ethyl ketone, may be used.

The surface-treating agent according to the present invention can be suitably used particularly as a surface-treating agent for a sliding portion (housing side of a sliding portion of an actuator) in a small electronic device.

<Actuator>

Hereinafter, as one example of the sliding portion of the small electronic device, an actuator will be described. As other sliding portions, for example, gears of a watch, such as a wrist watch, may be mentioned.

An actuator according to the present invention is an actuator which has, between two housings, a motor having a rotor, at least one torque increasing gear increasing a rotary torque generated from the motor, and an output gear which is engaged with the above gear and which outputs a power to drive a driven mechanism, and in the above actuator, there are provided a first sliding portion formed between each housing and the rotor, a second sliding portion formed between each housing and the torque increasing gear, and a third sliding portion formed between each housing and the output gear, and housing sides of one of the sliding portions are processed by the surface-treating agent described above. Hereinafter, an embodiment of the actuator will be described in more particular with reference to the drawings.

Embodiment B1 of Actuator

FIG. 1 is a top plan view of an actuator of Embodiment B1 when viewed from above, and FIG. 2 is a cross-sectional view of the actuator of Embodiment B1 when viewed from the side thereof. As shown in FIGS. 1 and 2, in the actuator of Embodiment B1, a two-pole step motor 4 having a rotor 12, two torque increasing gears (a first torque increasing gear 6 and a second torque increasing gear 8), and an output gear 10 are provided between two housings 2*a* and 2*b* and are fixed thereto with screws which are not shown in the figures. The fixing may also be performed by using hooks and/or caulking instead of using the screws. In this embodiment, the housings 2*a* and 2*b*, the first torque increasing gear 6, the second torque increasing gear 8, and the output gear 10 are each usually made of a copper alloy, such as brass, an iron alloy, an engineering plastic, or the like.

The two-pole step motor 4 is formed of the rotor 12 made of a two-pole permanent magnet, a two-pole stator 14 which has a rotor hole 14*a* into which the rotor 12 is to be inserted and which is magnetically coupled with the rotor 12, and coils 16*a* and 16*b* fixed to the stator 14, and these elements are arranged in plan. Although the coils 16*a* and 16*b* are separated and are wound around the stator 14, one coil may also be used instead. The rotor hole 14*a* of the stator 14 into which the rotor 12 is to be inserted is formed so that a stable position of the rotor 12 when the coils 16*a* and 16*b* are excited and a stable position of the rotor 12 when the coils 16*a* and 16*b* are not excited are different from each other. In this case, the rotor hole 14*a* has projections 14*b* and 14*c* at positions each forming an angle of approximately 45° with the magnetic pole direction of the stator 14. In addition, in Embodiment B1, although the projections 14*b* and 14*c* are each provided to form an angle of approximately 45° with the magnetic pole direction of the stator, an angle of 25° to 75° is preferable. In addition, in Embodiment B1, although an example in which the projections 14*b* and 14*c* are provided is shown as the shape of the rotor hole 14*a* of the stator 14, the shape of the rotor hole 14*a* may be a hole having a step formed by shifting a half circle thereof to a certain extent.

A pinion 12*a* provided under the rotor 12 is engaged with a gear 6*b* of the first torque increasing gear 6, a pinion 6*a* of the first torque increasing gear 6 is engaged with a gear 8*b* of the second torque increasing gear 8, a pinion 8*a* of the second torque increasing gear 8 is engaged with a gear 10*b* of the output gear 10, and a shaft 10*a* of the output gear 10 is projected above the housing 2*b* and functions as a rotation output shaft 10*a*.

Terminals from a circuit for control and drive of the actuator, which are not shown in the figure, are connected to connection points 18*a* and 18*b* provided on the stator 14. In addition, terminals of the coils 16*a* and 16*b* are also connected to the connection points 18*a* and 18*b*, respectively.

Since the gears are arranged as described above, the rotation generated from the motor, that is, the rotation of the rotor 12, can be transmitted by the first torque increasing gear 6 and the second torque increasing gear 8, and at the same time, the rotary torque of the rotor 12 can be increased. In addition, according to the output gear 10, a power can be output to drive the driven mechanism.

In addition, in the actuator of Embodiment B1, the first sliding portions are formed between the rotor 12 and the housings 2*a* and 2*b*, the second sliding portions are formed between the first torque increasing gear 6 and the housings 2*a* and 2*b* and between the second torque increasing gear 8 and the housings 2*a* and 2*b*, and the third sliding portions are formed between the output gear 10 and the housings 2*a* and 2*b*. FIG. 3 shows an insertion portion of the first torque increasing gear 6 which is inserted in the housing 2*a*. As shown in this FIG. 3, the area of the second sliding portion is changed depending on the shape of the gear. In particular, the second sliding portion may have an area surrounded by dotted lines of FIG. 3(*a*) or may have an area surrounded by dotted lines of FIG. 3 (*b*). The case described above is also applied to the other sliding portions.

In the actuator of Embodiment B1, the housing sides of the sliding portions are processed by the surface-treating agent.

Although a method for processing by a surface-treating agent is not particularly limited, there may be mentioned a method for immersing the housings 2*a* and 2*b* beforehand in a surface-treating agent and a method for applying a surface-treating agent to the holes of the housings 2*a* and 2*b* into which the gears are to be inserted.

Subsequently, the rotor 12, the first torque increasing gear 6, the second torque increasing gear 8, and the output gear 10 are inserted in the housing 2*a*, and the housing 2*b* is fitted thereto so as to sandwich the rotor 12, the first torque increasing gear 6, the second torque increasing gear 8, and the output gear 10 therebetween. As described above, the actuator can be formed.

According to Embodiment B1, the effect of reducing a sound generated from an actuator during driving can be obtained.

Embodiment B2 of Actuator

In an actuator of Embodiment B2, the housing sides of each sliding portion are processed by the surface-treating agent, and further, a lubricant (1) is adhered to the first sliding portions and the second sliding portions, and a lubricant (2) is adhered to the third sliding portions.

In this embodiment, the lubricant (1) and the lubricant (2) will be described.

<<Lubricant (1)>>

The lubricant (1) includes an anti-wear agent and a base oil which contains a polyol ester oil and/or a paraffinic hydrocarbon oil.

The polyol ester oil used as the base oil is, in particular, an ester having a structure obtained by a reaction between a polyol having at least two hydroxyl groups in one molecule and at least one type of a monobasic acid or an acid chloride. When the polyol ester oil as described above is used, the solubility to dissolve additives added to the lubricant is high, and hence the room for selection of additives is increased. In addition, since having lubricity, the above polyol ester oil is suitably used.

As the polyol, for example, neopentyl glycol, trimethylolpropane, pentaerythritol, and dipentaerythritol may be mentioned.

As the monobasic acid, for example, there may be mentioned saturated aliphatic carboxylic acids, such as acetic acid, propionic acid, butyric acid, isobutyric acid, valeric acid, pivalic acid, heptanoic acid, octanoic acid, nonanoic acid, decanoic acid, lauric acid, myristic acid, and palmitic acid; unsaturated aliphatic carboxylic acids, such as stearic acid, acrylic acid, propiolic acid, crotonic acid, and oleic acid; and cyclic carboxylic acids, such as benzoic acid, toluic acid, naphthoic acid, cinnamic acid, cyclohexane carboxylic acid, nicotinic acid, isonicotinic acid, 2-furoic acid, 1-pyrrole carboxylic acid, monoethyl malonate, and monoethyl hydrogen phthalate.

As the acid chloride, for example, salts, such as chlorides of the above monobasic acids, may be mentioned.

As these products, for example, there may be mentioned a neopentyl glycol caprylate caprate mixed ester, a trimethylolpropane valerate heptanoate mixed ester, a trimethylolpropane decanoate octanoate mixed ester, trimethylolpropane nonanoate, and a pentaerythritol heptanoate caprate mixed ester. In addition, in the lubricant (1), as the base oil, only one type of polyol ester oil may be used, or at least two types of polyol ester oils may also be used by mixing.

As the polyol ester oil used for the lubricant (1), in view of viscosity and evaporation rate, a polyol ester having three hydroxyl groups or less is preferable, and a perfect ester having no hydroxyl group is more preferable.

In addition, the kinematic viscosity of the polyol ester oil is preferably 2,500 cSt or less at −40° C. Incidentally, the kinematic viscosity is usually 500 cSt or more at −40° C.

The paraffinic hydrocarbon oil used as the above base oil is formed of an α-olefin polymer in which the total number of carbon atoms is preferably 15 or more, more preferably 15 to 35, and even more preferably 20 to 30. Since the paraffinic hydrocarbon oil as described above has no polarity, even if a member of the actuator is formed of a plastic, the member is, advantageously, not degraded thereby.

The α-olefin polymer having 15 carbon atoms or more is a polymer which has 15 carbon atoms or more in total and which is a homopolymer of ethylene and an α-olefin having 3 to 18 carbon atoms or a copolymer formed of at least two types selected from ethylene and α-olefins each having 3 to 18 carbon atoms. In particular, as the polymer described above, for example, a trimer of 1-decene, a trimer of 1-undecene, a trimer of 1-dodecen, a trimer of 1-tridecene, a trimer of 1-tetradecene, and a copolymer of 1-hexene and 1-pentene may be mentioned. In addition, a polymer which has 15 carbon atoms or more in total and which is formed by polymerizing at least one of 1-butene, 1-pentene, 1-hexene, 1-heptene, 1-octene, 1-nonene, 1-decene, 1-undecene, and 1-dodecen is also suitably used. In addition, in the lubricant (1), as the base oil, only one type of paraffinic hydrocarbon oil may be used, or at least two types of paraffinic hydrocarbon oils may also be used by mixing.

In addition, as the base oil, at least one type of polyol ester oil and at least one type of paraffinic hydrocarbon oil may also be used by mixing. When the base oil as described above is used, the lubricant (1) is not likely to flow from a position to which the lubricant (1) is supplied, and the member is suppressed from being eroded; hence, a lubricant (1) having more superior balance can be obtained.

As the anti-wear agent, a neutral phosphoric ester and/or a neutral phosphorous ester is suitably used. Incidentally, if a metal-based anti-wear agent, a sulfide-based anti-wear agent, an acid phosphoric ester-based anti-wear agent, an acid phosphorous ester-based anti-wear agent, an acid phosphoric ester amine-salt anti-wear agent, or the like is used, the member of the actuator is corroded, and rust may be generated in some cases. As a result, an unnecessary sound may be generated in some cases when the actuator is driven. When an animation is taken by a small electronic device having the actuator as described above, a sound generated during this driving may also be disadvantageously recorded. On the other hand, if a neutral phosphoric ester and/or a neutral phosphorous ester is used, the above problem is not likely to occur.

As the neutral phosphoric ester, a phosphoric ester represented by the following formula (1) may be mentioned.

[Chemical 13]

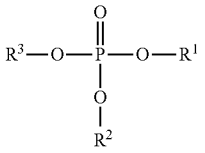

(1)

(In the formula (1), $R^1$, $R^2$, and $R^3$ each independently represent a chain or a branched aliphatic hydrocarbon group having 1 to 20 carbon atoms or a hydrocarbon group containing an aromatic ring having 6 to 20 carbon atoms.)

Among these mentioned above, since the wear resistance and the durability at a low temperature can be further improved, $R^1$, $R^2$, and $R^3$ each preferably independently represent a chain or a branched aliphatic hydrocarbon group having 12 to 18 carbon atoms or a phenyl group which may contain a chain or a branched aliphatic hydrocarbon group having 1 to 10 carbon atoms as a substituent (in this case, when a plurality of substituents is present, the total number of carbon atoms of these substituents is 1 to 14), and a dodecyl group, a tridecyl group, an oleyl group, a stearyl group, a phenyl group, a cresyl group, a dimethylphenyl group, a di-t-butylphenyl group, or a nonylphenyl group is more preferable.

As the neutral phosphoric ester described above, in particular, there will be preferably used trioleyl phosphate, tricresyl phosphate, trixylenyl phosphate, triphenyl phosphate, tris(nonylphenyl) phosphate, tris(tridecyl) phosphate, tristearyl phosphate, and tris(2,4-di-t-butylphenyl) phosphate.

In addition, a neutral phosphoric ester other than the neutral phosphoric ester represented by the formula (1) may also be suitably used. As the above neutral phosphoric ester, for example, there may be mentioned trimethylolpropane phosphate, tetraphenyldipropylene glycol diphosphate, tetraphenyltetra(tridecyl)pentaerythritol tetraphosphate, tetra(tridecyl)-4,4'-isopropylidenediphenyl diphosphate, bis(tridecyl) pentaerythritol diphosphate, bis(nonylphenyl)pentaerythritol diphosphate, distearyl pentaerythritol diphosphate, or a hydrogenated bisphenol A/pentaerythritol phosphate polymer.

As the neutral phosphorous ester, a phosphoric ester represented by the following formula (2) may be mentioned.

[Chemical 14]

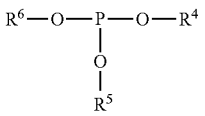

(2)

(In the formula (2), $R^4$, $R^5$, and $R^6$ each independently represent a chain or a branched aliphatic hydrocarbon group having 1 to 20 carbon atoms or a hydrocarbon group containing an aromatic ring having 6 to 20 carbon atoms.)

Among these mentioned above, since the wear resistance and the durability at a low temperature can be further improved, $R^4$, $R^5$, and $R^6$ each preferably independently represent a chain or a branched aliphatic hydrocarbon group having 12 to 18 carbon atoms or a phenyl group which may contain a chain or a branched aliphatic hydrocarbon group having 1 to 10 carbon atoms as a substituent (in this case, when a plurality of substituents is present, the total number of carbon atoms of these substituents is 1 to 14), and a dodecyl group, a tridecyl group, an oleyl group, a stearyl group, a phenyl group, a cresyl group, a dimethylphenyl group, a di-t-butylphenyl group, or a nonylphenyl group is more preferable.

As the neutral phosphorous ester described above, in particular, there may be suitably used trioleyl phosphite, tricresyl phosphite, trixylenyl phosphite, triphenyl phosphite, tris (nonylphenyl) phosphite, tris(tridecyl) phosphite, tristearyl phosphite, and tris(2,4-di-t-butylphenyl) phosphite.

In addition, a neutral phosphorous ester other than the neutral phosphoric ester represented by the above formula (2) is also suitably used. As the above neutral phosphoric ester, for example, there may be mentioned trimethylolpropane phosphite, tetraphenyldipropylene glycol diphosphite, tetraphenyltetra(tridecyl)pentaerythritol tetraphosphite, tetra (tridecyl)-4,4'-isopropylidenediphenyl diphosphite, bis (tridecyl)pentaerythritol diphosphite, bis(nonylphenyl) pentaerythritol diphosphite, distearyl pentaerythritol diphosphite, or a hydrogenated bisphenol A/pentaerythritol phosphite polymer.

The above neutral phosphoric esters may be used alone, or at least two types thereof may also be used in combination. The case described above is also applied to the neutral phosphorous esters. In addition, at least one type of neutral phosphoric ester and at least one type of neutral phosphorous ester may be used in combination.

In addition, in the lubricant (1), with respect to 100 parts by mass of the total of the base oil and the anti-wear agent, 85 to 99.5 parts by mass, preferably 95 to 99 parts by mass, and more preferably 95 to 97 parts by mass of the base oil is included, and 0.5 to 15 parts by mass, preferably 1 to 5 parts by mass, and more preferably 3 to 5 parts by mass of the anti-wear agent is included. As described above, since including a specific base oil and a specific anti-wear agent at a specific ratio, if the lubricant (1) is used at a sliding portion of an actuator, the wear is suppressed, and the durability can be improved. In addition, the wear resistance and the durability can be improved in a wide temperature range from a low temperature to a high temperature (−40° C. to 80° C.). If more than 15 parts by mass of the anti-wear agent is included, the member of the actuator may be corroded in some cases. In addition, in the case in which at least two types of base oils are used by mixing, the above amount of the base oil is the total amount of the at least two types of base oils. In addition, the case described above is also applied to the amount of the anti-wear agent.

In addition, International Publication WO2001/059043 pamphlet has disclosed as a lubricant for a watch, a lubricating oil composition including, besides a base oil, 0.1 to 20 percent by mass of a viscosity index improver and 0.1 to 8 percent by mass of an anti-wear agent. However, this lubricating oil composition cannot always improve the wear resistance of an actuator. The reason for this is believed that the case is not taken into consideration in which a force applied to the sliding portion of the actuator is larger than that applied to a sliding portion of a watch. On the other hand, according to the lubricant (1), since the specific base oil and anti-wear agent are included at a specific ratio as described above, in the use at a low temperature as well as at ordinary temperature, the wear resistance and the durability of the actuator can be improved.

The lubricant (1) may further include a metal deactivator, an antioxidant, or a fluorescent agent.

The metal deactivator is added to prevent corrosion of the member of the actuator, and as this metal deactivator, benzotriazole or its derivative is suitably used.

As the benzotriazole derivatives, in particular, there may be mentioned 2-(2'-hydroxy-5'-methylphenyl)benzotriazole, 2-[2'-hydroxy-3',5'-bis(α,α-dimethylbenzyl)phenyl]-benzotriazole, 2-(2'-hydroxy-3',5'-di-t-butyl-phenyl)-benzotriazole, and a compound having the structure represented by the following formulas in which R, R', and R" each represent an alkyl group having 1 to 18 carbon atoms, such as 1-(N,N-bis(2-ethylhexyl)aminomethyl)benzotriazole.

[Chemical 15]

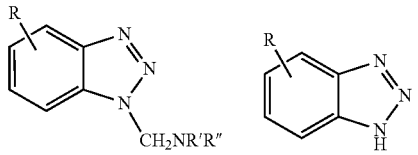

These compounds may be used alone, or at least two types thereof may also be used in combination.

In the lubricant (1), based on 100 parts by mass of the total of the base oil and the anti-wear agent, usually 0.01 to 3 parts by mass, preferably 0.02 to 3 parts by mass, and more preferably 0.03 to 0.06 parts by mass of the metal deactivator is used. When the metal deactivator in an amount in the range described above is used together with the anti-wear agent, corrosion of the member of the actuator can be further prevented, and in addition, the total acid number of the lubricant (1) can be controlled in a preferable range.

The antioxidant is added to prevent deterioration of the lubricant (1) over a long period of time, and as this antioxidant, a phenol-based antioxidant and/or an amine-based antioxidant is suitably used.

The phenol-based antioxidant is preferably at least one compound selected from 2,6-di-t-butyl-p-cresol, 2,4,6-tri-t-butylphenol, and 4,4'-methylenebis(2,6-di-t-butylphenol. In addition, as the amine-based antioxidant, a diphenylamine derivative is preferable. These compounds may be used alone, or at least two types thereof may also be used in combination.

In the lubricant (1), based on 100 parts by mass of the total of the base oil and the anti-wear agent, usually 0.01 to 1.0 parts by mass, preferably 0.01 to 0.5 parts by mass, and more preferably 0.03 to 0.06 parts by mass of the antioxidant is used. When the antioxidant in an amount in the range described above is used, the deterioration of the lubricant (1) can be prevented over a longer period of time.

As the fluorescent agent, an inorganic or an organic fluorescent substance may be mentioned. The fluorescent agent can be used to judge whether the lubricant (1) is supplied to the sliding portion of the actuator or not. Since a portable electronic device, such as a cellular phone, in which an actuator is mounted is rarely used by performing maintenance and/or repair work, when a portable electronic device is assembled using an actuator, it is preferable that the lubricant (1) be reliably supplied to the sliding portion. For this reason, when the device is assembled, it is usually checked whether the lubricant (1) is supplied to the sliding portion or not. In more particular, the sliding portion to which the lubricant (1) is supplied is irradiated with ultraviolet rays, and excited light such as fluorescence generated when the fluorescent agent receives ultraviolet rays is detected by visual inspection or a device having a photosensor, so that whether the lubricant (1) is supplied or not is confirmed.

As the organic fluorescent substance, for example, pyrene, perylene, 1,6 diphenyl-1,3,5-hexatriene, 1,8-diphenyl-1,3,5,7-octatetraene, and coumarin 6 may be mentioned. These compounds may be used alone, or at least two types thereof may also be used in combination.

In the lubricant (1), based on 100 parts by mass of the total of the base oil and the anti-wear agent, usually 0.01 to 0.5 parts by mass and preferably 0.05 to 0.2 parts by mass of the fluorescent agent is used.

The lubricant (1) preferably includes no viscosity index improver. When the viscosity index improver is not included, the wear resistance and the durability at a low temperature (down to −40° C.) can be further improved. In particular, if the viscosity index improver is included, the viscosity excessively increases at a low temperature, and the sliding property may be degraded in some cases. On the other hand, if the viscosity index improver is not included, the fluidity becomes high at a high temperature, and the wear resistance and the durability may be degraded in some cases. However, in the lubricant (1), since a relatively large amount of the anti-wear agent is included, the problem as described above is not likely to occur.

As the viscosity index improver, for example, a homopolymer selected from a polyacrylate, a polymethacrylate, a polyisobutylene, a poly(alkyl styrene), a polyester, isobutylene fumarate, styrene maleate ester, and vinyl acetate fumarate ester, or a compound obtained by copolymerization, such as a poly(butadiene styrene) copolymer, a poly(methyl methacrylate-vinylpyrrolidone) copolymer, or an ethylene alkyl acrylate copolymer, may be mentioned.

As the polyacrylate and polymethacrylate, in particular, a polymer of acrylic acid or methacrylic acid, or a polymer of an alkyl ester having 1 to 10 carbon atoms may be mentioned. As the poly(alkyl styrene), in particular, for example, a polymer of a monoalkyl styrene having a substituent of 1 to 18 carbon atoms, such as a poly(α-methyl styrene), a poly(β-methyl styrene), a poly(α-ethyl styrene), or a poly(β-ethyl styrene), may be mentioned. As the polyester, for example, there may be mentioned a polyester obtained from a polyhydric alcohol, such as ethylene glycol, propylene glycol, neopentyl glycol, or dipentaerythritol, having 1 to 10 carbon atoms and a polybasic acid, such as oxalic acid, malonic acid, succinic acid, glutaric acid, adipic acid, fumaric acid, or phthalic acid. As the α-olefin copolymer, in particular, for example, there may be mentioned an ethylene propylene copolymer formed of recurring units derived from ethylene and recurring units derived from isopropylene, and in addition, for example, a reaction product obtained by copolymerizing α-olefins, such as ethylene, propylene, butylene, and butadiene, having 2 to 18 carbon atoms may also be mentioned.

The lubricant (1) is prepared by appropriately mixing the components described above.

When the lubricant (1) is allowed to stand at 90° C., the change in weight thereof is 1.62 percent by mass or less, preferably 1.0 percent by mass or less, and more preferably 0.5 percent by mass or less. Since a smaller change in weight is more preferable, the lower limit thereof is not particularly specified but is generally approximately 0.01 percent by mass. If the change in weight, that is, if the evaporation loss (in this specification, also referred to as an evaporation rate in some cases), obtained when the lubricant is allowed to stand at 90° C. is in the range described above, operation stability over a long period of time can be improved in a wide range from a low temperature to a high temperature (in particular, at a high temperature). In addition, the change in weight obtained when the lubricant is allowed to stand at 90° C.

indicates an evaporation rate obtained when 230 g of the lubricant (1) charged in a container having a diameter of 6 cm and a depth of 10 cm is allowed to stand in an open state at 90° C. for 1,000 hours.

In addition, the total acid number of the lubricant (1) is 0.2 mgKOH/g or less, preferably 0.1 mgKOH/g or less, and more preferably 0.03 to 0.1 mgKOH/g. If the total acid number is more than 0.2 mgKOH/g, the member of the actuator is corroded, and rust may be generated in some cases. Hence, an unnecessary sound may be generated when the actuator is driven. When an animation is taken by a portable electronic device having an actuator as described above, a sound generated during this driving is also disadvantageously recorded. On the other hand, if the total acid number is in the range described above, the above problem is not likely to occur. In addition, when the total acid number is 0.03 mgKOH/g or more, the sliding property of the lubricant (1) is improved. The total acid number can be reduced by using a base oil refined, for example, by distillation or a high purity neutral phosphoric ester or neutral phosphorous ester, such as that of a reagent grade purity. In addition, the total acid number may by reduced by using a metal deactivator. As impurities which may be contained in the neutral phosphoric ester or the neutral phosphorous ester, for example, an acid phosphoric ester or an acid phosphorous ester may be mentioned. If these impurities are contained, the total acid number of the lubricant (1) will be increased. For this reason, in the lubricant (1), if a high purity neutral phosphoric ester or neutral phosphorous ester is used, even when a relatively large amount of the neutral phosphoric ester or the neutral phosphorous ester is contained as in the lubricant (1), the total acid number can be controlled in the range described above. Incidentally, the total acid number is measured based on "JIS K2501-1992 petroleum product and lubricating oil-neutralization number testing method". In particular, a sample is dissolved in a mixed solvent of toluene, isopropyl alcohol, and water and is measured by a potentiometric titration method using a standard isopropyl alcohol solution of potassium hydroxide.

The lubricant (1) is suitably used particularly as a lubricant for a sliding portion of an actuator.

<<Lubricant (2)>>

The lubricant (2) includes an anti-wear agent, polytetrafluoroethylene particles, and a base oil containing a polyol ester oil and/or a paraffinic hydrocarbon oil.

The base oil and the anti-wear agent used for the lubricant (2) are similar to the base oil and the anti-wear agent used for the lubricant (1) in terms of the preferable compounds, the ranges of properties, the reasons therefor, and the like.

As for the polytetrafluoroethylene particles, the content of particles having a diameter of 1 μm or less is preferably 90 percent by mass or more, and the content of particles having a particle diameter of 0.01 to 1 μm is more preferably 90 percent by mass or more. In addition, it is more preferable that the contents of polytetrafluoroethylene particles having a particle diameter of 10 μm or less and 1 μm or less be 100 percent by mass and 90 percent by mass or more, respectively, and it is particularly preferable that the contents of particles having a particle diameter of 10 μm or less and 0.01 to 1 μm be 100 percent by mass and 90 percent by mass or more, respectively. When the content of particles having a particle diameter of 1 μm or less is less than 90 percent by mass, the sliding property of the lubricant (1) may be degraded in some cases. In addition, the particle diameter and the content are measured by a laser diffraction type particle size distribution measuring apparatus.

In addition, the aspect ratio of the polytetrafluoroethylene particles is preferably 0.5 to 1.0. When the aspect ratio is in the range described above, it is preferable since the fluidity and the sliding property of the lubricant (1) are not disturbed. In addition, the aspect ratio is one of the shape indices of particles, is a ratio of the minor axis to the major axis (minor axis/major axis) of a two-dimensional projection image of particles, and is measured by a flow type particle image analysis apparatus.

The polytetrafluoroethylene particles may be manufactured by any one of block polymerization, suspension polymerization, solution polymerization, and emulsion polymerization.

In addition, in the lubricant (2), 85 to 99.5 parts by mass, preferably 95 to 99 parts by mass, and more preferably 95 to 97 parts by mass of the base oil is included, and 0.5 to 15 parts by mass, preferably 1 to 5 parts by mass, and more preferably 3 to 5 parts by mass of the anti-wear agent is included with respect to 100 parts by mass of the total of the base oil and the anti-wear agent, and 30 to 50 parts by mass and preferably 40 to 50 parts by mass of the polytetrafluoroethylene particles is included with respect to 100 parts by mass of the total of the base oil and the anti-wear agent. As described above, since including a specific base oil and a specific anti-wear agent at a specific ratio, if the lubricant (2) is used at a sliding portion of an actuator, the wear is suppressed, and the durability can be improved. In addition, the wear resistance and the durability can be improved in a wide temperature range from a low temperature to a high temperature (−40° C. to 80° C.). If more than 15 parts by mass of the anti-wear agent is included, when the lubricant is used for the actuator, the member thereof may be corroded in some cases. In addition, since including the polytetrafluoroethylene particles at a specific ratio, even if the lubricant (2) is used at a portion of the sliding portion of the actuator to which a force is particularly applied, the lubricant (2) can stay at the above portion over a long period of time. Hence, the wear resistance and the durability of the sliding portion of the actuator to which a force is particularly applied can be improved. Furthermore, when the polytetrafluoroethylene particles are used, the lubricant is not deteriorated even at a low temperature (−40° C.), and hence the wear resistance and the durability at a low temperature (down to −40° C.) can be improved. In addition, in the case in which at least two types of base oils are used, the above amount of the base oil is the total amount of the at least two types of base oils. The case described above is also applied to the amount of the anti-wear agent.

In addition, as disclosed, for example, in International Publication WO2004/018594 pamphlet, in a grease composition for a watch, in order to enable a lubricant component to stay at a sliding portion over a long period of time, a thickening agent, such as lithium stearate or a diurea compound, is used. However, when a grease composition containing the above thickening agent is used on an actuator which can be used at a temperature lower than that in the case of a watch, a sliding resistance is excessively increased at a low temperature (−40° C.), and the lubrication cannot be performed. On the other hand, since the lubricant (2) includes the polytetrafluoroethylene particles at a specific ratio with the specific base oil and the specific anti-wear agent as described above, extreme-pressure performance can be obtained even at a low temperature (−40° C.) together with a predetermined fluidity. Hence, according to the lubricant (2), as described above, the wear resistance and the durability of the actuator can be improved in the use not only at ordinary temperature but also at a low temperature. Furthermore, unlike the above grease composition, since including no metallic soap, the lubricant (2) is also preferable in view of environmental conservation.

The lubricant (2) may further include a metal deactivator, an antioxidant, or a fluorescent agent. The metal deactivator, the antioxidant, and the fluorescent agent are similar to the metal deactivator, the antioxidant, and the fluorescent agent used for the lubricant (1) in terms of the preferable compounds, the ranges of properties and amounts, the reasons therefor, and the like.

The lubricant (2) is prepared by appropriately mixing the components described above.

The total acid number of the lubricant (2) and the change in weight thereof obtained when the lubricant (2) is allowed to stand at 90° C. are similar to the total acid number of the lubricant (1) and the change in weight thereof obtained when the lubricant (1) is allowed to stand at 90° C., respectively, in terms of the desirable ranges, the reasons therefor, and the like.

The lubricant (2) is suitably used particularly as a lubricant for a portion of a sliding portion of an actuator to which a force is particularly applied.

For the actuator of Embodiment B2, the lubricant (1) and the lubricant (2) are suitably used as a lubricant for the sliding portion.

Although a method for adhering the lubricant (1) and the lubricant (2) is not particularly limited, the following method may be mentioned. In the housing 2*a* processed by the surface-treating agent, the lubricant (1) is supplied in holes into which the rotor 12, the first torque increasing gear 6, and the second torque increasing gear 8 are to be inserted, and the lubricant (2) is supplied in a hole into which the output gear 10 is to be inserted. Subsequently, the rotor 12, the first torque increasing gear 6, the second torque increasing gear 8, and the output gear 10 are inserted in the housing 2*a*, and the housing 2*b* processed by the surface-treating agent is fitted thereto so as to sandwich the rotor 12, the first torque increasing gear 6, the second torque increasing gear 8, and the output gear 10 therebetween. Finally, from above the housing 2*b*, the lubricant (1) is supplied in holes into which the rotor 12, the first torque increasing gear 6, and the second torque increasing gear 8 are inserted, and the lubricant (2) is supplied in a hole into which the output gear 10 is inserted. As descried above, the lubricant (1) and the lubricant (2) can be adhered to the sliding portions.

According to Embodiment B2, the effect of improving wear resistance and durability can be obtained together with the effect of reducing a sound generated from an actuator during driving as described in Embodiment B1. Of course, without using the lubricant (1) and the lubricant (2), if the housing sides of the sliding portions are processed by the surface-treating agent, the sound reduction effect can be obtained. However, as in Embodiment B1, when the lubricant (1) and the lubricant (2) are used together with the surface-treating agent, a more superior sound reduction effect can be obtained over a longer period of time. The reason for this is believed that the compound derived from the neutral phosphoric ester included in the surface-treatment agent has properties similar to those of the neutral phosphoric esters included in the lubricant (1) and the lubricant (2). In more particular, it is believed that when the compound derived from the neutral phosphoric ester of the surface-treating agent is removed from the housing, the neutral phosphoric esters included in the lubricant (1) and the lubricant (2) are supplied to a portion of the housing from which the surface-treating agent is removed.

Furthermore, according to Embodiment B2, the effect of improving wear resistance and durability can be obtained over a longer period of time than that when only the lubricant (1) and the lubricant (2) are used. The reason for this is believed that the surface-treating agent has properties to enable the lubricant (1) and the lubricant (2) to stay at positions to which the lubricants are supplied.

In addition, even if the lubricant (1) and the lubricant (2) are not used, when the housing sides of the sliding portion are processed by the surface-treating agent, the wear resistance and the durability can be improved although being inferior to those of the case in which the lubricant (1) and the lubricant (2) are used.

In addition, Embodiment B2 is preferably applied to the case in which a force is applied particularly to the third sliding portion and in which a force is not so much applied to the first sliding portion and the second sliding portion. At the third sliding portion to which a force is particularly applied, the lubricant (2) can stay over a long period of time, and at the first sliding portion and the second sliding portion at which a force is not so much applied, without any excessive increase in sliding resistance, lubrication can be performed over a long period of time. For this reason, according to Embodiment B2, the wear resistance and the durability can be improved in a wide temperature range from a low temperature to a high temperature.

Embodiment B3 of Actuator

In the actuator of Embodiment B2, the housing sides of each of the sliding portions are processed by the surface-treating agent, the two torque increasing gears are engaged with each other (the first torque increasing gear 6 and the second torque increasing gear 8 are engaged with each other), the lubricant (2) is adhered to the second sliding portions of the second torque increasing gear 8 engaged with the output gear 10, the lubricant (1) is adhered to the second sliding portions of the first torque increasing gear 6 not engaged with the output gear 10, the lubricant (1) is adhered to the first sliding portions, and the lubricant (2) is adhered to the third sliding portions.

Although a method for adhering the lubricant (1) and the lubricant (2) is not particularly limited, a method in accordance with that of Embodiment B1 may be mentioned.

According to Embodiment B3, an effect similar to that of Embodiment B2 can be obtained.

In addition, Embodiment B3 is preferably applied to the case in which a force is applied particularly to the second sliding portions formed by the second torque increasing gear and third sliding portions and in which a force is not so much applied to the first sliding portions and the second sliding portions formed by the first torque increasing gear. At the sliding portion to which a force is particularly applied, the lubricant (2) can stay over a long period of time, and at the sliding portion to which a force is not so much applied, without any excessive increase in sliding resistance, lubrication can be performed over a long period of time. Hence, according to Embodiment B3, the wear resistance and the durability can be improved in a wide temperature range from a low temperature to a high temperature.

(Embodiment of Another Actuator)

In Embodiments B1 to B3, although a three-stage torque increasing gear train is formed, in accordance with the relationship between a power of the two-pole step motor and a power required for the driven mechanism, a two-stage torque increasing gear train or a four-stage torque increasing gear train may also be formed. In addition, in accordance with a driving speed and a space of the driven mechanism, the number of gear may be increased or decreased by changing a torque increasing rate between the gears.

In addition, in Embodiments B1 to B3, although the two-pole step motor is used, in accordance with the power required for the driven mechanism, a three-pole step motor or a four-pole step motor may also be used. Furthermore, as long as the rotation is transmitted to the torque increasing gear, another motor may also be used.

In addition, in Embodiments B2 and B3, although the lubricant (1) or the lubricant (2) is adhered to all the sliding portions, an actuator may also be formed in which the lubricant (1) or the lubricant (2) is adhered to any one of each first sliding portion, each second sliding portion, and each third sliding portion. In the case of a portable electronic device, when a power required for a driven mechanism, such as a camera module, is taken into consideration, Embodiment B2 or Embodiment B3 is preferable.

In addition, in the case in which the actuator of Embodiment B2 is assembled and is actually used, if it is found that a large force is applied to the second torque increasing gear 8, the lubricant (2) may be adhered thereto afterward. As described above, afterwards, the above actuator can be changed into the actuator of Embodiment B3. Since the lubricant (1) and the lubricant (2) according to the present invention have common base oil and anti-wear agent, the lubricant (2) which is adhered afterward may be compatible with the lubricant (1) adhered beforehand.

In addition, in Embodiments B1 to B3, although the housing sides of all the sliding portions are processed by the surface-treating agent, an actuator may also be formed in which the housing sides of any one of each first sliding portion, each second sliding portion, and each third sliding portion are processed by the surface-treating agent. In the case of a portable electronic device, when the sound reduction effect is taken into consideration, an embodiment in which the housing sides of all the sliding portions are processed by the surface-treating agent is preferable.

<Small Electronic Device>

As a small electronic device according to the present invention, for example, a portable electronic device or a precision device may be mentioned, and in more particular, a cellular phone, a PHS, a personal digital assistant, a portable computer (mobile computer), a digital camera, a video camera, or the like may be mentioned. The small electronic device described above includes a sliding portion processed by the above surface-treating agent. In particular, the portable electronic device includes an actuator processed by the surface-treating agent described above. In this case, as a driven mechanism driven by the actuator, in particular, a camera module mounted in a portable electronic device may be mentioned. Furthermore, the small electronic device according to the present invention includes a sliding portion processed by the surface-treating agent as well as adhered with the lubricant (1) or the lubricant (2) as described above. In particular, the above portable electronic device preferably includes an actuator processed by the above surface-treating agent as well as adhered with the lubricant (1) or the lubricant (2) as described above.

In addition, the actuator according to the present invention may also be applied to a small toy. For example, the actuator may also be used, for example, to move legs or the like of a miniature doll or an animal.

C. Lubrication Kit

Finally, a lubrication kit according to the present invention and a small electronic device using this lubrication kit will be described in detail.

The lubrication kit according to the present invention which is used for a small electronic device having a sliding portion is formed of a surface-treating agent and at least one lubricant selected from the lubricant (1) and the lubricant (2). In particular, the lubrication kit is formed of a container containing a lubricant and a container containing a surface-treating agent.

As the small electronic device, for example, a portable electronic device or a precision device may be mentioned, and in more particular, a cellular phone, a PHS, a personal digital assistant, a portable computer (mobile computer), a digital camera, a video camera, or the like may be mentioned.

As sliding portions of the small electronic device, for example, gears of an actuator and a watch, such as a wrist watch, may be mentioned.

The lubricant (1), the lubricant (2), and the surface-treating agent are the same as those described above.

In a small electronic device processed by the lubrication kit, that is, in a small electronic device in which at least one type of lubricant selected from the lubricant (1) and the lubricant (2) and the surface-treating agent are adhered to a sliding portion, a more superior effect of improving wear resistance and durability and sound reduction effect can be obtained. Specifically, this is as described above with regard to the actuator.

A method for manufacturing a small electronic device as described above includes a step of adhering at least one type of lubricant selected from the lubricant (1) and the lubricant (2) and the surface-treating agent to a sliding portion. Specifically, this is as described above with regard to the actuator.

In addition, the above lubrication kit is also suitably used for a sliding portion of a watch. If the lubrication kit is used, a drive sound of a watch is reduced. Accordingly, when recording is performed by a recorder mounted in the watch, an effect in which a drive sound is not allowed to be recorded can be obtained.

In addition, since a watch is not always used at a low temperature (−40° C.), or since a force applied thereto is small, instead of using at least one type of lubricant selected from the lubricant (1) and the lubricant (2), a lubricant conventionally used for a sliding portion of a watch may be used. In this case, the above effects (more superior effect of improving wear resistance and durability and sound reduction effect) can also be obtained.

As the conventional lubricant, for example, first to third lubricating oil compositions disclosed in International Publication 2001/059043 may be suitably used.

First Lubricating Oil Composition

The first lubricating oil composition includes a polyol ester (A) as a base oil, a viscosity index improver (B), and an anti-wear agent (C), and further includes, if needed, a metal deactivator (D) and an antioxidant (E).

[Polyol Ester (A)]

As the polyol ether (A) used as a base oil for this first lubricating oil composition, in particular, an ester having a structure obtained by a reaction between a polyol having at least two hydroxyl groups in one molecule and one or plural kinds of monobasic acids or acid chlorides may be mentioned.

As the polyol, for example, neopentyl glycol, trimethylolpropane, pentaerythritol, or dipentaerythritol may be mentioned.

As the monobasic acid, for example, there may be mentioned a saturated aliphatic carboxylic acid, such as acetic acid, propionic acid, butyric acid, isobutyric acid, valeric acid, pivalic acid, heptanoic acid, octanoic acid, nonanoic acid, decanoic acid, lauric acid, myristic acid, or palmitic acid;

an unsaturated aliphatic carboxylic acid, such as stearic acid, acrylic acid, propiolic acid, crotonic acid, or oleic acid; or a cyclic carboxylic acid, such as benzoic acid, toluic acid, naphthoic acid, cinnamic acid, cyclohexane carboxylic acid, nicotinic acid, isonicotinic acid, 2-furoic acid, 1-pyrrole carboxylic acid, monoethyl malonate, or monoethyl hydrogen phthalate.

As the acid chloride, for example, a salt, such as a chloride of one of the above monobasic acids, may be mentioned.

As the products obtained therefrom, for example, there may be mentioned a neopentyl glycol caprylate caprate mixed ester, a trimethylolpropane valerate heptanoate mixed ester, a trimethylolpropane decanoate octanoate mixed ester, trimethylolpropane nonanoate, and a pentaerythritol heptanoate caprate mixed ester.

As the polyol ester (A) used in the present invention, a polyol ester having three hydroxyl groups or less is preferable, and a perfect ester having no hydroxyl group is particularly preferable.

In addition, the kinematic viscosity of the polyol ester (A) is preferably 1,500 cSt or less at −30° C.

[Viscosity Index Improver (B)]

The viscosity index improver (B) used for the first lubricating oil composition is generally one polymer selected from a polyacrylate, a polymethacrylate, a polyisobutylene, a poly (alkyl styrene), a polyester, isobutylene fumarate, styrene maleate ester, vinyl acetate fumarate ester, and an α-olefin copolymer, or at least one of compounds obtained by copolymerization, such as a poly(butadiene styrene) copolymer, a poly(methyl methacrylate-vinylpyrrolidone) copolymer, and an ethylene alkyl acrylate copolymer.

As the polyacrylate or the polymethacrylate, a polymerized material of acrylic acid or methacrylic acid, or a polymer of an alkyl ester having 1 to 10 carbon atoms may be used. Among these compounds mentioned above, a polymethacrylate obtained by polymerizing methyl methacrylate is preferable.

As the viscosity index improvers, conventionally known materials may be used.

In particular, as the poly(alkyl styrene), for example, a polymer of a monoalkyl styrene having a substituent of 1 to 18 carbon atoms, such as a poly(α-methyl styrene), a poly(β-methyl styrene), a poly(α-ethyl styrene), or a poly(β-ethyl styrene), may be mentioned.

As the polyester, for example, there may be mentioned a polyester obtained from a polyhydric alcohol having 1 to 10 carbon atoms, such as ethylene glycol, propylene glycol, neopentyl glycol, or dipentaerythritol, and a polybasic acid, such as oxalic acid, malonic acid, succinic acid, glutaric acid, adipic acid, fumaric acid, or phthalic acid.

As the α-olefin copolymer, in particular, for example, there may be mentioned an ethylene propylene copolymer formed of recurring units derived from ethylene and recurring units derived from isopropylene, and in addition, for example, a reaction product obtained by copolymerizing α-olefins, such as ethylene, propylene, butylene, and butadiene, having 2 to 18 carbon atoms may also be mentioned.

These compounds mentioned above may be used alone, or at least two types thereof may also be used in combination.

In the present invention, with respect to 100 percent by weight of the lubricating oil composition, 0.1 to 20 percent by weight, preferably 0.1 to 15 percent by weight, and more preferably 0.1 to 10 percent by weight of the viscosity index improver (B) is used. When the viscosity index improver (B) is used at a ratio in the above range, a watch can be properly operated.

[Anti-Wear Agent (C)]

The anti-wear agent (C) used for the first lubricating oil composition is usually a neutral phosphoric ester and/or a neutral phosphorous ester.

As the neutral phosphoric ester, in particular, for example, there may be mentioned tricresyl phosphate, trixylenyl phosphate, trioctyl phosphate, trimethylolpropane phosphate, triphenyl phosphate, tris(nonylphenyl) phosphate, triethyl phosphate, tris(tridecyl) phosphate, tetraphenyldipropylene glycol diphosphate, tetraphenyltetra(tridecyl)pentaerythritol tetraphosphate, tetra(tridecyl)-4,4'-isopropylidenediphenyl phosphate, bis(tridecyl)pentaerythritol diphosphate, bis(nonylphenyl)pentaerythritol diphosphate, tristearyl phosphate, distearyl pentaerythritol diphosphate, tris(2,4-di-t-butylphenyl) phosphate, or a hydrogenated bisphenol A/pentaerythritol phosphate polymer.

As the neutral phosphorous ester, in particular, for example, there may be mentioned trioleyl phosphite, trioctyl phosphite, trimethylolpropane phosphite, triphenyl phosphite, tris(nonylphenyl) phosphite, triethyl phosphite, tris (tridecyl) phosphite, tetraphenyldipropylene glycol diphosphite, tetraphenyltetra(tridecyl)pentaerythritol tetraphosphite, tetra(tridecyl)-4,4'-isopropylidenediphenyl phosphite, bis(tridecyl)pentaerythritol diphosphite, bis(nonylphenyl)pentaerythritol diphosphite, tristearyl phosphite, distearyl pentaerythritol diphosphite, tris(2,4-di-t-butylphenyl) phosphite, or a hydrogenated bisphenol A/pentaerythritol phosphite polymer.

These compounds mentioned above may be used alone, or at least two types thereof may also be used in combination.

In the present invention, with respect to 100 percent by weight of the lubricating oil composition, 0.1 to 8 percent by weight, preferably 0.1 to 5 percent by weight, and more preferably 0.5 to 1.5 percent by weight of the anti-wear agent (C) is used. If the anti-wear agent (C) is used at a ratio in the above range, frictional wear is not generated, and a watch can be preferably operated.

[Metal Deactivator (D)]

As the metal deactivator (D) used, if needed, for the first lubricating oil composition, benzotriazole or its derivative is preferable.

As the benzotriazole derivative, in particular, for example, there may be mentioned 2-(2'-hydroxy-5'-methylphenyl)benzotriazole, 2-[2'-hydroxy-3',5'-bis(α,α-dimethylbenzyl)phenyl]-benzotriazole, 2-(2'-hydroxy-3',5'-di-t-butyl-phenyl)-benzotriazole, or a compound having the structure represented by the following formula in which R, R', and R" each represent an alkyl group having 1 to 18 carbon atoms, such as 1-(N,N-bis(2-ethylhexyl)aminomethyl)benzotriazole.

[Chemical 16]

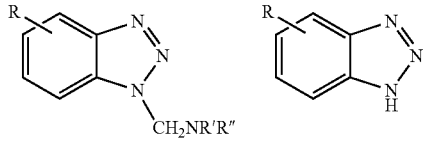

These compounds mentioned above may be used alone, or at least two types thereof may also be used in combination.

In the present invention, with respect to 100 percent by weight of the lubricating oil composition, usually 0.01 to 3 percent by weight, preferably 0.02 to 1 percent by weight, and more preferably 0.03 to 0.06 percent by weight of the metal deactivator (D) is used. If the metal deactivator (D) is used at a ratio in the above range together with the viscosity index improver (B) and the anti-wear agent (C), corrosion of metal, such as copper, can be prevented.

When the first lubricating oil composition is used for a watch using metal parts, such as Watch Movement™ (No. 2035, manufactured by Citizen Watch Co., Ltd., a wheel row section is made of metal (primarily made of brass and iron), the metal parts also should not be changed as in the case of a lubricant oil base oil. In this case, the metal deactivator (D) is preferably added.

[Antioxidant (E)]

The antioxidant (E) used, if needed, for the first lubricating oil composition is usually a phenol-based antioxidant and/or an amine-based antioxidant.

As the amine-based antioxidant, a diphenylamine derivative is preferable.

In addition, as the phenol-based antioxidant, at least one compound selected from 2,6-di-t-butyl-p-cresol, 2,4,6-tri-t-butylphenol, and 4,4'-methylenebis(2,6-di-t-butylphenol) is preferable.

These antioxidants (E) may be used alone, or at least two types thereof may also be used in combination.

In the present invention, with respect to 100 percent by weight of the lubricating oil composition, usually 0.01 to 3 percent by weight, preferably 0.01 to 2 percent by weight, and more preferably 0.03 to 1.20 percent by weight of the antioxidant (E) is used. If the antioxidant (E) is used at a ratio in the above range, the deterioration of the lubricating oil composition can be prevented over a long period of time.

In a watch module used for a long period of time, a lubricating oil composition to be used must be prevented from being oxidized so as not to be deteriorated over a long period of time. In order to stabilize the first lubricating oil composition over a long period of time without oxidation thereof, the antioxidant (E) is preferably added.

[First Lubricating Oil Composition]

In the first lubricating oil composition, in general, it is preferable that the kinematic viscosity be 13 to 1,500 cSt at a temperature of from −30° C. to 80° C., the change in weight obtained when the composition is allowed to stand at 90° C. for 1000 hours be 1.62 percent by weight or less, and the total acid number be 0.2 mgKOH/g or less.

When the change in weight, that is, when the evaporation loss, obtained when the first lubricating oil composition is allowed to stand at 90° C. is 1.62 percent by weight or less, operation stability at a high temperature is superior. In addition, when the total acid number is 0.2 mgKOH/g or less, an increase in viscosity and corrosion of watch parts can be prevented without any change in consumed current, and hence, the first lubricating oil composition is preferably used as a watch lubricating oil.

The first lubricating oil composition is preferably used particularly as a lubricating oil for a watch having metal parts.

Second Lubricating Oil Composition

A second lubricating oil composition includes a paraffinic hydrocarbon oil (F) as a base oil and the viscosity index improver (B), and also includes, if needed, an anti-wear agent (C), a metal deactivator (D), and an antioxidant (E).

[Paraffinic Hydrocarbon Oil (F)]

The paraffinic hydrocarbon oil (F) used as a base oil of the second lubricating oil composition is formed of an α-olefin polymer having 30 carbon atoms or more and preferably 30 to 50 carbon atoms.

The α-olefin polymer having 30 carbon atoms or more is a polymer or a copolymer which is formed of at least one type selected from ethylene and an α-olefin having 3 to 18 carbon atoms and which has 30 carbon atoms or more in total, and in particular, for example, a trimer of 1-decene, a trimer of 1-undecene, a trimer of 1-dodecen, a trimer of 1-tridecene, a trimer of 1-tetradecene, and a copolymer of 1-hexene and 1-pentene may be mentioned.

As the paraffinic hydrocarbon oil (F), a paraffinic hydrocarbon oil having 30 carbon atoms or more and a kinematic viscosity of 1,500 cSt or less at −30° C. is preferable.

[Viscosity Index Improver (B)]

The viscosity index improver (B) used for the second lubricating oil composition is usually at least one type of compound selected from a polyacrylate, a polymethacrylate, a polyisobutylene, a poly(alkyl styrene), a polyester, isobutylene fumarate, styrene maleate ester, vinyl acetate fumarate ester, and an α-olefin copolymer. Among these compounds mentioned above, a polyisobutylene is preferable.

As particular examples of the poly(alkyl styrene), the polyester, and the α-olefin copolymer, there may be mentioned the same compounds as those described in the column of the viscosity index improver (B) used for the first lubricating oil composition.

The viscosity index improver (B) may be used alone, or at least two types thereof may also be used in combination.

In the present invention, with respect to 100 percent by weight of the lubricating oil composition, 0.1 to 15 percent by weight, preferably 0.1 to 15 percent by weight, and more preferably 0.1 to 10 percent by weight of the viscosity index improver (B) is used. If the viscosity index improver (B) is used at a ratio in the above range, the change in viscosity of the paraffinic hydrocarbon oil (F) with the change in temperature can be reduced, and a watch can be properly operated.

[Anti-Wear Agent (C)]

The anti-wear agent (C) used, if needed, for the second lubricating oil composition is usually a neutral phosphoric ester and/or a neutral phosphorous ester.

As particular examples of the neutral phosphoric ester and the neutral phosphorous ester, there may be mentioned the same compounds as those described in the column of the anti-wear agent (C) used for the first lubricating oil composition.

The anti-wear agent (C) may be used alone, or at least two types thereof may also be used in combination.

In the present invention, with respect to 100 percent by weight of the lubricating oil composition, 0.1 to 8 percent by weight, preferably 0.1 to 5 percent by weight, and more preferably 0.5 to 1.5 percent by weight of the anti-wear agent (C) is used. When the anti-wear agent (C) is used at a ratio in the above range, the wear resistance can be improved.

When the second lubricating oil composition is used for a watch using metal parts besides plastic parts, such as Watch Movement™ (No. 7680, No. 1030: manufactured by Citizen Watch Co., Ltd., plastic and metal gears are used for the wheel row section), in order to prevent the metal parts from being worn, the anti-wear agent (C) is preferably added.

[Metal Deactivator (D)]

As the metal deactivator (D) used, if needed, for the second lubricating oil composition, benzotriazole or its derivative is preferable.

As particular examples of the benzotriazole derivative, there may be mentioned the same compounds as those described in the column of the metal deactivator (D) used, if needed, for the first lubricating oil composition.

The metal deactivator (D) may be used alone, or at least two types thereof may also be used in combination.

In the present invention, with respect to 100 percent by weight of the lubricating oil composition, 0.01 to 3 percent by weight, preferably 0.02 to 1 percent by weight, and more preferably 0.03 to 0.06 percent by weight of the metal deactivator (D) is used. When the metal deactivator (D) is used at a ratio in the above range, corrosion of metal, such as copper, can be effectively prevented.

When the second lubricating oil composition is used for a watch using metal parts besides plastic parts, such as the above Watch Movement™ (No. 7680, No. 1030), the metal parts also should not be changed as the case of a lubricant oil base oil. In this case, the metal deactivator (D) is preferably added.

[Antioxidant (E)]

The antioxidant (E) used, if needed, for the second lubricating oil composition is usually a phenol-based antioxidant and/or an amine-based antioxidant.

As particular examples of the phenol-based antioxidant and the amine-based antioxidant, there may be mentioned the same compounds as those described in the column of the antioxidant (E) used, if needed, for the first lubricating oil composition.

The antioxidant (E) may be used alone, or at least two types thereof may also be used in combination.

In the present invention, with respect to 100 percent by weight of the lubricating oil composition, preferably 0.1 to 3 percent by weight, more preferably 0.01 to 2 percent by weight, and even more preferably 0.03 to 1.20 percent by weight of the antioxidant (E) is used. When the antioxidant (E) is used at a ratio in the above range, the lubricating oil composition can be prevented from being deteriorated over a long period of time.

In a watch module used for a long period of time, the lubricating oil composition to be used must be prevented from being oxidized so as not to be deteriorated over a long period of time. Hence, in order to stabilize the second lubricating oil composition over a long period of time without oxidation thereof, the antioxidant (E) is preferably added.

[Second Lubricating Oil Composition]

The second lubricating oil composition preferably has a kinematic viscosity of 13 to 1,500 cSt at a temperature of from −30° C. to 80° C. If a lubricating oil composition having a kinematic viscosity in the range described above is used for Watch Movement™ (No. 7630) manufactured by Citizen Co., Ltd. in which the wheel row section is made of a plastic, the watch can be properly operated. In particular, it is preferable that the kinematic viscosity at a temperature of from −30° C. to 80° C. be 13 to 1,500 cSt and the change in weight obtained when the second oil composition is allowed to stand at 90° C. for 1,000 hours be 10 percent by weight or less. If a lubricating oil composition having a kinematic viscosity and a change in weight in the ranges described above is used, the watch can be properly operated in a temperature range of −30° C. to 80° C.

The second lubricating oil composition including the anti-wear agent (C) and the metal deactivator (D) is preferable as a lubricating oil for a watch using metal parts besides plastic parts (such as gears).

Third Lubricating Oil Composition

The third lubricating oil composition includes an ether oil (G) as a base oil, an anti-wear agent (C), and an antioxidant (E).

[Ether Oil]

As the ether oil (G) used for the third lubricating oil composition, an ether oil represented by the following general formula is preferable.

$$R^1—(—O—R^2—)_n—R^1$$

In the formula, $R^1$ each independently represents an alkyl group having 1 to 18 carbon atoms or a monovalent aromatic hydrocarbon group having 6 to 18 carbon atoms, and $R^2$ represents an alkylene group having 1 to 18 carbon atoms or a divalent aromatic hydrocarbon group having 6 to 18 carbon atoms, and n is 0 or an integer of 1 to 5.

As $R^1$ representing an alkyl group having 1 to 18 carbon atoms, in particular, for example, there may be mentioned a methyl group, an ethyl group, a propyl group, an isopropyl group, an n-butyl group, an isobutyl group, a sec-butyl group, a t-butyl group, an n-pentyl group, an isopentyl group, a t-pentyl group, a neopentyl group, a hexyl group, an isohexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, or an octadecyl group.

As $R^2$ representing a monovalent aromatic hydrocarbon group having 6 to 18 carbon atoms, for example, there may be mentioned a phenyl group, a tolyl group, a xylyl group, a benzyl group, a phenethyl group, a 1-phenylethyl group, or a 1-methyl-1-phenylethyl group.

In particular, as $R^2$ representing an alkylene group having 1 to 18 carbon atoms, for example, there may be mentioned a methylene group, an ethylene group, a propylene group, or a butylene group.

In particular, as $R^2$ representing a divalent aromatic hydrocarbon group having 6 to 18 carbon atoms, for example, there may be mentioned a phenylene group or 1,2-naphthylene group.

Since the ether oil represented by the above formula has no hydroxyl groups at molecular ends, excellent moisture absorption resistance can be obtained.

[Anti-Wear Agent (C)]

The anti-wear agent (C) used for the third lubricating oil composition is usually a neutral phosphoric ester and/or a neutral phosphorous ester.

As particular examples of the neutral phosphoric ester and the neutral phosphorous ester, there may be mentioned the same compounds as those described in the column of the anti-wear agent (C)) used for the first lubricating oil composition.

The anti-wear agent (C) may be used alone, or at least two types thereof may also be used in combination.

In the present invention, with respect to 100 percent by weight of the lubricating oil composition, preferably 0.1 to 8 percent by weight, more preferably 0.1 to 5 percent by weight, and even more preferably 0.5 to 1.5 percent by weight of the anti-wear agent (C) is used. When the anti-wear agent (C) is used at a ratio in the above range, the wear resistance can be improved.

When the third lubricating oil composition is used for a watch using metal parts besides plastic parts, such as Watch Movement™ (No. 7680, No. 1030: manufactured by Citizen Watch Co., Ltd., plastic and metal gears are used for the wheel row section), in order to prevent wear of the metal parts, the anti-wear agent (C) is preferably added.

[Antioxidant (E)]

The antioxidant (E) used, if needed, for the third lubricating oil composition is usually a phenol-based antioxidant and/or an amine-based antioxidant.

As particular examples of the phenol-based antioxidant and the amine-based antioxidant, there may be mentioned the same compounds as those described in the column of the antioxidant (E) used, if needed, for the first lubricating oil composition.

The antioxidant (E) may be used alone, or at least two types thereof may also be used in combination.

In the present invention, with respect to 100 percent by weight of the lubricating oil composition, preferably 0.01 to 2 percent by weight and more preferably 0.03 to 1.2 percent by weight of the antioxidant (E) is used. When the antioxidant (E) is used at a ratio in the above range, the lubricating oil composition can be prevented from being deteriorated over a long period of time.

[Third Lubricating Oil Composition]

The third lubricating oil composition preferably has a total acid number of 0.2 mgKOH/g or less. When a lubricating oil composition having a total acid number of 0.2 mgKOH/g or less is used as a watch lubricating oil, an increase in viscosity of the lubricating oil composition and corrosion of watch members can be prevented without any change in consumed current.

The third lubricating oil composition is a suitable lubricating oil for a watch having a wheel row section made of plastic parts and a watch having a wheel row section made of metal parts. In particular, the third lubricating oil composition is a suitable lubricating oil for a watch having a wheel row section made of metal parts.

In addition, as a conventional lubricant, for example, a lubricating oil composition disclosed in Japanese Unexamined Patent Application Publication No. 2001-303088 as an adhering oil is also suitably used.

The adhering oil (lubricating oil composition) includes as a base oil at least a polyol ester or a paraffinic hydrocarbon oil having 30 carbon atoms or more and has a viscosity of 200 to 400 mPa·s.

In addition, it is preferable that the adhering oil include as a base oil at least a polyol ester or a paraffinic hydrocarbon oil having 30 carbon atoms or more, further include at least a metal deactivator and 0.1 to 8 percent by weight of an anti-wear agent, which are mixed with the base oil, and have a viscosity of 200 to 400 mPa·s.

In addition, it is preferable that the adhering oil include as a base oil at least a polyol ester or a paraffinic hydrocarbon oil having 30 carbon atoms or more, further include at least a metal deactivator and 0.1 to 8 percent by weight of an anti-wear agent, which are mixed with the base oil, and have a viscosity of 200 to 400 mPa·s, a change in weight of 1.62 percent by weight or less, which is obtained when the adhering oil is allowed to stand at 90° C. for 1,000 hours, and a total acid number of 0.2 mgKOH/g or less.

The anti-wear agent as an additive to the adhering oil is preferable a neutral phosphoric ester or a neutral phosphorous ester.

The metal deactivator is preferably a benzotriazole derivative.

In addition, the antioxidant may be added and is preferably a phenol-based or an amine-based antioxidant. Furthermore, the amine-based antioxidant is preferably a diphenylamine derivative.

Hereinafter, the adhering oil (lubricating oil composition) will be described in more detail.

The adhering oil used for the present invention is required to have a viscosity of 200 to 400 mPa·s. When the viscosity of the base oil does not reach a target viscosity, a known viscosity improver may be used, and/or at least two types of oils may also be mixed together. The above results are values measured at 20° C.

As a synthetic oil candidate, for example, an ester oil, a paraffinic hydrocarbon oil (PAO), or a silicone oil may be mentioned, and a conventional ether, glycol, or the like may also be mentioned. If a conventional oil or the like is used, since it has moisture absorption properties, the humidity resistance is degraded. When a silicone oil is used, because of its low solubility to dissolve additives besides its poor lubricity, improvement in lubricity is limited to a certain level.

In addition, the oil as described above flows on a metal surface. Although a PAO is stable to a plastic material for a watch and is suitably used as a watch lubricating oil, a low molecular weight PAO has inferior evaporation properties, and hence, a PAO having 30 carbon atoms or more is preferable. Since an ester oil used as a base oil has its own lubricity and high solubility, generation of sludge can be suppressed, and hence the amount of additives can be decreased. In addition, the ester oil is advantageously used since the addition amount of a viscosity index improver, which enables an oil having sufficient low temperature properties to be used at a high temperature, can be increased.

As a metal material for a watch, for example, copper, brass containing zinc, nickel, and iron may be mentioned, and as a plastic material for a watch, for example, POM, PC, PS, and PPE may be mentioned. When coming into contact with the materials mentioned above, a watch oil must not corrode or swell the watch materials and must not generate sludge.

In addition, since a watch must perform lubrication for a long period of time by a predetermined amount of oil, the evaporation loss thereof must be small. In addition, since a metal must not be remarkably worn out during use, an anti-wear agent must be added; however, an anti-wear agent to be added is preferably non-corrosive. Although the addition amount of the anti-wear agent must be at a minimum level or more at which the addition effect can be obtained, it cannot be expected to improve the effect by excessive addition, and hence, an appropriate amount is preferably added. Since the total acid number is a value obtained by quantitative measurement of the amount of an acidic component of a lubricating oil, the number must be controlled to a value at which a metal is not corroded or less. Since metal corrosion must be prevented over a long period of time when a lubricating oil is used for a watch, the total acid number must be controlled to a present value of 1.24 mgKOH/g or less.

In addition, in order to maintain the quality over a long period of time, it is preferable to add a metal deactivator for stabilizing a metal and an antioxidant for preventing oxidation degradation of oil. As the metal deactivator, in this embodiment, a benzotriazole derivative may be used, and as the antioxidant, a phenol-based antioxidant and an amine-based antioxidant, such as a diphenylamine derivative, may be used. In addition, although finished articles of watches can be obtained by combination of exterior parts and modules, since the modules themselves are also to be sold on the market besides the finished articles of watches, the modules must be stable to humidity as well as to temperature.

A watch according to the present invention has sliding portions (sliding portions made of gears and a bottom plate) processed by a surface-treating agent obtained from a fluorine type surfactant and a phosphoric ester having a hydrocarbon group in which a part or all of hydrogen atoms have been substituted with a fluorine atom and a lubricating oil composition including, besides a base oil containing the polyol ester (A), at least 0.1 to 20 percent by weight of the viscosity index improvers (B) and 0.1 to 8 percent by weight of the anti-wear agent (C).

In addition, a watch according to the present invention may be a watch having at least one sliding portion processed by a surface-treating agent obtained from a fluorine type surfactant and a phosphoric ester having a hydrocarbon group in which a part or all of hydrogen atoms have been substituted with a fluorine atom and a lubricating oil composition including, besides a base oil containing the paraffinic hydrocarbon oil (F) having 30 carbon atoms or more, at least 0.1 to 15 percent by weight of the viscosity index improvers (B);

a watch having at least one sliding portion processed by a surface-treating agent obtained from a fluorine type surfactant and a phosphoric ester having a hydrocarbon group in which a part or all of hydrogen atoms have been substituted with a fluorine atom and a lubricating oil composition including, besides a base oil containing the ether oil (G), at least the anti-wear agent (C) and the antioxidant (E), the anti-wear agent (C) being a neutral phosphoric ester and/or a neutral phosphorous ester, and the content thereof being 0.1 to 8 percent by weight; or a watch having at least one sliding portion processed by a surface-treating agent obtained from a fluorine type surfactant and a phosphoric ester having a hydrocarbon group in which a part or all of hydrogen atoms have been substituted with a fluorine atom and a lubricating oil composition including as a base oil, at least a polyol ester or a paraffinic hydrocarbon oil having 30 carbon atoms or more and having a viscosity of 200 to 400 mPa·s at 20° C.

Hereinafter, although the present invention will be described in more particular with reference to examples, the present invention is not limited thereto.

EXAMPLES

Lubricant (1)

Example A1-1

As a base oil, there were prepared a trimethylolpropane valerate heptanoate mixed ester (B1) (kinematic viscosity at 100° C.: approximately 3.0 cSt) and a polymer (B2) (kinematic viscosity at 40° C.: approximately 5.0 cSt) which was obtained by polymerization of 1-nonene, 1-decene, 1-undecene, and 1-dodecen and which had 20 to 30 carbon atoms in total in the polymer. These base oils were refined oils. In addition, in the following examples, refined base oils were used unless otherwise particularly noted.

As an anti-wear agent, trioleyl phosphate (TOP), trixylenyl phosphate (TXP), trioleyl phosphite (TOP2), and trixylenyl phosphite (TXP2) were prepared. These anti-wear agents were each a reagent grade agent. In addition, in the following examples, reagent grade anti-wear agents were used unless otherwise particularly noted.

A lubricant (1) was obtained by mixing the components in amounts shown in Table A1-1.

Next, an actuator (housings, a rotor, and gears made of brass were used) was formed (see FIGS. 1 and 2) in which the lubricant (1) was supplied to sliding portions formed by the rotor, sliding portions formed by a first torque increasing gear, sliding portions formed by a second torque increasing gear, and sliding portions formed by an output gear.

In particular, the lubricant (1) was supplied as described below. In the housing 2*a*, the lubricant (1) was supplied in the holes into which the rotor 12, the first torque increasing gear 6, the second torque increasing gear 8, and the output gear 10 were to be inserted. Subsequently, the rotor 12, the first torque increasing gear 6, the second torque increasing gear 8, and the output gear 10 were inserted in the housing 2*a*, and the housing 2*b* was fitted thereto so as to sandwich the rotor 12, the first torque increasing gear 6, the second torque increasing gear 8, and the output gear 10 therebetween. Finally, from above the housing 2*b*, the lubricant (1) was supplied in the holes into which the rotor 12, the first torque increasing gear 6, the second torque increasing gear 8, and the output gear 10 were inserted.

A camera module was connected to the actuator supplied with the lubricant (1). This camera module was reciprocated at 80° C. for 100 hours. Since the camera module had no zoom function and was smaller than a camera module mounted in a usual cellular phone, loads applied to the rotor and the gears were small. As in the case described above, the camera module was also reciprocated at −40° C. for 100 hours.

Examples A1-2 to A1-6, Comparative Examples A1-1 to A1-3

Except that the lubricant (1) was obtained by mixing the components in amounts shown in Table A1-1, an actuator was assembled in a manner similar to that of Example A1-1 and was reciprocated at 80° C. and −40° C. for 100 hours.

[Evaluation of Wear Resistance and Durability]

Evaluation of the wear resistance and the durability at a high temperature was performed by observing the operation property and the state of wear after 100 hours from the start of the reciprocation. The actuator was disassembled, and the sliding portions to which the lubricant (1) was supplied were observed to evaluate the state of wear. The results are shown in Table A1-1. Reference numerals of Table A1-1 indicate the following.

A1: The operation property was good even after 100 hours from the start, and no wear was observed at the sliding portion.

A2: The operation property was good even after 100 hours from the start, and slight wear was observed at the sliding portion.

A3: The operation property was good even after 100 hours from the start, and wear observed at the sliding portion was more than that of A2.

B1: The operation property was inferior although the operation was performed even after 100 hours from the start, and the sliding portion was severely worn.

Evaluation of the wear resistance and the durability at a low temperature was performed by observing the operation property and the state of wear after 100 hours from the start of the reciprocation. The actuator was disassembled, and the sliding portions to which the lubricant (1) was supplied were observed to evaluate the state of wear. The results are shown in Table A1-1. Reference numerals of Table A1-1 indicate the following.

A1: The operation property was good even after 100 hours from the start, and no wear was observed at the sliding portion.

A1*: The operation property was slightly inferior after 100 hours from the start to that of A1, and no wear was observed at the sliding portion.

A2: The operation property was good even after 100 hours from the start, and slight wear was observed at the sliding portion.

A3: The operation property was good even after 100 hours from the start, and wear observed at the sliding portion was more than that of A2.

B1: The operation property was inferior although the operation was performed even after 100 hours from the start, and the sliding portion was severely worn.

B2: The viscosity of the lubricant (1) was too high, and no reciprocation could be performed.

In addition, the change in weight obtained when the lubricant (1) formed in each of Examples A1-1 to A1-6 was allowed to stand at 90° C. was 0.05 percent by mass or less, and the total acid number was 0.03 to 0.1 mgKOH/g or less.

TABLE A1-1

| | | COMPARATIVE EXAMPLE A1-1 | COMPARATIVE-EXAMPLE A1-2 | EXAMPLE A1-1 | EXAMPLE A1-2 | EXAMPLE A1-3 | EXAMPLE A1-4 | EXAMPLE A1-5 | EXAMPLE A1-6 | COMPARATIVE EXAMPLE A1-3 |
|---|---|---|---|---|---|---|---|---|---|---|
| BASE OIL | B1 (PARTS BY MASS) | 40 | 83 | 50 | 40 | 0 | 7 | 0 | 99.5 | 0 |
| | B2 (PARTS BY MASS) | 40 | 0 | 35 | 50 | 95 | 90 | 99 | 0 | 99.95 |
| | TOTAL (PARTS BY MASS) | 80 | 83 | 85 | 90 | 95 | 97 | 99 | 99.5 | 99.95 |
| ANTI-WEAR AGENT | TOP (PARTS BY MASS) | 0 | 7 | 5 | 10 | 0 | 0 | 0 | 0 | 0 |
| | TXP (PARTS BY MASS) | 0 | 0 | 5 | 0 | 0 | 0 | 0 | 0 | 0 |
| | TOP2 (PARTS BY MASS) | 10 | 5 | 0 | 0 | 5 | 3 | 0 | 0 | 0 |
| | TOP2 PARTS BY MASS) | 10 | 5 | 5 | 0 | 0 | 0 | 1 | 0.5 | 0.05 |
| | TOTAL (PARTS BY MASS) | 20 | 17 | 15 | 10 | 5 | 3 | 1 | 0.5 | 0.05 |
| EVALUATION | HIGH TEMPERATURE | A1 | A1 | A1 | A1 | A1 | A1 | A2 | A3 | B1 |
| | LOW TEMPERATURE | B2 | B2 | A1* | A1* | A1 | A1 | A2 | A3 | B1 |

Example A1-7

The lubricant (1) was obtained by mixing 96 parts by mass of the trimethylolpropane valerate heptanoate mixed ester (B1) (kinematic viscosity at 100° C.: approximately 3.0 cSt) as a base oil and as an anti-wear agent, 4 parts by mass of a neutral phosphoric ester represented by the formula (1) ($R^1$, $R^2$, and $R^3$ each represented an oleyl group) (see Table A1-2).

Next, in a manner similar to that of Example A1-1, an actuator was formed (see FIGS. 1 and 2) in which the lubricant (1) was supplied to the sliding portions formed by the rotor, the sliding portions formed by the first torque increasing gear, the sliding portions formed by the second torque increasing gear, and the sliding portions formed by the output gear.

A camera module was connected to the actuator supplied with the lubricant (1) and was reciprocated at −40° C. for 100 hours. The same camera module as that used in Example A1-1 was used.

Examples A1-8 to A1-14

Except that the lubricant (1) was obtained by mixing the components in amounts shown in Table A1-2, an actuator was assembled in a manner similar to that of Example A1-7 and was reciprocated at −40° C. for 100 hours.

[Evaluation of Wear Resistance and Durability]

Evaluation of the wear resistance and the durability at a low temperature was performed by observing the operation property and the state of wear after 100 hours from the start of the reciprocation. The actuator was disassembled, and the sliding portions to which the lubricant (1) was supplied were observed to evaluate the state of wear. The results are shown in Table A1-2. Reference numerals of Table A1-2 indicate the following.

A1: The operation property was good even after 100 hours from the start, and no wear was observed at the sliding portion.

A2: The operation property was good even after 100 hours from the start, and slight wear was observed at the sliding portion.

In Example A1-7 to A1-14, except that instead of using the trimethylolpropane valerate heptanoate mixed ester (B1) (kinematic viscosity at 100° C.: approximately 3.0 cSt), as a base oil, the polymer (B2) (kinematic viscosity at 40° C.: approximately 5.0 cSt) formed by polymerizing 1-nonene, 1-decene, 1-undecene, and 1-dodecen, and having 20 to 30 carbon atoms in total in the polymer was used, an actuator was formed in a manner similar to that described above and was reciprocated. In this case, the evaluation results of the wear resistance and the durability were also the same as those of Example A1-7 to A1-14.

Furthermore, in Examples A1-7 to A1-14, except that instead of using the neutral phosphoric ester represented by the formula (1) as an anti-wear agent, a neutral phosphorous ester represented by the formula (2) ($R^4$, $R^5$ and an $R^6$ each represented an oleyl group, a stearyl group, a tridecyl group, a lauryl group, a 2-ethylhexyl group, an ethyl group, a nonylphenyl group, or a cresyl group) was used, an actuator was formed in a manner similar to that described above and was reciprocated. In this case, the evaluation results of the wear resistance and the durability were also the same as those of Examples A1-7 to A1-14.

In addition, the change in weight obtained when a lubricant (2) formed in each of Examples A1-7 to A1-14 was allowed to stand at 90° C. was 0.05 percent by mass or less, and the total acid number was 0.03 to 0.1 mgKOH/g or less.

TABLE A1-2

| | EXAMPLE A1-7 | EXAMPLE A1-8 | EXAMPLE A1-9 | EXAMPLE A1-10 | EXAMPLE A1-11 | EXAMPLE A1-12 | EXAMPLE A1-13 | EXAMPLE A1-14 |
|---|---|---|---|---|---|---|---|---|
| $R^1$~$R^3$ | OLEYL GROUP | STEARYL GROUP | TRIDECYL GROUP | LAURYL GROUP | 2-ETHYLHEXYL GROUP | ETHYL GROUP | NONYLPHENYL GROUP | CRESYL GROUP |
| EVALUATION | A1 | A1 | A1 | A1 | A2 | A2 | A1 | A1 |

Example A1-15

As a base oil, trimethylolpropane valerate heptanoate mixed esters having different molecular weights and polymers having different molecular weights obtained by polymerizing 1-nonene, 1-decene, 1-undecene, and 1-dodecen were prepared. The lubricant (1) was obtained by mixing 96 parts by mass of a mixture of base oils appropriately selected from those mentioned above and 4 parts by mass of trioleyl phosphate (TOP) as an anti-wear agent. When this lubricant (1) was allowed to stand at 90° C., the change in weight thereof was 2.0 percent by mass.

Next, in a manner similar to that of Example A1-1, an actuator was formed (see FIGS. 1 and 2) in which the lubricant (1) was supplied to the sliding portions formed by the rotor, the sliding portions formed by the first torque increasing gear, the sliding portions formed by the second torque increasing gear, and the sliding portions formed by the output gear.

A camera module was connected to the actuator supplied with the lubricant (1) and was reciprocated at 80° C. for 100 hours in order to perform an accelerated test of the operation. The same camera module as that used in Example A1-1 was used.

Example A1-16 to A1-21

Except that the lubricant (1) was used which had a change in weight shown in Table A1-3 after allowed to stand at 90° C., an actuator was assembled in a manner similar to that of Example A1-15 and was reciprocated at 80° C. for 100 hours in order to perform the accelerated test of the operation. In addition, the change in weight obtained when the lubricant was held at 90° C. was adjusted by the types of base oils to be used and a mixing ratio therebetween.

[Accelerated Test of Operation]

The accelerated test of the operation was evaluated based on how many hours the operation was able to be performed from the start of the reciprocation. The results are shown in Table A1-3. Reference numerals of Table A1-3 indicate the following.

A1: The operation was well performed even after the test was performed for 80 hours.

A2: The operation was stopped when the test was performed for between 60 hours and less than 80 hours.

A3: The operation was stopped when the test was performed for between 50 hours and less than 60 hours.

A4: The operation was stopped before the test was performed for 30 hours.

In addition, in Examples A1-15 to A1-21, except that trioleyl phosphite (TOP2) was used as an anti-wear agent instead of using trioleyl phosphate (TOP), an actuator was formed in a manner similar to that described above and was reciprocated. In this case, the results of the accelerated test of the operation were also the same as those of Examples A1-15 to A1-21.

TABLE A1-3

| | EXAMPLE A1-15 | EXAMPLE A1-16 | EXAMPLE A1-17 | EXAMPLE A1-18 | EXAMPLE A1-19 | EXAMPLE A1-20 | EXAMPLE A1-21 |
|---|---|---|---|---|---|---|---|
| CHANGE IN WEIGHT OF LUBRICANT WHEN HELD AT 90° C. (PERCENT BY MASS) | 2.0 | 1.62 | 1.3 | 1.0 | 0.8 | 0.5 | 0.3 |
| EVALUATION | A4 | A3 | A3 | A2 | A2 | A1 | A1 |

Example A1-22

As a base oil, a trimethylolpropane valerate heptanoate mixed ester and a polymer obtained by polymerizing 1-nonene, 1-decene, 1-undecene, and 1-dodecen were prepared. For each of these base oils, a refined base oil and a non-refined base oil were both prepared. For trioleyl phosphate (TOP) used as an anti-wear agent, a reagent grade agent and an agent having a low purity were both prepared. In addition, the lubricant (1) was obtained by mixing 96 parts by mass of a base-oil mixture of base oils appropriately selected from those mentioned above and 4 parts by mass of trioleyl phosphate (TOP) appropriately selected from the above anti-wear agents. In this lubricant (1), the total acid number was 1.5 mgKOH/g.

Next, in a manner similar to that of Example A1-1, an actuator was formed (see FIGS. 1 and 2) in which the lubricant (1) was supplied to the sliding portions formed by the rotor, the sliding portions formed by first torque increasing gear, the sliding portions formed by the second torque increasing gear, and the sliding portions formed by the output gear.

A camera module was connected to the actuator supplied with the lubricant (1). The same camera module as that used in Example A1-1 was used. After being held for 1,000 hours, this camera module was reciprocated at 80° C. in order to perform the accelerated test of the operation.

Examples A1-23 to A1-26

Except that the lubricant (1) having a total acid number shown in Table A1-4 was used, an actuator was assembled in a manner similar to that of Example A1-22 and was reciprocated at 80° C. In addition, the total acid number was adjusted by the types of base oils to be used and the types of anti-wear agents to be used.

[Evaluation of Silence Property]

The silence property was evaluated by the loudness of sound generated during the reciprocation. The results are shown in Table A1-4. Reference numerals of Table A1-4 indicate the following.

A1: No sound was generated during the operation.

A2: Slight sound was generated during the operation.

A3: Loud sound was generated during the operation.

In addition, in Examples A1-22 to A1-26, except that trioleyl phosphite (TOP2) was used as an anti-wear agent instead of using trioleyl phosphate (TOP), an actuator was formed in a manner similar to that described above and was reciprocated. In this case, the evaluation results of the silence property are also the same as those of Example A1-22 to A1-26.

TABLE 4

Table A1-4

| | EXAMPLE A1-22 | EXAMPLE A1-23 | EXAMPLE A1-24 | EXAMPLE A1-25 | EXAMPLE A1-26 |
|---|---|---|---|---|---|
| TOTAL ACID NUMBER (mgKOH/g) | 1.5 | 0.2 | 0.15 | 0.1 | 0.03 |
| EVALUATION | A3 | A2 | A2 | A1 | A1 |

Example A1-27

As a base oil, a polymer obtained by polymerizing 1-butene, 1-pentene, 1-hexene, 1-heptene, 1-octene, 1-nonene, 1-decene, 1-undecene, and 1-dodecen was prepared. From this base oil mixture, a polymer having more than 36 carbon atoms was obtained by classification. The lubricant (1) was obtained by mixing 96 parts by mass of this base oil and 4 parts by mass of trioleyl phosphate (TOP) as an anti-wear agent.

Next, in a manner similar to that of Example A1-1, an actuator was formed (see FIGS. 1 and 2) in which the lubricant (1) was supplied to the sliding portions formed by the rotor, the sliding portions formed by the first torque increasing gear, the sliding portions formed by the second torque increasing gear, and the sliding portions formed by the output gear.

A camera module was connected to the actuator supplied with the lubricant (1) and was reciprocated at 80° C. in order to perform the accelerated test of the operation. The same camera module as that used in Example A1-1 was used.

Examples A1-28 to A1-30

From the above base oil mixture, a polymer having 15 to 35 carbon atoms, a polymer having 20 to 30 carbon atoms, and a polymers having less than 14 carbon atoms were obtained by classification. Except that each of the polymers shown in Table A1-5 was used, an actuator was assembled in a manner similar to that of Example A1-27 and was reciprocated at 80° C.

[Accelerated Test of Operation]

The accelerated test of the operation was evaluated based on how many hours the operation was able to be performed from the start of the reciprocation. The results are shown in Table A1-5. Reference numerals of Table A1-5 indicate the following.

A1: The operation was well performed even after the test was performed for 80 hours.

A2: The operation was stopped when the test was performed for between 60 hours and less than 80 hours.

A3: The operation was stopped before the test was performed for one hour.

B: Since the viscosity of the lubricant (1) was too high, although the reciprocation was started, the operation thereof could not be well performed.

In addition, in Examples A1-27 to A1-30, except that trioleyl phosphite (TOP2) was used as an anti-wear agent instead of using trioleyl phosphate (TOP), an actuator was formed in a manner similar to that described above and was reciprocated. In this case, the results of the accelerated test of the operation were also the same as those of Examples A1-27 to A1-30.

TABLE 5

Table A1-5

| | EXAMPLE A1-27 | EXAMPLE A1-28 | EXAMPLE A1-29 | EXAMPLE A1-30 |
|---|---|---|---|---|
| NUMBER OF CARBON ATOMS | 36 OR MORE | 15~35 | 20~30 | LESS THAN 14 |
| EVALUATION | B | A2 | A1 | A3 |

Example A1-31

The lubricant (1) was obtained by mixing 96 parts by mass of the trimethylolpropane valerate heptanoate mixed ester (B) (kinematic viscosity at 100° C.: approximately 3.0 cSt) as a base oil and 4 parts by mass of trioleyl phosphate (TOP) as an anti-wear resistance.

Next, in a manner similar to that of Example A1-1, an actuator was formed (see FIGS. 1 and 2) in which the lubricant (1) was supplied to the sliding portions formed by the rotor, the sliding portions formed by the first torque increasing gear, the sliding portions formed by the second torque increasing gear, and the sliding portions formed by the output gear.

A camera module was connected to the actuator supplied with the lubricant (1). This actuator was stored at 90° C. and 80 RH for 1,000 hours. Subsequently, the camera module was reciprocated at 80° C. The same camera module as that used in Example A1-1 was used.

Examples A1-32 to A1-38

Except that the lubricant (1) including benzotriazole in an amount shown in Table A1-6 was used, an actuator was assembled in a manner similar to that of Example A1-31 and was stored at 90° C. and 80 RH for 1,000 hours. Subsequently, the camera module was reciprocated at 80° C.

[Occurrence of Tarnish]

The actuator stored at 90° C. and 80 RH for 1,000 was disassembled, and the occurrence of tarnish of the sliding portions to which the lubricant (1) was supplied was observed. The results are shown in Table A1-6. Reference numerals of Table A1-6 indicate the following.

A1: No tarnish was observed.

A2: Slight tarnish occurred.

A3: More tarnish than that of A2 occurred.

B: Tarnish occurred.

[Accelerated Test of Operation]

The accelerated test of the operation was evaluated based on how many hours the operation was able to be performed from the start of the reciprocation. The results are shown in Table A1-6. Reference numerals of Table A1-6 indicate the following.

A1: The operation was well performed even after the test was performed for 80 hours.

A2: The operation was stopped when the test was performed for between 60 hours and less than 80 hours.

B: Since the viscosity of the lubricant (1) was too high, although the reciprocation was started, the operation thereof could not be well performed.

TABLE 6

Table A1-6

| | EXAMPLE A1-31 | EXAMPLE A1-32 | EXAMPLE A1-33 | EXAMPLE A1-34 | EXAMPLE A1-35 | EXAMPLE A1-36 | EXAMPLE A1-37 | EXAMPLE A1-38 |
|---|---|---|---|---|---|---|---|---|
| METAL DEACTIVATOR (PARTS BY MASS) | 0 | 0.01 | 0.02 | 0.03 | 0.06 | 1 | 3 | 5 |
| TARNISH | B | A3 | A2 | A1 | A1 | A1 | A1 | A1 |
| OPERATION PROPERTY | A1 | A1 | A1 | A1 | A1 | A2 | A2 | B |
| COMPREHENSIVE EVALUATION | B | A3 | A2 | A1 | A1 | A2 | A2 | B |

Example A1-39

The lubricant (1) was obtained by mixing 96 parts by mass of the trimethylolpropane valerate heptanoate mixed ester (B1) (kinematic viscosity at 100° C.: approximately 3.0 cSt) as a base oil, 4 parts by mass of trioleyl phosphate (TOP) as an anti-wear resistance, and 0.005 parts by mass of a fluorescent agent.

Examples A1-40 to A1-45

Except that the lubricant (1) including the fluorescent agent in an amount shown in Table A1-7 was used, the lubricant (1) was obtained in a manner similar to that of Example A1-39.

[UV Light Irradiation Test]

The lubricant (1) was irradiated with light by a handy UV light, and it was confirmed whether the lubricant emitted light or not. The results are shown in Table A1-7. Reference numerals of Table A1-7 indicate the following.

A1: Light was emitted with appropriate brightness.

A2: Light was excessively emitted to some extent.

B1: Light was emitted too weakly.

B2: Light was excessively emitted.

TABLE 7

Table A1-7

| | EXAMPLE A1-39 | EXAMPLE A1-40 | EXAMPLE A1-41 | EXAMPLE A1-42 | EXAMPLE A1-43 | EXAMPLE A1-44 | EXAMPLE A1-45 |
|---|---|---|---|---|---|---|---|
| FLUORESCENT AGENT (PARTS BY MASS) | 0.005 | 0.01 | 0.05 | 0.1 | 0.2 | 0.5 | 1.0 |
| EVALUATION | B1 | A2 | A1 | A1 | A1 | A2 | B2 |

Lubricant (2)

Example A2-1-1

As a base oil, there were prepared the trimethylolpropane valerate heptanoate mixed ester (B1) (kinematic viscosity at 100° C.: approximately 3.0 cSt) and the polymer (B2) (kinematic viscosity at 40° C.: approximately 5.0 cSt) which was formed by polymerizing 1-nonene, 1-decene, 1-undecene, and 1-dodecen and which had 20 to 30 carbon atoms in total in the polymer.

As an anti-wear agent, trioleyl phosphate (TOP), trixylenyl phosphate (TXP), trioleyl phosphite (TOP2), and trixylenyl phosphite (TXP2) were prepared.

As polytetrafluoroethylene (PTFE) particles, particles were prepared in which the content of particles having a diameter of 10 μm or less was 100 percent by mass, the content of particles having a diameter of 1 μm or less was 90 percent by mass or more, and the aspect ratio was 0.5.

The lubricant (2) was obtained by mixing the components in amounts shown in Table A2-1-1.

Next, an actuator (housings, a rotor, and gears made of brass were used) was formed (see FIGS. 1 and 2) in which the lubricant (2) was supplied to the sliding portions formed by the second torque increasing gear and the sliding portions formed by the output gear. In addition, since a relatively weak force was applied to the sliding portions formed by the rotor and the sliding portions formed by the first torque increasing gear, the lubricant (1) used in Example A1-3 was supplied thereto.

In particular, the lubricant (1) and the lubricant (2) were supplied as described below. In the housing 2*a*, the lubricant (1) was supplied in the holes into which the rotor 12 and the first torque increasing gear 6 were to be inserted, and the lubricant (2) was supplied in the holes into which the second torque increasing gear 8 and the output gear 10 were to be inserted. Subsequently, the rotor 12, the first torque increasing gear 6, the second torque increasing gear 8, and the output gear 10 were inserted in the housing 2*a*, and the housing 2*b* is fitted thereto so as to sandwich the rotor 12, the first torque increasing gear 6, the second torque increasing gear 8, and the output gear 10 therebetween. Finally, from above the housing 2*b*, the lubricant (1) was supplied in the holes into which the rotor 12 and the first torque increasing gear 6 were inserted, and the lubricant (2) was supplied in the holes into which the second torque increasing gear 8 and the output gear 10 were inserted.

A camera module was connected to the actuator supplied with the lubricant (1) and the lubricant (2). This camera module was reciprocated at 80° C. for 100 hours. As the camera module described above, modules were used in which loads applied to the rotation output shaft 10*a* by the reciprocation were 1.5 times and 2.0 times that of Example A1-1. As in the case described above, the reciprocation was also performed at −40° C. for 100 hours.

Examples A2-1-2 to A2-1-6, Comparative Examples A2-1-1 to A2-1-3

Except that the lubricant (2) was obtained by mixing the components in amounts shown in Table A2-1-1, an actuator was assembled in a manner similar to that of Example A2-1-1 and was reciprocated at 80° C. and −40° C. for 100 hours.

[Evaluation of Wear Resistance and Durability]

(Load=1.5 Times)

Evaluation of the wear resistance and the durability at a high temperature was performed by observing the operation property and the state of wear after 100 hours from the start of the reciprocation. The actuator was disassembled, and the sliding portions to which the lubricant (2) was supplied were observed to evaluate the state of wear. The results are shown in Table A2-1-1. Reference numerals of Table A2-1-1 indicate the following.

A1: The operation property was good even after 100 hours from the start, and no wear was observed at the sliding portion.

A2: The operation property was good even after 100 hours from the start, and slight wear was observed at the sliding portion.

A3: The operation property was good even after 100 hours from the start, and wear observed at the sliding portion was more than that of A2.

B1: The operation property was inferior although the operation was performed even after 100 hours from the start, and the sliding portion was severely worn.

Evaluation of the wear resistance and the durability at a low temperature was performed by observing the operation property and the state of wear after 100 hours from the start of the reciprocation. The actuator was disassembled, and the sliding portions to which the lubricant (2) was supplied were observed to evaluate the state of wear. The results are shown in Table A2-1-1. Reference numerals of Table A2-1-1 indicate the following.

A1: The operation property was good even after 100 hours from the start, and no wear was observed at the sliding portion.

A1*: The operation property after 100 hours from the start was slightly inferior to that of A1, and no wear was observed at the sliding portion.

A2: The operation property was good even after 100 hours from the start, and slight wear was observed at the sliding portion.

A3: The operation property was good even after 100 hours from the start, and wear observed at the sliding portion was more than that of A2.

B1: The operation property was inferior although the operation was performed even after 100 hours from the start, and the sliding portion was severely worn.

B2: The viscosity of the lubricant (2) was too high, and no reciprocation could be performed.

(Load=2 Times)

Evaluation of the wear resistance and the durability at a high and a low temperature was performed by observing the operation property and the state of wear after 100 hours from the start of the reciprocation; however, in all Examples and Comparative Examples, the reciprocation was stopped before 100 hours from the start.

TABLE 8

Table A2-1-1

| | | COMPARATIVE EXAMPLE A2-1-1 | COMPARATIVE EXAMPLE A2-1-2 | EXAMPLE A2-1-1 | EXAMPLE A2-1-2 | EXAMPLE A2-1-3 | EXAMPLE A2-1-4 | EXAMPLE A2-1-5 | EXAMPLE A2-1-6 | COMPARATIVE EXAMPLE A2-1-3 |
|---|---|---|---|---|---|---|---|---|---|---|
| BASE OIL | B1 (PARTS BY MASS) | 40 | 83 | 50 | 40 | 0 | 7 | 0 | 99.5 | 0 |
| | B2 (PARTS BY MASS) | 40 | 0 | 35 | 50 | 95 | 90 | 99 | 0 | 99.95 |
| | TOTAL (PARTS BY MASS) | 80 | 83 | 85 | 90 | 95 | 97 | 99 | 99.5 | 99.95 |
| ANTI-WEAR AGENT | TOP (PARTS BY MASS) | 0 | 7 | 5 | 10 | 0 | 0 | 0 | 0 | 0 |

TABLE 8-continued

Table A2-1-1

| | | COMPARATIVE EXAMPLE A2-1-1 | COMPARATIVE EXAMPLE A2-1-2 | EXAMPLE A2-1-1 | EXAMPLE A2-1-2 | EXAMPLE A2-1-3 | EXAMPLE A2-1-4 | EXAMPLE A2-1-5 | EXAMPLE A2-1-6 | COMPARATIVE EXAMPLE A2-1-3 |
|---|---|---|---|---|---|---|---|---|---|---|
| | TXP (PARTS BY MASS) | 0 | 0 | 5 | 0 | 0 | 0 | 0 | 0 | 0 |
| | TOP2 (PARTS BY MASS) | 10 | 5 | 0 | 0 | 5 | 3 | 0 | 0 | 0 |
| | TOP2 (PARTS BY MASS) | 10 | 5 | 5 | 0 | 0 | 0 | 1 | 0.5 | 0.05 |
| | TOTAL (PARTS BY MASS) | 20 | 17 | 15 | 10 | 5 | 3 | 1 | 0.5 | 0.05 |
| PTFE PARTICLES (PARTS BY MASS) | | 20 | 20 | 20 | 20 | 20 | 20 | 20 | 20 | 20 |
| EVALUATION | LOAD OF 1.5 TIMES HIGH TEMPERATURE | A1 | A1 | A1 | A1 | A1 | A1 | A2 | A3 | B |
| | LOAD OF 1.5 TIMES LOW TEMPERATURE | B | B | A1* | A1* | A1 | A1 | A2 | A3 | B |

Example A2-2-1

The lubricant (2) was obtained by mixing the components in amounts shown in Table A2-2-1.

Next, as in Example A2-1-1, an actuator was formed (see FIGS. 1 and 2) in which the lubricant (2) was supplied to the sliding portions formed by the second torque increasing gear and the sliding portions formed by the output gear. In addition, as in Example A2-1-1, since a relatively weak force was applied to the sliding portions formed by the rotor and the sliding portions formed by the first torque increasing gear, the lubricant (1) used in Example A1-3 was supplied thereto. The lubricant (1) and the lubricant (2) were supplied as described in Example A2-1-1.

A camera module was connected to the actuator supplied with the lubricant (1) and the lubricant (2). This camera module was reciprocated at 80° C. for 100 hours. As the camera module described above, modules were used in which loads applied to the rotation output shaft 10*a* by the reciprocation were 2.0 times and 3.0 times that of Example A1-1. As in the case described above, the reciprocation was also performed at −40° C. for 100 hours.

Example A2-2-2 to A2-2-6, Comparative Example A2-2-1 to A2-2-3

Except that the lubricant (2) was obtained by mixing the components in amounts shown in Table A2-1-1, an actuator was assembled in a manner similar to that of Example A2-2-1 and was reciprocated at 80° C. and −40° C. for 100 hours.

[Evaluation of Wear Resistance and Durability]

(Load=2 times)

Evaluation of the wear resistance and the durability at a high temperature was performed by observing the operation property and the state of wear after 100 hours from the start of the reciprocation. The actuator was disassembled, and the sliding portions to which the lubricant (2) was supplied were observed to evaluate the state of wear. The results are shown in Table A2-2-1. Reference numerals of Table A2-2-1 indicate the following.

A1: The operation property was good even after 100 hours from the start, and no wear was observed at the sliding portion.

A2: The operation property was good even after 100 hours from the start, and slight wear was observed at the sliding portion.

A3: The operation property was good even after 100 hours from the start, and wear observed at the sliding portion was more than that of A2.

B1: The operation property was inferior although the operation was performed even after 100 hours from the start, and the sliding portion was severely worn.

Evaluation of the wear resistance and the durability at a low temperature was performed by observing the operation property and the state of wear after 100 hours from the start of the reciprocation. The actuator was disassembled, and the sliding portions to which the lubricant (2) was supplied were observed to evaluate the state of wear. The results are shown in Table A2-2-1. Reference numerals of Table A2-2-1 indicate the following.

A1: The operation property was good even after 100 hours from the start, and no wear was observed at the sliding portion.

A1*: The operation property after 100 hours from the start was slightly inferior to that of A1, and no wear was observed at the sliding portion.

A2: The operation property was good even after 100 hours from the start, and slight wear was observed at the sliding portion.

A3: The operation property was good even after 100 hours from the start, and wear observed at the sliding portion was more than that of A2.

B1: The operation property was inferior although the operation was performed even after 100 hours from the start, and the sliding portion was severely worn.

B2: The viscosity of the lubricant (2) was too high, and no reciprocation could be performed.

(Load=3 Times)

Evaluation of the wear resistance and the durability at a high and a low temperature was performed by observing the operation property and the state of wear after 100 hours from the start of the reciprocation; however, in all Examples and Comparative Examples, the reciprocation was stopped before 100 hours from the start.

TABLE 9

Table A2-2-1

| | | | COMPARATIVE EXAMPLE A2-2-1 | COMPARATIVE EXAMPLE A2-2-2 | EXAMPLE A2-2-1 | EXAMPLE A2-2-2 | EXAMPLE A2-2-3 | EXAMPLE A2-2-4 | EXAMPLE A2-2-5 | EXAMPLE A2-2-6 | COMPARATIVE EXAMPLE A2-2-3 |
|---|---|---|---|---|---|---|---|---|---|---|---|
| BASE OIL | | B1 (PARTS BY MASS) | 40 | 83 | 50 | 40 | 0 | 7 | 0 | 99.5 | 0 |
| | | B2 (PARTS BY MASS) | 40 | 0 | 35 | 50 | 95 | 90 | 99 | 0 | 99.95 |
| | | TOTAL (PARTS BY MASS) | 80 | 83 | 85 | 90 | 95 | 97 | 99 | 99.5 | 99.95 |
| ANTI-WEAR AGENT | | TOP (PARTS BY MASS) | 0 | 7 | 5 | 10 | 0 | 0 | 0 | 0 | 0 |
| | | TXP (PARTS BY MASS) | 0 | 0 | 5 | 0 | 0 | 0 | 0 | 0 | 0 |
| | | TOP2 (PARTS BY MASS) | 10 | 5 | 0 | 0 | 5 | 3 | 0 | 0 | 0 |
| | | TOP2 (PARTS BY MASS) | 10 | 5 | 5 | 0 | 0 | 0 | 1 | 0.5 | 0.05 |
| | | TOTAL (PARTS BY MASS) | 20 | 17 | 15 | 10 | 5 | 3 | 1 | 0.5 | 0.05 |
| PTFE PARTICLES (PARTS BY MASS) | | | 30 | 30 | 30 | 30 | 30 | 30 | 30 | 30 | 30 |
| EVALUATION | LOAD OF 2 TIMES | HIGH TEMPERATURE | A1 | A1 | A1 | A1 | A1 | A1 | A2 | A3 | B |
| | | LOW TEMPERATURE | B | B | A1* | A1* | A1 | A1 | A2 | A3 | B |

Example A2-3-1

The lubricant (2) was obtained by mixing the components in amounts shown in Table A2-3-1.

Next, as in Example A2-1-1, an actuator was formed (see FIGS. 1 and 2) in which the lubricant (2) was supplied to the sliding portions formed by the second torque increasing gear and the sliding portions formed by the output gear. In addition, as in Example A2-1-1, since a relatively weak force was applied to the sliding portions formed by the rotor and the sliding portions formed by the first torque increasing gear, the lubricant (1) used in Example A1-3 was supplied thereto. The lubricant (1) and the lubricant (2) were supplied as described in Example A2-1-1.

A camera module was connected to the actuator supplied with the lubricant (1) and the lubricant (2). This camera module was reciprocated at 80° C. for 100 hours. As the camera module described above, a module was used in which a load applied to the rotation output shaft 10*a* by the reciprocation was 3.0 times that of Example A1-1. As in the case described above, the reciprocation was also performed at −40° C. for 100 hours.

Example A2-3-2 to A2-3-6, Comparative Example A2-3-1 to A2-3-3

Except that the lubricant (2) was obtained by mixing the components in amounts shown in Table A2-3-1, an actuator was assembled in a manner similar to that of Example A2-3-1 and was reciprocated at 80° C. and −40° C. for 100 hours.

[Evaluation of Wear Resistance and Durability]

(Load=3 times)

Evaluation of the wear resistance and the durability at a high temperature was performed by observing the operation property and the state of wear after 100 hours from the start of the reciprocation. The actuator was disassembled, and the sliding portions to which the lubricant (2) was supplied were observed to evaluate the state of wear. The results are shown in Table A2-3-1. Reference numerals of Table A2-3-1 indicate the following.

A1: The operation property was good even after 100 hours from the start, and no wear was observed at the sliding portion.

A2: The operation property was good even after 100 hours from the start, and slight wear was observed at the sliding portion.

A3: The operation property was good even after 100 hours from the start, and wear observed at the sliding portion was more than that of A2.

B1: The operation property was inferior although the operation was performed even after 100 hours from the start, and the sliding portion was severely worn.

Evaluation of the wear resistance and the durability at a low temperature was performed by observing the operation property and the state of wear after 100 hours from the start of the reciprocation. The actuator was disassembled, and the sliding portions to which the lubricant (2) was supplied were observed to evaluate the state of wear. The results are shown in Table A2-3-1. Reference numerals of Table A2-3-1 indicate the following.

A1: The operation property was good even after 100 hours from the start, and no wear was observed at the sliding portion.

A1*: The operation property after 100 hours from the start was slightly inferior to that of A1, and no wear was observed at the sliding portion.

A2: The operation property was good even after 100 hours from the start, and slight wear was observed at the sliding portion.

A3: The operation property was good even after 100 hours from the start, and wear observed at the sliding portion was more than that of A2.

B1: The operation property was inferior although the operation was performed even after 100 hours from the start, and the sliding portion was severely worn.

B2: The viscosity of the lubricant (2) was too high, and no reciprocation could be performed.

In Example A2-3-1 to A2-3-6 and Comparative Example A2-3-1 to A2-3-3, except that 50 parts by mass of polytetrafluoroethylene particles was used instead of using 40 parts by mass of polytetrafluoroethylene particles, an actuator was formed in a manner similar to that described above and was reciprocated. In this case, the evaluations of the wear resistance and the durability were also the same as those of Example A2-3-1 to A2-3-6 and Comparative Example A2-3-1 to A2-3-3.

In addition, a camera module in which a load applied to the rotation output shaft 10*a* by the reciprocation is 2.0 to 3.0 times that of Example A1-1 corresponds to a camera module which has a zoom function and which is generally mounted in a cellular phone.

A camera module was connected to the actuator supplied with the lubricant (1) and the lubricant (2). This camera module was reciprocated at −40° C. for 100 hours. As the camera module described above, a module was used in which a load applied to the rotation output shaft 10*a* by the reciprocation was 3.0 times that of Example A1-1.

Example A2-8 to A2-14

Except that the lubricant (2) was obtained by mixing the components in amounts shown in Table A2-2, an actuator was assembled in a manner similar to that of Example A2-7 and was reciprocated at −40° C. for 100 hours.

[Evaluation of Wear Resistance and Durability]

Evaluation of the wear resistance and the durability at a low temperature was performed by observing the operation property and the state of wear after 100 hours from the start of the reciprocation. The actuator was disassembled, and the sliding portions to which the lubricant (2) was supplied were observed to evaluate the state of wear. The results are shown in Table A2-2. Reference numerals of Table A2-2 indicate the following.

A1: The operation property was good even after 100 hours from the start, and no wear was observed at the sliding portion.

A2: The operation property was good even after 100 hours from the start, and slight wear was observed at the sliding portion.

In Example A2-7 to A2-14, except that instead of using the trimethylolpropane valerate heptanoate mixed ester (B1) (kinematic viscosity at 100° C.: approximately 3.0 cSt), the polymer (B2) (kinematic viscosity at 40° C.: approximately 5.0 cSt) which was formed by polymerizing 1-nonene, 1-decene, 1-undecene, and 1-dodecen and which had 20 to 30 carbon atoms in total in the polymer were each used as a base oil, an actuator was formed in a manner similar to that

TABLE 10

Table A2-3-1

| | | COMPARATIVE EXAMPLE A2-3-1 | COMPARATIVE EXAMPLE A2-3-2 | EXAMPLE A2-3-1 | EXAMPLE A2-3-2 | EXAMPLE A2-3-3 | EXAMPLE A2-3-4 | EXAMPLE A2--5 | EXAMPLE A2-3-6 | COMPARATIVE EXAMPLE A2-3-3 |
|---|---|---|---|---|---|---|---|---|---|---|
| BASE OIL | B1 (PARTS BY MASS) | 40 | 83 | 50 | 40 | 0 | 7 | 0 | 99.5 | 0 |
| | B2 (PARTS BY MASS) | 40 | 0 | 35 | 50 | 95 | 90 | 99 | 0 | 99.95 |
| | TOTAL (PARTS BY MASS) | 80 | 83 | 85 | 90 | 95 | 97 | 99 | 99.5 | 99.95 |
| ANTI-WEAR AGENT | TOP (PARTS BY MASS) | 0 | 7 | 5 | 10 | 0 | 0 | 0 | 0 | 0 |
| | TXP (PARTS BY MASS) | 0 | 0 | 5 | 0 | 0 | 0 | 0 | 0 | 0 |
| | TOP2 (PARTS BY MASS) | 10 | 5 | 0 | 0 | 5 | 3 | 0 | 0 | 0 |
| | TOP2 (PARTS BY MASS) | 10 | 5 | 5 | 0 | 0 | 0 | 1 | 0.5 | 0.05 |
| | TOTAL (PARTS BY MASS) | 20 | 17 | 15 | 10 | 5 | 3 | 1 | 0.5 | 0.05 |
| PTFE PARTICLES (PARTS BY MASS) | | 40 | 40 | 40 | 40 | 40 | 40 | 40 | 40 | 40 |
| EVALUATION LOAD OF 3 TIMES | HIGH TEMPERATURE | A1 | A1 | A1 | A1 | A1 | A1 | A2 | A3 | B |
| | LOW TEMPERATURE | B | B | A1* | A1* | A1 | A1 | A2 | A3 | B |

Example A2-7

The lubricant (2) was obtained by mixing 96 parts by mass of the trimethylolpropane valerate heptanoate mixed ester (B1) (kinematic viscosity at 100° C.: approximately 3.0 cSt) as a base oil, 4 parts by mass of the neutral phosphoric ester represented by the formula (1) ($R^1$, $R^2$, and $R^3$ each represented an oleyl group) (see Table A2-2) as an anti-wear agent, and 45 parts by mass of polytetrafluoroethylene particles (the same type as that of Example A2-1-1).

Next, as in Example A2-1-1, an actuator was formed (see FIGS. 1 and 2) in which the lubricant (2) was supplied to the sliding portions formed by the second torque increasing gear and the sliding portions formed by the output gear. In addition, as in Example A2-1-1, since a relatively weak force was applied to the sliding portions formed by the rotor and the sliding portions formed by the first torque increasing gear, the lubricant (1) used in Example A1-3 was supplied thereto. The lubricant (1) and the lubricant (2) were supplied as described in Example A2-1-1.

described above and was reciprocated. In this case, the evaluation results of the wear resistance and the durability were also the same as those of Example A2-7 to A2-14.

Furthermore, in Examples A2-7 to A2-14, except that instead of using the neutral phosphoric ester represented by the formula (1) as an anti-wear agent, the neutral phosphorous ester represented by the formula (2) ($R^4$, $R^5$ and an $R^6$ each represented an oleyl group, a stearyl group, a tridecyl group, a lauryl group, a 2-ethylhexyl group, an ethyl group, a nonylphenyl group, or a cresyl group) was used, an actuator was formed in a manner similar to that described above and was reciprocated. In this case, the evaluation results of the wear resistance and the durability were also the same as those of Examples A2-7 to A2-14.

TABLE 11

Table A2-2

| | EXAMPLE A2-7 | EXAMPLE A2-8 | EXAMPLE A2-9 | EXAMPLE A2-10 | EXAMPLE A2-11 | EXAMPLE A2-12 | EXAMPLE A2-13 | EXAMPLE A2-14 |
|---|---|---|---|---|---|---|---|---|
| $R^1$~$R^3$ | OLEYL GROUP | STEARYL GROUP | TRIDECYL GROUP | LAURYL GROUP | 2-ETHYLHEXYL GROUP | ETHYL GROUP | NONYLPHENYL GROUP | CRESYL GROUP |
| EVALUATION | A1 | A1 | A1 | A1 | A2 | A2 | A1 | A1 |

Example A2-15

As a base oil, trimethylolpropane valerate heptanoate mixed esters having different molecular weights and polymers having different molecular weights obtained by polymerizing 1-nonene, 1-decene, 1-undecene, and 1-dodecen were prepared. The lubricant (2) was obtained by mixing 96 parts by mass of a base-oil mixture of base oils appropriately selected from those mentioned above, 4 parts by mass of trioleyl phosphate (TOP) as an anti-wear agent, and 45 parts by mass of polytetrafluoroethylene particles (the same type as that of Example A2-1-1). When this lubricant (2) was held at 90° C., the change in weight thereof was 2.0 percent by mass.

Next, as in Example A2-1-1, an actuator was formed (see FIGS. 1 and 2) in which the lubricant (2) was supplied to the sliding portions formed by the second torque increasing gear and the sliding portions formed by the output gear. In addition, as in Example A2-1-1, since a relatively weak force was applied to the sliding portions formed by the rotor and the sliding portions formed by the first torque increasing gear, the lubricant (1) used in Example A1-3 was supplied thereto. The lubricant (1) and the lubricant (2) were supplied as described in Example A2-1-1.

A camera module was connected to the actuator supplied with the lubricant (1) and the lubricant (2). In order to perform the accelerated test of the operation, this camera module was reciprocated at −40° C. for 100 hours. As the camera module described above, a module was used in which a load applied to the rotation output shaft 10*a* by the reciprocation was 3.0 times that of Example A1-1.

Examples A2-16 to A2-21

Except that the lubricant (2) was used having a change in weight shown in Table A2-3 which was obtained when the lubricant was held at 90° C., an actuator was assembled in a manner similar to that of Example A2-15 and was reciprocated at 80° C. for 100 hours in order to perform the accelerated test of the operation. In addition, the change in weight obtained when the lubricant was held at 90° C. was adjusted by the types of base oils to be used and a mixing ratio therebetween.

[Accelerated Test of Operation]

The accelerated test of the operation was evaluated based on how many hours the operation was able to be performed from the start of the reciprocation. The results are shown in Table A2-3. Reference numerals of Table A2-3 indicate the following.

A1: The operation was well performed even after 80 hours from the start.

A2: The operation was stopped when the test was performed for between 60 hours and less than 80 hours.

A3: The operation was stopped when the test was performed for between 50 hours and less than 60 hours.

A4: The operation was stopped when the test was performed for less than 30 hours.

In addition, in Examples A2-15 to A2-21, except that trioleyl phosphite (TOP2) was used as an anti-wear agent instead of using trioleyl phosphate (TOP), an actuator was formed in a manner similar to that described above and was reciprocated. In this case, the results of the accelerated test of the operation were also the same as those of Examples A2-15 to A2-21.

TABLE 12

Table A2-3

| | EXAMPLE A2-15 | EXAMPLE A2-16 | EXAMPLE A2-17 | EXAMPLE A2-18 | EXAMPLE A2-19 | EXAMPLE A2-20 | EXAMPLE A2-21 |
|---|---|---|---|---|---|---|---|
| CHANGE IN WEIGHT OF LUBRICANT WHEN HELD AT 90° C. (PERCENT BY MASS) | 2.0 | 1.62 | 1.3 | 1.0 | 0.8 | 0.5 | 0.3 |
| EVALUATION | A4 | A3 | A3 | A2 | A2 | A1 | A1 |

Example A2-22

As a base oil, a trimethylolpropane valerate heptanoate mixed ester and a polymer obtained by polymerizing 1-nonene, 1-decene, 1-undecene, and 1-dodecen were prepared. For each of these base oils, a refined base oil and a non-refined base oil were both prepared. As trioleyl phosphate (TOP) used as an anti-wear agent, a reagent grade anti-wear agent and an anti-wear agent having a low purity were both prepared. In addition, the lubricant (2) was obtained by mixing 96 parts by mass of a base-oil mixture of base oils appropriately selected from those mentioned above, 4 parts by mass of trioleyl phosphate (TOP) appropriately selected from the above anti-wear agents, and 45 parts by mass of polytetrafluoroethylene particles (the same type as that of Example A2-1-1). In this lubricant (2), the total acid number was 1.5 mgKOH/g.

Next, as in Example A2-1-1, an actuator was formed (see FIGS. 1 and 2) in which the lubricant (2) was supplied to the sliding portions formed by the second torque increasing gear and the sliding portions formed by the output gear. In addition, as in Example A2-1-1, since a relatively weak force was applied to the sliding portions formed by the rotor and the sliding portions formed by the first torque increasing gear, the lubricant (1) used in Example A1-3 was supplied thereto. The lubricant (1) and the lubricant (2) were supplied as described in Example A2-1-1.

A camera module was connected to the actuator supplied with the lubricant (1) and the lubricant (2). As the camera module described above, a module was used in which a load applied to the rotation output shaft 10*a* by the reciprocation was 3.0 times that of Example A1-1. In order to perform the accelerated test of the operation, after being held for 1,000 hours, this camera module was reciprocated at 80° C.

Example A2-23 to A2-26

Except that the lubricant (2) having a total acid number shown in Table A2-4 was used, an actuator was assembled in a manner similar to that of Example A2-22 and was reciprocated at 80° C. In addition, the total acid number was adjusted by the types of base oils to be used and the types of anti-wear agents to be used.

[Evaluation of Silence Property]

The silence property was evaluated by the loudness of sound generated during the reciprocation. The results are shown in Table A2-4. Reference numerals of Table A2-4 indicate the following.

A1: No sound was generated during the operation.

A2: Slight sound was generated during the operation.

A3: Loud sound was generated during the operation.

In addition, in Examples A2-21 to A2-26, except that trioleyl phosphite (TOP2) was used as an anti-wear agent instead of using trioleyl phosphate (TOP), an actuator was formed in a manner similar to that described above and was reciprocated. In this case, the evaluation results of the silence property were also the same as those of Examples A2-22 to A2-26.

TABLE 13

Table A2-4

| | EXAMPLE A2-22 | EXAMPLE A2-23 | EXAMPLE A2-24 | EXAMPLE A2-25 | EXAMPLE A2-26 |
|---|---|---|---|---|---|
| TOTAL ACID NUMBER (mgKOH/g) | 1.5 | 0.2 | 0.15 | 0.1 | 0.03 |
| EVALUATION | A3 | A2 | A2 | A1 | A1 |

Example A2-27

As a base oil, a polymer obtained by polymerizing 1-butene, 1-pentene, 1-hexene, 1-heptene, 1-octene, 1-nonene, 1-decene, 1-undecene, and 1-dodecen was prepared. From this base oil mixture, a polymer having more than 36 carbon atoms was obtained by classification. The lubricant (2) was obtained by mixing 96 parts by mass of this base oil, 4 parts by mass of trioleyl phosphate (TOP) as an anti-wear agent, and 45 parts by mass of polytetrafluoroethylene particles (the same type as that of Example A2-1-1).

Next, as in Example A2-1-1, an actuator was formed (see FIGS. 1 and 2) in which the lubricant (2) was supplied to the sliding portions formed by the second torque increasing gear and the sliding portions formed by the output gear. In addition, as in Example A2-1-1, since a relatively weak force was applied to the sliding portions formed by the rotor and the sliding portions formed by the first torque increasing gear, the lubricant (1) used in Example A1-3 was supplied thereto. The lubricant (1) and the lubricant (2) were supplied as described in Example A2-1-1.

A camera module was connected to the actuator supplied with the lubricant (1) and the lubricant (2). In order to perform the accelerated test of the operation, this camera module was reciprocated at 80° C. As this camera module, a module was used in which a load applied to the rotation output shaft 10*a* by the reciprocation was 3.0 times that of Example A1-1.

Example A2-28 to A2-30

From the above base oil mixture, a polymer having 15 to 35 carbon atoms, a polymer having 20 to 30 carbon atoms, and a polymer having less than 14 carbon atoms were obtained by classification. Except that the polymer shown in Table A2-5 was used, an actuator was assembled in a manner similar to that of Example A2-27 and was reciprocated at 80° C.

[Accelerated Test of Operation]

The accelerated test of the operation was evaluated based on how many hours the operation was able to be performed from the start of the reciprocation. The results are shown in Table A2-5. Reference numerals of Table A2-5 indicate the following.

A1: The operation was well performed even after 80 hours from the start.

A2: The operation was stopped when the test was performed for between 60 hours and less than 80 hours.

A3: The operation was stopped when the test was performed for less than one hour.

B: Since the viscosity of the lubricant (2) was too high, although the reciprocation was started, the operation thereof could not be well performed.

In addition, in Examples A2-27 to A2-30, except that trioleyl phosphite (TOP2) was used as an anti-wear agent instead of using trioleyl phosphate (TOP), an actuator was formed in a manner similar to that described above and was reciprocated. In this case, the results of the accelerated test of the operation were also the same as those of Examples A2-27 to A2-30.

TABLE 14

Table A2-5

| | EXAMPLE A2-27 | EXAMPLE A2-28 | EXAMPLE A2-29 | EXAMPLE A2-30 |
|---|---|---|---|---|
| NUMBER OF CARBON ATOMS | 36 OR MORE | 15~35 | 20~30 | LESS THAN 14 |
| EVALU-ATION | B | A2 | A1 | A3 |

Example A2-31

The lubricant (2) was obtained by mixing 96 parts by mass of the trimethylolpropane valerate heptanoate mixed ester (B1) (kinematic viscosity at 100° C.: approximately 3.0 cSt) as a base oil, 4 parts by mass of trioleyl phosphate (TOP) as an anti-wear resistance, and 45 parts by mass of polytetrafluoroethylene particles (the same type as that of Example A2-1-1).

Next, as in Example A2-1-1, an actuator was formed (see FIGS. 1 and 2) in which the lubricant (2) was supplied to the sliding portions formed by the second torque increasing gear and the sliding portions formed by the output gear. In addition, as in Example A2-1-1, since a relatively weak force was applied to the sliding portions formed by the rotor and the sliding portions formed by the first torque increasing gear, the lubricant (1) used in Example A1-3 was supplied thereto. The lubricant (1) and the lubricant (2) were supplied as described in Example A2-1-1.

A camera module was connected to the actuator supplied with the lubricant (1) and the lubricant (2). This actuator was stored at 90° C. and 80 RH for 1,000 hours. Subsequently, the camera module was reciprocated at 80° C. As the camera module described above, a module was used in which a load applied to the rotation output shaft 10*a* by the reciprocation was 3.0 times that of Example A1-1.

Example A1-32 to A1-38

Except that the lubricant (2) including a benzotriazole derivative in an amount shown in Table A2-6 was used, an actuator was assembled in a manner similar to that of Example A2-31 and was stored at 90° C. and 80 RH for 1,000 hours. Subsequently, a camera module was reciprocated at 80° C.

[Occurrence of Tarnish]

The actuator stored at 90° C. and 80 RH for 1,000 was disassembled, and the occurrence of tarnish of the sliding portions to which the lubricant (2) was supplied was observed. The results are shown in Table A2-6. Reference numerals of Table A2-6 indicate the following.

A1: No tarnish was observed.

A2: Slight tarnish occurred.

A3: More tarnish than that of A2 occurred.

B: Tarnish occurred.

[Accelerated Test of Operation]

The accelerated test of the operation was evaluated based on how many hours the operation was able to be performed from the start of the reciprocation. The results are shown in Table A2-6. Reference numerals of Table A2-6 indicate the following.

A1: The operation was well performed even after 80 hours from the start.

A2: The operation was stopped when the test was performed for between 60 hours and less than 80 hours.

B: Since the viscosity of the lubricant (2) was too high, although the reciprocation was started, the operation thereof could not be well performed.

TABLE 15

Table A2-6

| | EXAMPLE A2-31 | EXAMPLE A2-32 | EXAMPLE A2-33 | EXAMPLE A2-34 | EXAMPLE A2-35 | EXAMPLE A2-36 | EXAMPLE A2-37 | EXAMPLE A2-38 |
|---|---|---|---|---|---|---|---|---|
| METAL DEACTIVATOR (PARTS BY MASS) | 0 | 0.01 | 0.02 | 0.03 | 0.06 | 1 | 3 | 5 |
| TARNISH | B | A3 | A2 | A1 | A1 | A1 | A1 | A1 |
| OPERATION PROPERTY | A1 | A1 | A1 | A1 | A1 | A2 | A2 | B |
| COMPREHENSIVE EVALUATION | B | A3 | A2 | A1 | A1 | A2 | A2 | B |

Example A2-39

The lubricant (2) was obtained by mixing 96 parts by mass of the trimethylolpropane valerate heptanoate mixed ester (B1) (kinematic viscosity at 100° C.: approximately 3.0 cSt) as a base oil, 4 parts by mass of trioleyl phosphate (TOP) as an anti-wear resistance, 45 parts by mass of polytetrafluoroethylene particles (the same type as that of Example A2-1-1), and 0.005 parts by mass of a fluorescent agent.

Example A2-40 to A2-45

Except that the lubricant (2) including a fluorescent agent in an amount shown in Table A2-7 was used, the lubricant (2) was obtained in a manner similar to that of Example A2-39.

[UV Light Irradiation Test]

The lubricant (2) was irradiated with light by a handy UV light, and it was confirmed whether the lubricant emitted light or not. The results are shown in Table A2-7. Reference numerals of Table A2-7 indicate the following.

A1: Light was emitted with appropriate brightness.

A2: Light was excessively emitted to some extent.

B1: Light was emitted too weakly.

B2: Light was excessively emitted.

TABLE 16

Table A2-7

| | EXAMPLE A2-39 | EXAMPLE A2-40 | EXAMPLE A2-41 | EXAMPLE A2-42 | EXAMPLE A2-43 | EXAMPLE A2-44 | EXAMPLE A2-45 |
|---|---|---|---|---|---|---|---|
| FLUORESCENT AGENT (PARTS BY MASS) | 0.005 | 0.01 | 0.05 | 0.1 | 0.2 | 0.5 | 1.0 |
| EVALUATION | B | A2 | A1 | A1 | A1 | A2 | B |

Example A3-1-1

The lubricant (1) used in Example A1-3 and the lubricant (2) used in Example A2-3-3 were prepared as the lubricant (1) and the lubricant (2), respectively. In addition, 50 parts by mass of tris(1H,1H,5H-octafluoro-n-pentyl) phosphate as a phosphoric ester and 50 parts by mass of a perfluoroalkyl ethylene oxide adduct as a fluorine type surfactant were dissolved in isopropyl alcohol, so that a surface-treating agent was prepared. In this case, with respect to 100 parts by mass of isopropyl alcohol, the phosphoric ester and the fluorine type surfactant were dissolved so that the total thereof was 1.5 parts by mass.

Next, after the housings 2*a* and 2*b* were immersed in the surface-treating agent, the solvent was evaporated. Except that the housings 2*a* and 2*b* processed by the surface-treating agent were used, as in Example A2-3-3, an actuator (housings, a rotor, and gears made of brass were used) was formed (see FIGS. 1 and 2) in which the lubricant (1) was supplied to the sliding portions formed by the rotor and the sliding portions formed by the first torque increasing gear and in which the lubricant (2) was supplied to the sliding portions formed by the second torque increasing gear and the sliding portions formed by the output gear. The lubricant (1) and the lubricant (2) were supplied as described in Example A2-3-3.

A camera module was connected to the actuator supplied with the lubricant (1) and the lubricant (2). This camera module was reciprocated at 80° C. As the camera module described above, a module was used in which a load applied to the rotation output shaft 10*a* by the reciprocation was 3.0 times that of Example A1-1.

Example A3-1-2

As in Example A2-3-3, an actuator was formed, and a camera module was connected thereto. This camera module was reciprocated at 80° C. As the camera module described above, a module was used in which a load applied to the rotation output shaft 10*a* by the reciprocation was 3.0 times that of Example A1-1.

Reference Example A3-1-1

Except that the lubricant (1) and the lubricant (2) were not used, as in Example 3-1-1, an actuator was formed, and a camera module was connected thereto. This camera module was reciprocated at 80° C. As the camera module described above, a module was used in which a load applied to the rotation output shaft 10*a* by the reciprocation was 3.0 times that of Example A1-1.

[Evaluation of Durability]

A time required to stop the operation caused by wear of the sliding portion was measured. The times in Examples A3-1-1 and A3-1-2, and Reference Example A3-1-1 were 1,500, 500, and 100 hours, respectively.

[Evaluation of Silence Property]

The camera module was removed for the evaluation of the silence property. The actuator was driven, and the loudness of sound generated by rotation of the rotation output shaft 10*a* was evaluated into one of ten levels. In particular, the actuator was set in an anechoic room, a microphone was placed at a position 20 mm apart from the actuator, and a sound generated during driving was picked up. The level of Example A3-1-1 was 1+(superior to 1), the level of Example A3-1-2 was 7, and the level of Reference Example A3-1-1 was 1. A smaller value indicates lower loudness. In addition, when the level is 7 or less, and this actuator is used to drive a camera module of a cellular phone, a drive sound is not a level to cause a problem even when an animation is taken.

In addition, in Examples A3-1-1 and A3-1-2 and Reference Example A3-1-1, except that as a surface-treating agent, tris (1H,1H,5H-octafluoro-n-pentyl) phosphite or bis(2',2',2-trifluoroethyl)(methoxycarbonyl) phosphonate trioleyl phosphite was used instead of using tris(1H,1H,5H-octafluoro-n-pentyl) phosphate, an actuator was formed in a manner similar to that described above and was reciprocated. In this case, the evaluation results of the durability and the silence property were also the same as those of Example A3-1-1 and A3-1-2 and Reference example A3-1-1.

In addition, in Example A3-1-1 and A3-1-2 and Reference Example A3-1-1, when the reciprocation was performed as described above except that only the temperature was changed, in a temperature range down to −40° C., the evaluation results of the durability and the silence property were also the same as those of Example A3-1-1 and A3-1-2 and Reference Example A3-1-1.

Surface-Treating Agent

Example B1-1

A surface-treating agent was prepared by dissolving 80 parts by mass of tris(1H,1H,5H-octafluoro-n-pentyl) phosphate as a fluorine-containing phosphoric ester and 20 parts by mass of a perfluoroalkyl ethylene oxide adduct as a fluorine type surfactant in isopropyl alcohol. In this case, with respect to 100 parts by mass of isopropyl alcohol, the phosphoric ester and the fluorine type surfactant were dissolved so that the total thereof was 1.5 parts by mass. As described above, the surface-treating agent was obtained.

Next, an actuator (housings, a rotor, and gears made of brass were used) was formed (see FIGS. 1 and 2) in which housing sides of the sliding portions were processed by the surface-treating agent.

In particular, after the housings 2*a* and 2*b* were immersed in the surface-treating agent, the solvent was evaporated. Subsequently, the rotor 12, the first torque increasing gear 6, the second torque increasing gear 8, and the output gear 10 were inserted in the housing 2*a* processed by the surface-treating agent, and the housing 2*b* processed by the surface-treating agent was fitted to the housing 2*a* so as to sandwich the rotor 12, the first torque increasing gear 6, the second torque increasing gear 8, and the output gear 10 therebetween. As described above, the actuator was obtained.

The actuator processed by the surface-treating agent was driven to rotate the rotation output shaft 10*a*.

Example B1-2 to B1-8

Except that the surface-treating agent was obtained by mixing the components in amounts shown in Table B1-1, an actuator was assembled in a manner similar to that of Example B1-1 and was driven.

[Evaluation of Silence Property]

As the evaluation of the silence property, the loudness of sound generated during driving was evaluated into one of ten levels. In particular, the actuator was set in an anechoic room, a microphone was placed at a position 20 mm apart from the actuator, and a sound generated during driving was picked up. The results are shown in Table B1-1. A smaller value indicates lower loudness. In addition, when the level is 7 or less, and this actuator is used to drive a camera module of a cellular phone, a drive sound is not a level to cause a problem even when an animation is taken.

In addition, in Example B1-1 to B1-8, except that tris(1H,1H,5H-octafluoro-n-pentyl) phosphite or bis(2',2',2-trifluoroethyl)(methoxycarbonyl) phosphonate was used instead of using tris(1H,1H,5H-octafluoro-n-pentyl) phosphate, an actuator was formed in a manner similar to that described above and was driven. In this case, the evaluation results of the silence property were also the same as those of Examples B1-1 to B1-8.

Furthermore, in Example B1-1 to B1-8, except that hexane, diethyl ether, or methyl ethyl ketone was used instead of using isopropyl alcohol, an actuator was formed in a manner similar to that described above and was driven. In this case, the evaluation results of the silence property were also the same as those of Examples B1-1 to B1-8.

TABLE 17

Table B1-1

| | EXAMPLE B1-1 | EXAMPLE B1-2 | EXAMPLE B1-3 | EXAMPLE B1-4 | EXAMPLE B1-5 | EXAMPLE B1-6 | EXAMPLE B1-7 | EXAMPLE B1-8 |
|---|---|---|---|---|---|---|---|---|
| FLUORINE-CONTAINING PHOSPHORIC ESTER (PARTS BY MASS) | 20 | 30 | 40 | 45 | 55 | 60 | 70 | 80 |
| FLUORINE TYPE SURFACTANT (PARTS BY MASS) | 80 | 70 | 60 | 55 | 45 | 40 | 30 | 20 |
| EVALUATION | 7 | 5 | 3 | 1 | 1 | 3 | 5 | 7 |

Example B1-9-1

As a fluorine-containing phosphoric ester, in the fluorine-containing phosphoric ester represented by formula (A), a fluorine-containing phosphoric ester was prepared so that $R^1$ represented a pentyl group in which some or all of hydrogen atoms were substituted with fluorine atoms, $R^2$ represented an octyl group in which some or all of hydrogen atoms were substituted with fluorine atoms, $R^3$ represented a dodecyl group in which some or all of hydrogen atoms were substituted with fluorine atoms, and a fluorine-atom substitution rate (%) was 50% or more. In addition, in Table B1-2-1, the fluorine-atom substitution rate (%) indicates the percentage of the number of the hydrogen atoms which are substituted by fluorine-atoms out of the total number of hydrogen atoms possessed by $R^1$, $R^2$ and $R^3$ before part of or all of the hydrogen atoms are substituted with fluorine-atoms.

A surface-treating agent was prepared by dissolving 50 parts by mass of this fluorine-containing phosphoric ester and 50 parts by mass of a perfluoroalkyl ethylene oxide adduct as a fluorine type surfactant in isopropyl alcohol. In this case, with respect to 100 parts by mass of isopropyl alcohol, the phosphoric ester and the fluorine type surfactant were dissolved so that the total thereof was 1.5 parts by mass. As described above, the surface-treating agent was obtained.

Next, as in Example B1-1, an actuator was formed (see FIGS. 1 and 2) in which the housing sides of the sliding portions were processed by the surface-treating agent.

A camera module was connected to the actuator processed by the surface-treating agent. This camera module was reciprocated. Since the above camera module had no zoom function and was smaller than a camera module mounted in a usual cellular phone, loads applied to the rotor and the gears were small.

Example B1-9-2 to B1-9-5

Except that a surface-treating agent was obtained using compounds having groups shown in Table B1-2-1 as $R^1$ to $R^3$ of the fluorine-containing phosphoric ester represented by the formula (A), an actuator was assembled in a manner similar to that of Example B1-9-1 and was reciprocated.

Example B1-10-1

Except that as a fluorine-containing phosphoric ester, in the fluorine-containing phosphoric ester represented by formula (B), there was used a fluorine-containing phosphoric ester having $R^4$ representing a pentyl group in which some or all of hydrogen atoms were substituted with fluorine atoms, $R^5$ representing an octyl group in which some or all of hydrogen atoms were substituted with fluorine atoms, and $R^6$ representing a dodecyl group in which some or all of hydrogen atoms were substituted with fluorine atoms, in which the fluorine-atom substitution rate (%) was 50% or more, an actuator was assembled in a manner similar to that of Example B1-9-1 and was reciprocated. In addition, in Table B1-2-2, the fluorine-atom substitution rate (%) indicates the percentage of the number of the hydrogen atoms which are substituted by fluorine-atoms out of the total number of hydrogen atoms possessed by $R^4$, $R^5$ and $R^6$ before part of or all of the hydrogen atoms are substituted with fluorine-atoms.

Example B1-10-2 to B1-10-5

Except that a surface-treating agent was obtained using the compounds having groups shown in Table B1-2-2 as $R^4$ to $R^6$ of the fluorine-containing phosphoric ester represented by the formula (B), an actuator was assembled in a manner similar to that of Example B1-10-1 and was reciprocated.

Example B1-11-1

Except that as a fluorine-containing phosphoric ester, in the fluorine-containing phosphoric ester represented by formula (C), there was used a fluorine-containing phosphoric ester having $R^7$ representing an ethyl group in which some or all of hydrogen atoms were substituted with fluorine atoms, $R^8$ representing an ethyl group in which some or all of hydrogen atoms were substituted with fluorine atoms, and $R^9$ representing a methoxycarbonyl group, in which the fluorine-atom substitution rate (%) was 50% or more, an actuator was assembled in a manner similar to that of Example B1-9-1 and was reciprocated. In addition, in Table B1-2-3, the fluorine-atom substitution rate (%) indicates the percentage of the number of the hydrogen atoms which are substituted by fluorine-atoms out of the total number of hydrogen atoms possessed by $R^7$ and $R^8$ before part of or all of the hydrogen atoms are substituted with fluorine-atoms.

Example B1-11-2 to B1-11-4

Except that a surface-treating agent was obtained using the compounds having groups shown in Table B1-2-3 as $R^7$ to $R^9$ of the fluorine-containing phosphoric ester represented by the formula (C), an actuator was assembled in a manner similar to that of Example B1-11-1 and was reciprocated.

[Evaluation of Sliding Properties]

A consumed current (mA) of the actuator was measured. The results are shown in Tables B1-2-1 to B1-2-3. A consumed current (mA) of 27 (mA) or less indicates a superior sliding property, and a consumed current (mA) of 27 (mA) or more indicates an inferior sliding property.

TABLE 18

Table B1-2-1

| | EXAMPLE B1-9-1 | EXAMPLE B1-9-2 | EXAMPLE B1-9-3 | EXAMPLE B1-9-4 | EXAMPLE B1-9-5 |
|---|---|---|---|---|---|
| $R^1$ | PENTYL GROUP IN WHICH A PART OR ALL OF HYDROGEN ATOMS HAVE BEEN SUBSTITUTED WITH A FLUORINE ATOM | DODECYL GROUP IN WHICH A PART OR ALL OF HYDROGEN ATOMS HAVE BEEN SUBSTITUTED WITH A FLUORINE ATOM | DECYL GROUP IN WHICH A PART OR ALL OF HYDROGEN ATOMS HAVE BEEN SUBSTITUTED WITH A FLUORINE ATOM | PENTYL GROUP IN WHICH A PART OR ALL OF HYDROGEN ATOMS HAVE BEEN SUBSTITUTED WITH A FLUORINE ATOM | PROPYL GROUP IN WHICH A PART OR ALL OF HYDROGEN ATOMS HAVE BEEN SUBSTITUTED WITH A FLUORINE ATOM |
| $R^2$ | OCTYL GROUP IN WHICH A PART OR ALL OF HYDROGEN ATOMS HAVE BEEN SUBSTITUTED WITH A FLUORINE ATOM | OLEYL GROUP IN WHICH A PART OR ALL OF HYDROGEN ATOMS HAVE BEEN SUBSTITUTED WITH A FLUORINE ATOM | OCTYL GROUP IN WHICH A PART OR ALL OF HYDROGEN ATOMS HAVE BEEN SUBSTITUTED WITH A FLUORINE ATOM | PENTYL GROUP IN WHICH A PART OR ALL OF HYDROGEN ATOMS HAVE BEEN SUBSTITUTED WITH A FLUORINE ATOM | BUTYL GROUP IN WHICH A PART OR ALL OF HYDROGEN ATOMS HAVE BEEN SUBSTITUTED WITH A FLUORINE ATOM |
| $R^3$ | DODECYL GROUP IN WHICH A PART OR ALL OF HYDROGEN ATOMS HAVE BEEN SUBSTITUTED WITH A FLUORINE ATOM | OLEYL GROUP IN WHICH A PART OR ALL OF HYDROGEN ATOMS HAVE BEEN SUBSTITUTED WITH A FLUORINE ATOM | DODECYL GROUP IN WHICH A PART OR ALL OF HYDROGEN ATOMS HAVE BEEN SUBSTITUTED WITH A FLUORINE ATOM | PENTYL GROUP IN WHICH A PART OR ALL OF HYDROGEN ATOMS HAVE BEEN SUBSTITUTED WITH A FLUORINE ATOM | ETHYL GROUP IN WHICH A PART OR ALL OF HYDROGEN ATOMS HAVE BEEN SUBSTITUTED WITH A FLUORINE ATOM |
| FLUORINE-ATOM SUBSTITUTION RATE (%) | 50% OR MORE | 50% OR MORE | 50% OR MORE | 50% OR MORE | 50% OR MORE |
| CONSUMED CURRENT (mA) | 15 | 23 | 25 | 18 | 50 |

TABLE 19

Table B1-2-2

| | EXAMPLE B1-10-1 | EXAMPLE B1-10-2 | EXAMPLE B1-10-3 | EXAMPLE B1-10-4 | EXAMPLE B1-10-5 |
|---|---|---|---|---|---|
| $R^4$ | PENTYL GROUP IN WHICH A PART OR ALL OF HYDROGEN ATOMS HAVE BEEN SUBSTITUTED WITH A FLUORINE ATOM | DODECYL GROUP IN WHICH A PART OR ALL OF HYDROGEN ATOMS HAVE BEEN SUBSTITUTED WITH A FLUORINE ATOM | DECYL GROUP IN WHICH A PART OR ALL OF HYDROGEN ATOMS HAVE BEEN SUBSTITUTED WITH A FLUORINE ATOM | PENTYL GROUP IN WHICH A PART OR ALL OF HYDROGEN ATOMS HAVE BEEN SUBSTITUTED WITH A FLUORINE ATOM | PROPYL GROUP IN WHICH A PART OR ALL OF HYDROGEN ATOMS HAVE BEEN SUBSTITUTED WITH A FLUORINE ATOM |
| $R^5$ | OCTYL GROUP IN WHICH A PART OR ALL OF HYDROGEN ATOMS HAVE BEEN SUBSTITUTED WITH A FLUORINE ATOM | OLEYL GROUP IN WHICH A PART OR ALL OF HYDROGEN ATOMS HAVE BEEN SUBSTITUTED WITH A FLUORINE ATOM | OCTYL GROUP IN WHICH A PART OR ALL OF HYDROGEN ATOMS HAVE BEEN SUBSTITUTED WITH A FLUORINE ATOM | PENTYL GROUP IN WHICH A PART OR ALL OF HYDROGEN ATOMS HAVE BEEN SUBSTITUTED WITH A FLUORINE ATOM | BUTYL GROUP IN WHICH A PART OR ALL OF HYDROGEN ATOMS HAVE BEEN SUBSTITUTED WITH A FLUORINE ATOM |
| $R^6$ | DODECYL GROUP IN WHICH A PART OR ALL OF HYDROGEN ATOMS HAVE BEEN SUBSTITUTED WITH A FLUORINE ATOM | OLEYL GROUP IN WHICH A PART OR ALL OF HYDROGEN ATOMS HAVE BEEN SUBSTITUTED WITH A FLUORINE ATOM | DODECYL GROUP IN WHICH A PART OR ALL OF HYDROGEN ATOMS HAVE BEEN SUBSTITUTED WITH A FLUORINE ATOM | PENTYL GROUP IN WHICH A PART OR ALL OF HYDROGEN ATOMS HAVE BEEN SUBSTITUTED WITH A FLUORINE ATOM | ETHYL GROUP IN WHICH A PART OR ALL OF HYDROGEN ATOMS HAVE BEEN SUBSTITUTED WITH A FLUORINE ATOM |

TABLE 19-continued

Table B1-2-2

| | EXAMPLE B1-10-1 | EXAMPLE B1-10-2 | EXAMPLE B1-10-3 | EXAMPLE B1-10-4 | EXAMPLE B1-10-5 |
|---|---|---|---|---|---|
| FLUORINE-ATOM SUBSTITUTION RATE (%) | 50% OR MORE | 50% OR MORE | 50% OR MORE | 50% OR MORE | 50% OR MORE |
| CONSUMED CURRENT (mA) | 15 | 23 | 25 | 18 | 50 |

TABLE 20

Table B1-2-3

| | EXAMPLE B1-11-1 | EXAMPLE B1-11-2 | EXAMPLE B1-11-3 | EXAMPLE B1-11-4 |
|---|---|---|---|---|
| $R^7$ | ETHYL GROUP IN WHICH A PART OR ALL OF HYDROGEN ATOMS HAVE BEEN SUBSTITUTED WITH A FLUORINE ATOM | PROPYL GROUP IN WHICH A PART OR ALL OF HYDROGEN ATOMS HAVE BEEN SUBSTITUTED WITH A FLUORINE ATOM | OCTYL GROUP IN WHICH A PART OR ALL OF HYDROGEN ATOMS HAVE BEEN SUBSTITUTED WITH A FLUORINE ATOM | NONYL GROUP IN WHICH A PART OR ALL OF HYDROGEN ATOMS HAVE BEEN SUBSTITUTED WITH A FLUORINE ATOM |
| $R^8$ | ETHYL GROUP IN WHICH A PART OR ALL OF HYDROGEN ATOMS HAVE BEEN SUBSTITUTED WITH A FLUORINE ATOM | OCTYL GROUP IN WHICH A PART OR ALL OF HYDROGEN ATOMS HAVE BEEN SUBSTITUTED WITH A FLUORINE ATOM | OCTYL GROUP IN WHICH A PART OR ALL OF HYDROGEN ATOMS HAVE BEEN SUBSTITUTED WITH A FLUORINE ATOM | NONYL GROUP IN WHICH A PART OR ALL OF HYDROGEN ATOMS HAVE BEEN SUBSTITUTED WITH A FLUORINE ATOM |
| $R^9$ | METHOXYCARBONYL GROUP | METHOXYCARBONYL GROUP | METHOXYCARBONYL GROUP | METHOXYCARBONYL GROUP |
| FLUORINE-ATOM SUBSTITUTION RATE (%) | 50% OR MORE | 50% OR MORE | 50% OR MORE | 50% OR MORE |
| CONSUMED CURRENT (mA) | 15 | 23 | 25 | 50 |

Example B1-12

A surface-treating agent was prepared by dissolving 50 parts by mass of tris(1H,1H,5H-octafluoro-n-pentyl) phosphate as a fluorine-containing phosphoric ester and 50 parts by mass of a perfluoroalkyl ethylene oxide adduct as a fluorine type surfactant in a solvent having a boiling point of 350° C. In this case, with respect to 100 parts by mass of the solvent, the phosphoric ester and the fluorine type surfactant were dissolved so that the total thereof was 1.5 parts by mass. As described above, the surface-treating agent was obtained.

Next, after the housings (made of brass) were immersed in the surface-treating agent, the solvent was evaporated.

Example B1-13 to B1-16

Except that a surface-treating agent was obtained using a solvent shown in Table B1-3, the housings were processed by the surface-treating agent in a manner similar to that of Example B1-12.

[Drying Condition]

The housings (made of brass) processed by the surface-treating agent were observed. The results are shown in Table B1-3. Reference numerals of Table B1-3 indicate the following.

A: Drying was well performed.

B: Stickiness was observed for a certain time.

In addition, in Example B1-12 to B1-16, except that tris(1H,1H,5H-octafluoro-n-pentyl) phosphite or bis(2',2',2-trifluoroethyl)(methoxycarbonyl) phosphonate was used instead of using tris(1H,1H,5H-octafluoro-n-pentyl) phosphate, the housings were processed by the surface-treating agent in a manner similar to that described above. In this case, the drying condition was the same as that of Example B1-12 to B1-16.

TABLE 21

Table B1-3

| | EXAMPLE B1-12 | EXAMPLE B1-13 | EXAMPLE B1-14 | EXAMPLE B1-15 | EXAMPLE B1-16 |
|---|---|---|---|---|---|
| BOILING POINT (° C.) | 350 | 250 | 180 | 50 | 30 |
| EVALUATION | B | B | A | A | A |

Example B1-17

A surface-treating agent was prepared by dissolving 50 parts by mass of tris(1H,1H,5H-octafluoro-n-pentyl) phosphate as a fluorine-containing phosphoric ester and 50 parts by mass of a perfluoroalkyl ethylene oxide adduct as a fluorine type surfactant in isopropyl alcohol. In this case, with respect to 100 parts by mass of isopropyl alcohol, the phosphoric ester and the fluorine type surfactant were dissolved so that the total thereof was 0.1 parts by mass. As described above, the surface-treating agent was obtained.

Next, as in Example B1-1, an actuator was formed (see FIGS. 1 and 2) in which the housing sides of the sliding portions were processed by the surface-treating agent.

A camera module was connected to the actuator processed by the surface-treating agent. This camera module was reciprocated. Since the camera module described above has no zoom function and was smaller than a camera module mounted in a usual cellular phone, loads applied to the rotor and the gears were small.

manner similar to that described above. In this case, the evaluation results were also the same as those of Example B1-17 to B1-23.

[Oil Repellency]

Besides the housing 2*a* used for forming the actuator, another housing 2*a* processed by the surface-treating agent was prepared and was supplied with the lubricant (1), and the condition of the another housing 2*a* was observed. The lubricant (1) was obtained by mixing 95 parts by mass of the polymer (B) (kinematic viscosity at 40° C.: approximately 5.0 cSt) as a base oil which was obtained by polymerizing 1-nonene, 1-decene, 1-undecene, and 1-dodecen and which had 20 to 30 carbon atoms in total in the polymer and 95 parts by mass of trioleyl phosphite (TOP2) as an anti-wear agent. Reference numerals of Table B1-4 indicate the following.

A: The lubricant (1) did not flow, and its oil repellency was superior.

B: The lubricant (1) flowed and spread, and its oil repellency was inferior.

TABLE 22

Table B1-4

| | | EXAMPLE B1-17 | EXAMPLE B1-18 | EXAMPLE B1-19 | EXAMPLE B1-20 | EXAMPLE B1-21 | EXAMPLE B1-22 | EXAMPLE B1-23 |
|---|---|---|---|---|---|---|---|---|
| TOTAL OF FLUORINE-CONTAINING PHOSPHORIC ESTER AND FLUORINE TYPE SURFACTANT (PARTS BY MASS) | | 0.1 | 0.2 | 0.3 | 1.0 | 1.3 | 1.5 | 2.0 |
| EVALUATION | SURFACE CONDITION OF HOUSING | A | A | A | A | A | A | B |
| | OIL REPELLENCY | B | A | A | A | A | A | A |
| | SLIDING PROPERTY | B | B | A | A | A | A | — |

Example B1-18 to B1-23

Except that a surface-treating agent was obtained in which with respect to 100 parts by mass of isopropyl alcohol, the phosphoric ester and the fluorine type surfactant were used in a total amount shown in Table B1-4, an actuator was assembled in a manner similar to that of Example B1-17 and was reciprocated.

[Surface Condition of Housing]

Before the actuator was assembled, the housings (made of brass) processed by the surface-treating agent were observed. The results are shown in Table B1-4. Reference numerals of Table B1-4 indicate the following.

A: Surface condition was good.

B: Stickiness was observed.

[Evaluation of Sliding Properties]

The consumed current (mA) of the actuator was measured. The results are shown in Table B1-4. Reference numerals of Table B1-4 indicate the following.

A: The consumed current (mA) was 27 (mA) or less, and the sliding property was superior.

B: The consumed current (mA) was 27 (mA) or more, and the sliding property was inferior.

In addition, in Example B1-17 to B1-23, except that tris (1H,1H,5H-octafluoro-n-pentyl) phosphite or bis(2',2',2-trifluoroethyl)(methoxycarbonyl) phosphonate was used instead of using tris(1H,1H,5H-octafluoro-n-pentyl) phosphate, the housings were processed by the surface-treating agent in a Example B2-1

A surface-treating agent was prepared by dissolving 50 parts by mass of tris(1H,1H,5H-octafluoro-n-pentyl) phosphate as a phosphoric ester and 50 parts by mass of a perfluoroalkyl ethylene oxide adduct as a fluorine type surfactant in isopropyl alcohol. In this case, with respect to 100 parts by mass of isopropyl alcohol, the phosphoric ester and the fluorine type surfactant were dissolved so that the total thereof was 1.5 parts by mass.

Next, as in Example B1-1, an actuator was formed (see FIGS. 1 and 2) in which the housing sides of the sliding portions were processed by the surface-treating agent.

A camera module was connected to the actuator processed by the surface-treating agent. This camera module was reciprocated at 80° C. As the camera module described above, a module was used in which a load applied to the rotation output shaft 10*a* by the reciprocation was 3.0 times that of Example B1-9-1.

Example B2-2

The lubricant (1) was obtained by mixing 95 parts by mass of the polymer (B) (kinematic viscosity at 40° C.: approximately 5.0 cSt) as a base oil which was obtained by polymerizing 1-nonene, 1-decene, 1-undecene, and 1-dodecen and which had 20 to 30 carbon atoms in total in the polymer and 95 parts by mass of trioleyl phosphite (TOP2) as an anti-wear agent. The base oil was a refined oil. In addition, in the following examples, a refined base oil was used unless otherwise particularly noted. The anti-wear agent was a reagent grade agent. In addition, in the following examples, a reagent grade anti-wear agent was used unless otherwise particularly noted.

The lubricant (2) was obtained by mixing 95 parts by mass of the polymer (B) (kinematic viscosity at 40° C.: approximately 5.0 cSt) as a base oil which was obtained by polymerizing 1-nonene, 1-decene, 1-undecene, and 1-dodecen and which had 20 to 30 carbon atoms in total in the polymer and 40 parts by mass of polytetrafluoroethylene particles (the contents of particles having a particle diameter of 10 μm or less and 1 μm or less were 100 percent by mass and 90 percent by mass or more, respectively, and the aspect ratio was 0.5) as an anti-wear agent.

Next, an actuator (housings, a rotor, and gears made of brass were used) processed by the surface-treating agent used in Example B2-1, the lubricant (1), and the lubricant (2) was formed (see FIGS. 1 and 2).

In particular, after the housings 2*a* and 2*b* were immersed in the surface-treating agent, the solvent was evaporated. Subsequently, in the housing 2*a* processed by the surface-treating agent, the lubricant (1) was supplied in the holes into which the rotor 12 and the first torque increasing gear 6 were to be inserted, and the lubricant (2) was supplied in the holes into which the second torque increasing gear 8 and the output gear 10 were to be inserted. Subsequently, the rotor 12, the first torque increasing gear 6, the second torque increasing gear 8, and the output gear 10 were inserted in the housing 2*a*, and the housing 2*b* processed by the surface-treating agent was fitted thereto so as to sandwich the rotor 12, the first torque increasing gear 6, the second torque increasing gear 8, and the output gear 10 therebetween. Finally, the lubricant (1) was supplied in the holes into which the rotor 12 and the first torque increasing gear 6 were inserted, and the lubricant (2) was supplied in the holes into which the second torque increasing gear 8 and the output gear 10 were inserted.

A camera module was connected to the actuator processed by the surface-treating agent, the lubricant (1), and the lubricant (2). This camera module was reciprocated at 80° C. for 100 hours. As the camera module described above, a module was used in which a load applied to the rotation output shaft 10*a* by the reciprocation was 3.0 times that of Example B1-9-1.

Reference Example B2-1

Except that the surface-treating agent was not used, an actuator was formed in a manner similar to that in Example B2-2, and a camera module was connected thereto. This camera module was reciprocated at 80° C. As this camera module, a module was used in which a load applied to the rotation output shaft 10*a* by the reciprocation was 3.0 times that of Example B1-9-1.

[Evaluation of Durability]

A time required to stop the operation caused by wear of the sliding portion was measured. The times in Examples B2-1 and B2-2 and Reference Example B2-1 were 100, 1,500, and 500 hours, respectively.

[Evaluation of Silence Property]

The camera module was removed for the evaluation of the silence property. The actuator was driven, and the loudness of sound generated by rotation of the output shaft 10*a* was evaluated into one of ten levels. In particular, the actuator was set in an anechoic room, a microphone was placed at a position 20 mm apart from the actuator, and a sound generated during driving was picked up. The level of Example B2-1 was 1, the level of Example B2-2 was 1+(superior to 1), and the level of Reference Example B2-1 was 7. A smaller value indicates lower loudness. In addition, when the level is 7 or less, and this actuator is used to drive a camera module of a cellular phone, a drive sound is not a level to cause a problem even when an animation is taken.

In addition, in Examples B2-1 and B2-2 and Reference Example B2-1, except that as a surface-treating agent, tris (1H,1H,5H-octafluoro-n-pentyl) phosphite or bis(2',2',2-trifluoroethyl)(methoxycarbonyl) phosphonate trioleyl phosphite was used instead of using tris(1H,1H,5H-octafluoro-n-pentyl) phosphate, an actuator was formed in a manner similar to that described above and was reciprocated. In this case, the evaluation results of the durability and the silence property were also the same as those of Examples B2-1 and B2-2 and Reference Example B2-1.

In addition, in Examples B2-1 and B2-2 and Reference Example B2-1, when the reciprocation was performed as described above except that only the temperature was changed, in a temperature range down to −40° C., the evaluation results of the durability and the silence property were also the same as those of Examples B2-1 and B2-2 and Reference Example B2-1.

In addition, when the lubricant (1) and the lubricant (2) formed in Examples B2-2 and Reference Example B2-1 were each held at 90° C., the change in weight thereof was 0.05 percent by mass or less, and the total acid number was 0.06 mgKOH/g or less.

Sliding Portion of Watch

Example C1-1

By addition of 10 percent by weight of a viscosity index improver [polyacrylate (neutralization value: 0.1, kinematic viscosity measured at 100° C.: 850 cSt)], 4 percent by weight of an anti-wear agent [neutral phosphoric ester (trioleyl phosphate)], 0.5 percent by weight of an antioxidant [phenol-based antioxidant (2,6-di-t-butyl-p-cresol)], and 0.05 percent by weight of a metal deactivator [benzotriazole] to a polyol ester [neopentyl glycol caprylate caprate mixed ester (kinematic viscosity measured at 100° C.: 2.5 cSt)] having a kinematic viscosity of 1,500 cSt or less at −30° C., a lubricating oil composition was prepared as a watch lubricating oil in which the kinematic viscosities at −30° C. and 80° C. were 1,500 cSt or less and 13 cSt or more, respectively, the change in weight obtained when the composition was held at 90° C. was 1.62 percent by weight or less, and the total acid number was 0.2 mgKOH/g or less.

In addition, a surface-treating agent was prepared by dissolving 50 parts by mass of tris(1H,1H,5H-octafluoro-n-pentyl) phosphate as a phosphoric ester and 50 parts by mass of a perfluoroalkyl ethylene oxide adduct as a fluorine type surfactant in isopropyl alcohol. In this case, with respect to 100 parts by mass of isopropyl alcohol, the phosphoric ester and the fluorine type surfactant were dissolved so that the total thereof was 1.5 parts by mass.

The Watch Movement™ manufactured by Citizen Watch Co., Ltd. (No. 2035: the wheel row section was made of metal (primarily made of brass and iron)) was formed. In particular, after a bottom plate was processed by the surface-treating agent, the watch movement was assembled, and the watch lubricating oil was supplied to sliding portions with gears. Alternately, after the gears and the bottom plate were processed by the surface-treating agent, the watch movement was assembled, and the watch lubricating oil was supplied to the sliding portions with the gears.

[Evaluation of Durability]

A durability test was performed using 20 samples in which hand rotation was performed at ordinary temperature at a rate of 64 times the usual rate for a period corresponding to 20 years. According to the results, all the samples could be properly operated even after the durability test.

[Evaluation of Silence Property]

For the evaluation of the silence property, the watch movement was continuously driven at 80° C., and the loudness of sound generated during driving was evaluated into one of ten levels. In particular, the watch movement was set in an anechoic room, a microphone was placed at a position 20 mm apart from the watch movement, and a sound generated during driving was picked up. The level of Example C1-1 was 1+ (superior to 1). A smaller value indicates lower loudness. In addition, when the level is 7 or less, a drive sound of this watch movement is not a level to cause a problem, for example, when an animation is taken.

In addition, in Example C1-1, when the amount of the viscosity index improver was changed to 0.1 to 20 percent by weight, and/or when the amount of the anti-wear agent was changed to 0.1 to 8 percent by weight, the evaluation results of the durability and the silence property were also the same as those of Example C1-1.

In addition, in Example C1-1, when instead of using the neopentyl glycol caprylate caprate mixed ester, a trimethylolpropane valerate heptanoate mixed ester (kinematic viscosity measured at 100° C.: 3.0 cSt) was used, when instead of using the polyacrylate, a polymethacrylate (neutralization value: 0.1, kinematic viscosity measured at 100° C.: 850 cSt), a polyisobutylene (kinematic viscosity measured at 100° C.: 1,000 cSt), a poly(alkyl styrene) [poly(ethyl styrene) (kinematic viscosity measured at 100° C.: 600 cSt)], a polyester [poly(ethylene fumarate) (kinematic viscosity measured at 100° C.: 500 cSt)], isobutylene fumarate (kinematic viscosity measured at 100° C.: 1,000 cSt), styrene maleate ester (kinematic viscosity measured at 100° C.: 3,000 cSt), or vinyl acetate fumarate ester (kinematic viscosity measured at 100° C.: 1,800 cSt) was used, when instead of using the trioleyl phosphate, trixylenyl phosphite was used, and/or when instead of using the phenol-based antioxidant (2,6-di-t-butyl-p-cresol), an amine-based antioxidant (diphenylamine derivative; trade name: Irganox L57, manufactured by Ciba Specialty Chemicals Inc.) was used, a lubricating oil composition was also prepared as a watch lubricating oil in which the kinematic viscosities at −30° C. and 80° C. were 1,500 cSt or less and 13 cSt or more, respectively, the change in weight obtained when the composition was held at 90° C. was 1.62 percent by weight or less, and the total acid number was 0.2 mgKOH/g or less. In these cases, the evaluation results of the durability and the silence property were also the same as those of Example C1-1.

In Example C1-1, except that as a surface-treating agent, instead of using the tris(1H,1H,5H-octafluoro-n-pentyl) phosphate, tris(1H,1H,5H-octafluoro-n-pentyl) phosphite or bis(2',2',2-trifluoroethyl)(methoxycarbonyl) phosphonate trioleyl phosphite was used, a watch movement was formed in a manner similar to that described above and was continuously driven. In this case, the evaluation results of the durability and the silence property were also the same as those of Example C1-1.

In addition, in Example C1-1, when the continuous driving was performed as described above except that only the temperature was changed, in a temperature range down to −30° C., the evaluation results of the durability and the silence property were also the same as those of Example C1-1.

Example C1-2

By addition of 10 percent by weight of a viscosity index improver [polyacrylate; poly(methyl acrylate) (kinematic viscosity measured at 100° C.: 850 cSt, neutralization value: 0.1)], 4 percent by weight of an anti-wear agent [neutral phosphoric ester (trioctyl phosphate)], 0.5 percent by weight of an antioxidant [phenol-based antioxidant (2,6-di-t-butyl-p-cresol)], and 0.05 percent by weight of a metal deactivator [benzotriazole] to a paraffinic hydrocarbon oil [having 30 carbon atoms or more; trade name: PA0501, manufactured by Chevron Corp.] having a kinematic viscosity of 1,500 cSt or less at −30° C., a lubricating oil composition was prepared as a watch lubricating oil in which the kinematic viscosities at −30° C. and 80° C. were 1,500 cSt or less and 13 cSt or more, respectively, the change in weight obtained when the composition was held at 90° C. was 10 percent by weight or less, and the total acid number was 0.2 mgKOH/g or less.

In addition, a surface-treating agent was prepared by dissolving 50 parts by mass of tris(1H,1H,5H-octafluoro-n-pentyl) phosphate as a phosphoric ester and 50 parts by mass of a perfluoroalkyl ethylene oxide adduct as a fluorine type surfactant in isopropyl alcohol. In this case, with respect to 100 parts by mass of isopropyl alcohol, the phosphoric ester and the fluorine type surfactant were dissolved so that the total thereof was 1.5 parts by mass.

The watch Movement™ manufactured by Citizen Watch Co., Ltd. (No. 2035: the wheel row section was made of metal (primarily made of brass and iron)) was formed. In particular, the watch movement was formed in a manner similar to that of Example C1-1.

[Evaluation of Durability]

The durability test was performed using 20 samples in which hand rotation was performed at ordinary temperature at a rate of 64 times the usual rate for a period corresponding to 20 years. According to the results, all the samples could be properly operated even after the durability test.

[Evaluation of Silence Property]

For the evaluation of the silence property, the watch movement was continuously driven at 80° C., and the loudness of sound generated during driving was evaluated into one of ten levels. In particular, the watch movement was set in an anechoic room, a microphone was placed at a position 20 mm apart from the watch movement, and a sound generated during driving was picked up. The level of Example C1-2 was 1+ (superior to 1). A smaller value indicates lower loudness. In addition, when the level is 7 or less, a drive sound of this watch movement is not a level to cause a problem, for example, when an animation is taken.

In addition, in Example C1-2, when the amount of the viscosity index improver was changed to 0.1 to 15 percent by weight, and/or when the amount of the anti-wear agent was changed to 0.1 to 8 percent by weight, the evaluation results of the durability and the silence property were also the same as those of Example C1-2.

In addition, in Example C1-2, when instead of using the polyacrylate, a polymethacrylate [poly(methyl methacrylate) (kinematic viscosity measured at 100° C.: 1,550 cSt, neutralization value: 0.1], a polyisobutylene (kinematic viscosity measured at 100° C.: 1,000 cSt), a poly(alkyl styrene) [poly (ethyl styrene) (kinematic viscosity measured at 100° C.: 600 cSt)], a polyester [poly(ethylene fumarate) (kinematic viscosity measured at 100° C.: 500 cSt)], isobutylene fumarate (kinematic viscosity measured at 100° C.: 1,000 cSt), styrene maleate ester (kinematic viscosity measured at 100° C.: 3,000 cSt), or vinyl acetate fumarate ester (kinematic viscosity measured at 100° C.: 1,800 cSt) was used, when trioleyl phosphite was used instead of using the trioctyl phosphate, and/or when instead of using the phenol-based antioxidant (2,6-di-t-butyl-p-cresol), an amine-based antioxidant (diphenylamine derivative; trade name: Irganox L57, manufactured by Ciba Specialty Chemicals Inc.) was used, a lubricating oil composition was also prepared as a watch lubricating oil in which the kinematic viscosities at −30° C. and 80° C. were 1,500 cSt or less and 13 cSt or more, respectively, the change in weight obtained when the composition was held at 90° C. was 1.62 percent by weight or less, and the total acid number was 0.2 mgKOH/g or less. In these cases, the evaluation results of the durability and the silence property were the same as those of Example C1-2.

In Example C1-2, except that as a surface-treating agent, instead of using the tris(1H,1H,5H-octafluoro-n-pentyl) phosphate, tris(1H,1H,5H-octafluoro-n-pentyl) phosphite or bis(2',2',2-trifluoroethyl)(methoxycarbonyl) phosphonate trioleyl phosphite was used, a watch movement was formed in a manner similar to that described above and was continuously driven. In this case, the evaluation results of the durability and the silence property were also the same as those of Example C1-2.

In addition, in Example C1-2, when the continuous driving was performed as described above except that only the temperature was changed, in a temperature range down to −30° C., the evaluation results of the durability and the silence property were also the same as those of Example C1-2.

Example C1-3

A lubricating oil composition having a total acid number of 0.2 mgKOH/g or less was prepared as a watch lubricating oil which included an ether oil [trade name: MORESCO-HI-LUBE LB15, manufactured by MORESCO Corporation] as a base oil, 4 parts by weight of an anti-wear agent [neutral phosphoric ester (trioctyl phosphate)], and an antioxidant (2,6-di-t-butyl-p-cresol).

In addition, a surface-treating agent was prepared by dissolving 50 parts by mass of tris(1H,1H,5H-octafluoro-n-pentyl) phosphate as a phosphoric ester and 50 parts by mass of a perfluoroalkyl ethylene oxide adduct as a fluorine type surfactant in isopropyl alcohol. In this case, with respect to 100 parts by mass of isopropyl alcohol, the phosphoric ester and the fluorine type surfactant were dissolved so that the total thereof was 1.5 parts by mass.

The Watch Movement™ manufactured by Citizen Watch Co., Ltd. (No. 2035: the wheel row section was made of metal (primarily made of brass and iron)) was formed. In particular, the watch movement was formed in a manner similar to that of Example C1-1.

[Evaluation of Durability]

The durability test was performed using 20 samples in which hand rotation was performed at ordinary temperature at a rate of 64 times the usual rate for a period corresponding to 20 years. According to the results, all the samples could be properly operated even after the durability test.

[Evaluation of Silence Property]

For the evaluation of the silence property, the watch movement was continuously driven at 80° C., and the loudness of sound generated during driving was evaluated into one of ten levels. In particular, the watch movement was set in an anechoic room, a microphone was placed at a position 20 mm apart from the watch movement, and a sound generated during driving was picked up. The level of Example C1-3 was 1+ (superior to 1). A smaller value indicates lower loudness. In addition, when the level is 7 or less, a drive sound of the watch movement is not a level to cause a problem, for example, when an animation is taken.

In Example C1-3, when the amount of the anti-wear agent was changed to 0.1 to 8 percent by weight, the evaluation results of the durability and the silence property were also the same as those of Example C1-3.

In addition, in Example C1-3, when trioleyl phosphite was used instead of using the trioctyl phosphate, a lubricating oil composition was also prepared as a watch lubricating oil having a total acid number of 0.2 mgKOH/g or less. In this case, the evaluation results of the durability and the silence property were also the same as those of Example C1-3.

In Example C1-3, except that as a surface-treating agent, instead of using the tris(1H,1H,5H-octafluoro-n-pentyl) phosphate, tris(1H,1H,5H-octafluoro-n-pentyl) phosphite or bis(2',2',2-trifluoroethyl)(methoxycarbonyl) phosphonate trioleyl phosphite was used, a watch movement was formed in a manner similar to that described above and was continuously driven. In this case, the evaluation results of the durability and the silence property were also the same as those of Example C1-3.

In addition, in Example C1-3, when the continuous driving was performed as described above except that only the temperature was changed, in a temperature range down to −30° C., the evaluation results of the durability and the silence property were also the same as those of Example C1-3.

Example C1-4

By addition of a viscosity improver (polyacrylate), 4 percent by weight of an anti-wear agent (neutral phosphoric ester), 0.5 percent by weight of an antioxidant (phenol-based antioxidant), and 0.05 percent by weight of a metal deactivator (benzotriazole) to a polyol ester (neopentyl glycol caprylate caprate mixed ester), a watch lubricating oil was formed in which the viscosity was 200 to 400 mPa·s at 20° C., the change in weight obtained when the composition was held at 90° C. was 1.62 percent by weight or less, and the total acid number was 0.2 mgKOH/g or less.

In addition, a surface-treating agent was prepared by dissolving 50 parts by mass of tris(1H,1H,5H-octafluoro-n-pentyl) phosphate as a phosphoric ester and 50 parts by mass of a perfluoroalkyl ethylene oxide adduct as a fluorine type surfactant in isopropyl alcohol. In this case, with respect to 100 parts by mass of isopropyl alcohol, the phosphoric ester and the fluorine type surfactant were dissolved so that the total thereof was 1.5 parts by mass.

The Watch Movement™ manufactured by Citizen Watch Co., Ltd. (No. 2035: the wheel row section was made of metal (primarily made of brass and iron)) was formed. In particular, the watch movement was formed in a manner similar to that of Example C1-1.

[Evaluation of Durability]

The durability test was performed using 20 samples in which hand rotation was performed at ordinary temperature at a rate of 64 times the usual rate for a period corresponding to 20 years. According to the results, all the samples could be properly operated even after the durability test.

[Evaluation of Silence Property]

For the evaluation of the silence property, the watch movement was continuously driven at 80° C., and the loudness of sound generated during driving was evaluated into one of ten levels. In particular, the watch movement was set in an anechoic room, a microphone was placed at a position 20 mm apart from the watch movement, and a sound generated during driving was picked up. The level of Example C1-4 was 1+(superior to 1). A smaller value indicates lower loudness. In addition, when the level is 7 or less, a drive sound of the watch movement is not a level to cause a problem, for example, when an animation is taken.

In Example C1-4, when the amount of the anti-wear agent was changed to 0.1 to 8 percent by weight, the evaluation results of the durability and the silence property were also the same as those of Example C1-4.

In addition, in Example C1-4, when instead of using the neopentyl glycol caprylate caprate mixed ester, a polyol ester (trimethylolpropane valerate heptanoate mixed ester) or PAO4 (the viscosity at 100° C. was approximately 4) was used, when instead of using the polyacrylate, a polymethacrylate, a polyisobutylene, a poly(alkyl styrene), a polyester, isobutylene fumarate, styrene maleate ester, vinyl acetate fumarate ester, a high-viscosity polyol ester, or a PAO having a high molecular weight was used, when instead of using the neutral phosphoric ester, a neutral phosphorous ester was used, and/or when instead of using the phenol-based antioxidant, an amine-based antioxidant, such as a diphenylamine derivative, was used, a watch lubricating oil was also prepared in which the viscosity was 200 to 400 mPa·s at 20° C., the change in weight obtained when the composition was held at 90° C. was 1.62 percent by weight or less, and the total acid number was 0.2 mgKOH/g or less. In these cases, the evaluation results of the durability and the silence property were also the same as those of Example C1-4.

In Example C1-4, except that as a surface-treating agent, instead of using the tris(1H,1H,5H-octafluoro-n-pentyl) phosphate, tris(1H,1H,5H-octafluoro-n-pentyl) phosphite or bis(2',2',2-trifluoroethyl)(methoxycarbonyl) phosphonate trioleyl phosphite was used, a watch movement was formed in a manner similar to that described above and was continuously driven. In this case, the evaluation results of the durability and the silence property were also the same as those of Example C1-4.

In addition, in Example C1-4, when the continuous driving was performed as described above except that only the temperature was changed, in a temperature range down to −30° C., the evaluation results of the durability and the silence property were also the same as those of Example C1-4.

REFERENCE SIGNS LIST

2*a*, 2*b*: housing
4: two-pole step motor
6: first torque increasing gear
6*a*: pinion
6*b*: gear
8: second torque increasing gear
8*a*: pinion
8*b*: gear
10: output gear
10*a*: rotation output shaft
10*b*: gear
12: rotor
14: stator
14*a*: rotor hole
14*b* and 14*c*: projection
16*a* and 16*b*: coil
18*a* and 18*b*: connection point

The invention claimed is:

1. A lubrication kit used for a small electronic device or a watch having a sliding portion, comprising:

a lubricant (1) comprising an anti-wear agent and a base oil containing a polyol ester oil and/or a paraffinic hydrocarbon oil, 85 to 99.5 parts by mass of the base oil and 0.5 to 15 parts by mass of the anti-wear agent being comprised with respect to 100 parts by mass of the total of the base oil and the anti-wear agent, a lubricant (2) comprising an anti-wear agent, polytetrafluoroethylene particles, and a base oil containing a polyol ester oil and/or a paraffinic hydrocarbon oil, 85 to 99.5 parts by mass of the base oil and 0.5 to 15 parts by mass of the anti-wear agent being comprised with respect to 100 parts by mass of the total of the base oil and the anti-wear agent, 30 to 50 parts by mass of the polytetrafluoroethylene particles being comprised with respect to 100 parts by mass of the total of the base oil and the anti-wear agent, and a surface-treating agent obtained from a fluorine type surfactant and a phosphoric ester having a hydrocarbon group in which a part or all of hydrogen atoms have been substituted with a fluorine atom, wherein the fluorine type surfactant and the phosphoric ester are used in combination, wherein the anti-wear agent contained in the lubricant (1) and the lubricant (2) is a neutral phosphoric ester and/or a neutral phosphorous ester.

2. A small electronic device or a watch comprising: a sliding portion, wherein the sliding portion is adhered with the lubrication kit according to claim 1.

3. A method for manufacturing a small electronic device or a watch having a sliding portion, comprising a step of:

adhering, to the sliding portion, the lubrication kit according to claim 1.

* * * * *